US006422294B1

(12) United States Patent
Murata et al.

(10) Patent No.: US 6,422,294 B1
(45) Date of Patent: Jul. 23, 2002

(54) CASTING APPARATUS AND CASTING METHOD OF CYLINDER HEAD

(75) Inventors: Akira Murata; Akihiro Nakano; Nobuyuki Matsubayashi; Takayuki Shouju; Tomoyuki Nozaki; Shigeo Yano, all of Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/719,741

(22) PCT Filed: Apr. 25, 2000

(86) PCT No.: PCT/JP00/02686

§ 371 (c)(1),
(2), (4) Date: Dec. 15, 2000

(87) PCT Pub. No.: WO00/66296

PCT Pub. Date: Nov. 9, 2000

(30) Foreign Application Priority Data

Apr. 30, 1999 (JP) ..... 11-124391
Apr. 30, 1999 (JP) ..... 11-124396
Apr. 30, 1999 (JP) ..... 11-124400

(51) Int. Cl.[7] ..... B22D 17/12; B22D 27/04

(52) U.S. Cl. ..... 164/113; 164/125; 164/126; 164/312; 164/348

(58) Field of Search ..... 164/113, 312, 164/125, 126, 348

(56) References Cited

U.S. PATENT DOCUMENTS 4,671,337 A 6/1987 Hiroshi et al.
4,875,518 A 10/1989 Takeshi et al.

FOREIGN PATENT DOCUMENTS

| | | |
|---|---|---|
| EP | 0 445 355 B | 9/1991 |
| JP | 01 053755 | 3/1989 |
| JP | 04 084662 | 3/1992 |
| JP | 07 266020 | 10/1995 |
| JP | 09 225589 | 9/1997 |
| JP | 11 090613 | 4/1999 |

*Primary Examiner*—Kuang Y. Lin
(74) *Attorney, Agent, or Firm*—Nixon Peabody LLP; Donald R. Studebaker

(57) ABSTRACT

To obtain a high-quality cast product of a cylinder head, a proper directivity to the cooling process of the molten metal after a pouring process by utilizing the shape of a cylinder head is discussed. In a process where molten metal is injected to a casting mold cavity formed between upper and lower molds to fill it therewith so that the molten metal is solidified to form a cylinder head of an engine, a plurality of core protrusions corresponding to holes (plug holes and bolt holes) are formed in the upper mold, and a cooling means is attached to each of the core protrusions. With respect to cooling means attached to the plurality of core protrusions, those attached to the inner core protrusions comparatively closer to the center of the casting mold are designed so as to have a greater cooling capability than those attached to the outer core protrusions; therefore, with respect to the center portion and the outer portion of the casting mold cavity.

15 Claims, 32 Drawing Sheets

CASTING APPARATUS AND CASTING METHOD OF CYLINDER HEAD

TECHNICAL FIELD

The present invention relates to a casting apparatus and a casting method for cast-molding a cylinder head of an engine.

BACKGROUND ART

As is generally known, a cylinder head of an engine for an automobile engine or the like is provided with paths having complex shapes, such as air-supply and exhaust ports to a cylinder section, paths for engine cooling water (water jackets) and paths for engine oil (oil jackets), and also contains plug holes for ignition plugs corresponding to the number of cylinders and a number of bolt holes used at the time of assembling to a cylinder body; therefore, it has a complex shape as a whole which makes it difficult to apply machining processes such as cutting process, etc., and normally, its base material is therefore obtained as a cast product using an aluminum alloy, etc. as its material.

With respect to a casting method for cast-molding such a cylinder head, a so-called low-pressure casting method has been known in which molten metal inside a stoke is raised by pressing the surface of the molten metal inside a crucible by using compressed air, etc. so that the molten metal thus raised is supplied to a casting mold cavity to be cast (see, for example, Japanese Patent Laid-Open Publication No. 1-53755. In this low-pressure casting method, since the molten metal is pressurized by compressed air, etc., stable high-quality cast products can be obtained, and since virtually no or very little so-called feeder head is required in this method, it is possible to improve the yield of the material to a great degree; thus, this method has various advantages.

Here, in the case when gas such as air is contained in a casting mold cavity to which molten metal is injected to fill, such residual gas inside the cast product tends to cause cast defects such as "gross porosity", etc. In order to prevent the occurrence of such cast defects, it has been well known that an effective method is to give directivity to the cooling process of the molten metal after the casting process so as to allow solidification to start at a portion as far as possible from the gate. By cooling and solidifying the molten metal under such directivity, the residual gas inside the casting mold cavity is gradually driven to the gate side, and finally comes to reside in the gate portion, and in this state, the solidification can be finished. Since the gate portion is cut and removed as a waste portion after completion of the casting process, the possibility of residual gas inside the cast product as it is can be reduced correspondingly, and it becomes possible to effectively reduce the generation of cast defects.

In particular, in the above-mentioned low-pressure casting method, the gate is often formed on the lower mold side of the upper and lower molds, and in this case, gas residing inside the cavity filled with the molten metal is generally allowed to rise to the upper mold side that is far from the gate; therefore, it is essential to carry out the cooling process of the molten metal with directivity in such a manner that cooling of the molten metal is allowed to gradually proceed from the upper mold side farthest from the gate.

Moreover, when the molten metal inside the casting mold cavity is cooled and solidified, the outer side of the casting mold cavity closer to the casting mold surface is generally more susceptible to cooling than the center side thereof due to natural heat radiation outward from the casting mold; therefore, gas tends to reside on the center side of the casting mold cavity. For this reason, with respect to portions on the center side and portions on the outer side of the casting mold cavity as well, it is preferably to carry out the cooling process of the molten metal with directivity in such a manner that cooling of the molten metal is allowed to gradually proceed from the portions on the center side.

In other words, generally in the casting process, in order to improve the productivity, etc., a cooling process is prepared so as to accelerate the solidification of the molten metal upon solidifying the molten metal after the casting process; and in this cooling process, it is essential not only to simply increase the solidifying rate, but also to carry out a cooling process with the above-mentioned directivity.

As described above, in addition to air-supply and exhaust ports, the cylinder head of an engine is provided with passage sections such as the water jackets serving as paths for engine cooling water and the oil jackets serving as paths for engine oil. Therefore, in the case when such a cylinder head is cast-molded, cores corresponding these passage sections are assembled in the casting mold and casting is carried out therein.

When these cores are assembled inside the casting mold, core prints are placed at the ends of each core, and the core is generally assembled in the casting mold through these core prints. Here, in the present specification, "core print" includes to any of those installed integrally with the core main body and those formed on a separate member and used in combination with the core main body.

Among the above-mentioned passage sections, the water jackets and oil jackets are normally placed at parallel upper and lower positions close to each other, after predetermined path cross-sectional areas have been provided respectively within a limited space in the cylinder head.

Therefore, when cores for these two types of jackets are assembled in the casting mold, it is essential to maintain the distance between the axes of the two cores as accurately as possible so as to keep the thickness between the two types of jackets properly.

However, since these two types of jackets are installed in a manner so as to extend virtually over the entire length of the cylinder head in the length direction, the cores have considerably elongated shapes. Therefore, in the case when these cores are respectively assembled in the casting mold independently, it is difficult to stably maintain the distance between the axes of the two types of cores at a fixed value. Moreover, this case results in an increase in the number of the core assembling processes, and also makes the assembling device for the cores more complex, which causes disadvantages in reducing the production costs.

In particular, an arrangement has been proposed in which at least one portion of a casting mold face corresponding to the side face of the cylinder head is formed by an inner side face of a movable side mold that is allowed to slide in a direction (lateral direction) orthogonal to the mold-closing direction of the upper and lower casting molds (for example, Japanese Patent Laid-Open Publication No. 1-53755). However, in the case when such an arrangement is adopted, after the lower-side water jacket core has been set in the lower mold, the upper-side oil jacket core has to be set in the above-mentioned movable side mold.

However, this case raises a problem in which, since a portion of the casting mold that supports the sliding operation of the side mold is subjected to abrasion due to repeated sliding movements, it is difficult to maintain the distance between the axes of the two cores at a fixed value in a stable manner.

Moreover, in order to assemble the lower-side water jacket core of the two types of cores in the lower mold core print stopping portions are formed in portions of the casting mold corresponding to core prints on the two ends of the water jacket core, and engaging sections that engage the core print stopping portions are formed in the respective core print sides; thus, positioning and securing operations are generally carried out by allowing the engaging sections to engage the corresponding core print stopping portions.

However, in such a conventional arrangement, since the respective engaging sections are set in their shape and dimension so as to engage the core print stopping portions in a manner so as not to move in any directions in order to prevent positional offsets of the core, the core is secured in a completely rigid manner by the core print portions on the two ends. This arrangement tends to raise another problem in which, when, upon casting, molten metal is injected in the casting mold cavity so as to fill it, the core is susceptible to cracks and chips due to differences in the amount of thermal expansion between the metal casting mold and the core having casting sand as its main material Moreover, another arrangement has been proposed in which, instead of assembling the two types of cores for water jackets and oil jackets independently in the casting mold, the two cores are preliminarily assembled integrally, and these pre-assembled cores are assembled in the casting mold. However, even in this arrangement, the core is susceptible to cracks and chips due to differences in the amount of thermal expansion caused by temperature differences, etc. between the cores.

Moreover, as has been well known, the respective cores are formed by using casting sand as its main material with which a binder having resin as its main component is blended, and in this case, when such a core is assembled in the casting mold and subjected to a casting process, the binder contained in the core is gasified due to heat of the molten metal, and the residual gas inside the cast product tends to cause so-called gas defects. Therefore, in the casting process, it is essential to discharge such gas outside the casting mold quickly before the solidification of the molten metal.

However, since the water jacket core and the oil jacket core have elongated shapes as described earlier, it is difficult to discharge the gas generated inside thereof quickly outside the casting mold.

Here, in this case also, in order to prevent the generation of cast defects such as "gross porosity", etc, due to residual gas such as air inside the cast product, it is effective to give directivity to the cooling process of the molten metal after the casting process so as to allow solidification to start at a portion as far as possible from the gate. In particular, in the above-mentioned low-pressure casting method, it is more important to carry out the cooling process of the molten metal with such directivity.

In this case, it is very preferable if such directivity in the cooling process can be achieved by utilizing the core that more hardly transmits heat as compared with the metal casting mold, because of its main material of casting sand.

As has been well known, in the case when a cast product is obtained by injecting molten metal into a volume section formed between casting molds placed face to face with each other, in order to distribute the molten metal smoothly over the inner face of the casting molds, or in order to take the cast product after the solidification of the molten metal out of the casting mold smoothly, it is a general method to preliminarily apply a mold wash to the inner face of the casting mold, prior to a casting process.

For example, in the above-mentioned low-pressure casting method, since, in most cases, the gate is formed on the lower mold side of the upper and lower molds; consequently, in order to maintain a better molten-metal distributing property on the upper mold side that is susceptible to a temperature drop in the molten metal temperature, it is particularly essential to properly apply a mold wash to the inner face of the upper mold.

Moreover, in general, when, upon completion of a casting process, the upper mold is raised to open the molds, a resulting cast product is also raised together with the upper mold; therefore, it is necessary to separate the cast product from the upper mold. In this case, if the mold-releasing properly is poor, it is necessary to increase a pushing force of the ejector pin, and this makes the ejector mechanism bulky, and might cause damages to the resulting cast product. Therefore, from this viewpoint also, it is essential to properly apply a mold wash to the inner face of the upper mold.

In relation to the application method of a mold wash to the inner face of the casting mold (upper mold) in the low-pressure casting method, the applicant, etc. of the present application has proposed a coating method in which, upon application of a powder mold wash to the inner face of the upper mold, the mold wash, which has dropped without sufficiently adhering to the inner surface of the upper mold, is again allowed to adhere to the inner face of the upper mold so that the adhering efficiency of the mold wash is improved so as to provide an appropriate application process (see Japanese Patent Laid-Open Publication No. 9-225589).

Here, for example, in the case of a casting process for a cylinder head for an automobile, a plurality of side wall portions, which form casting mold faces corresponding to the side faces of the cylinder head, are installed in addition to a pair of upper and lower molds. In the cylinder head casting apparatuss in relation to the above-mentioned patent publications, these wall portions are formed as sand walls on the lower mold side; however, it has been well known in the art that these side wall portions are formed as molds, that is, as movable side wall casting molds that are slidable in a direction (lateral direction) virtually orthogonal to the opening and closing directions (up and down directions) of the upper and lower main casting molds.

In this arrangement in which the side wall portions are provided as the movable side wall casting molds slidable in the lateral direction, in general, all the movable side wall casting molds or at least one portion thereof (for example, in the case of four faces of the side wall portions, the side wall casting molds corresponding to, a least, two faces thereof) are arranged so as to be supported on the lower mold side.

However, in the case when the side wall casting molds are arranged in this manner, upon application of a mold wash, the coating process to the inner faces of the side wall cast molds has to be carried out in a separate manner from the inner face of the upper mold, and the coating process has to be conducted twice (that is, in two processes); this causes degradation in the efficiency of the process.

Moreover, upon application of the mold wash to the inner faces of the casting molds, it is essential to ensure a proper adhering property (contacting property) of the mold wash to the inner faces of the casting molds. Here, since the adhering property of the mold wash is influenced by the temperature of the casting mold, it is essential to properly control the casting mold temperature at the time of coating.

Furthermore, as described earlier, for example, upon carrying out the casting process for a cylinder head, after the cores corresponding to passage sections such as air-supply and exhaust ports to the cylinder section, paths for engine cooling water (water jacket) and paths for engine oil ,(oil jackets) have been assembled in the casting mold, the casting process is carried out, and these assembling process for the cores and the coating process of the mold wash are both carried out on the casting mold.

Therefore, in the case when the coating process of the mold wash and the assembling process for the cores are commonly carried out on the casting mold, it is important to carry out both of the processes in a properly synchronized timing so as to improve the production efficiency in the casting process as a whole.

DISCLOSURE OF THE INVENTION

Accordingly, the objectives of the present invention are basically described as follows: Upon cast-molding a cylinder head for an engine, a proper directivity is given to the cooling process of the molten metal after the casting process by utilizing the shape of the cylinder head so as to obtain high-quality cast products, and the distance between the axes of the two elongated cores is accurately maintained so as to prevent damage to the cores or so as to quickly discharge gas generated inside the cores out of the casting mold; thus, it is possible to reduce gas defects in the resulting cast mold. Moreover, upon application of the mold wash to the inner face of the casting mold provided with movable side wall casting molds, the efficiency of the coating process is improved, and the adhering property of the mold wash to the inner face of the casting mold is improved, or, when the coating process of the mold wash and the assembling process of the cores are carried out together, the production efficiency of the casting process as a whole is enhanced.

In order to achieve the above object, in a first aspect of the present invention, there is provided a casting apparatus of a cylinder head, which comprises a pair of upper and lower molds that are separably joined to each other and which cast-molds a cylinder head of an engine by injecting molten metal into a casting mold cavity formed between the two molds so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold.

In a second aspect of the present invention, there is provided a casting apparatus of a cylinder head as described in the first aspect, wherein a cooling medium of the cooling means attached to the inner core protrusions is liquid and a cooling medium of the cooling means attached to the outer core protrusions is gas.

Further, in a third aspect of the present invention, there is provided a casting apparatus of a cylinder head as described in the second aspect, wherein a removing means is installed so as to remove residual cooling medium inside the core protrusions after stoppage of the cooling operation of the cooling means attached the inner protrusions.

Still further, in a fourth aspect of the present invention, there is provided a casting apparatus of a cylinder head as described in the first aspect, wherein the core protrusions correspond to at least a plug hole located comparatively closer to the center of the cylinder head and a bolt hole located comparatively closer to the periphery of the cylinder head.

Still further, in a fifth aspect of the present invention, there is provided a casting apparatus of a cylinder head. as described in the first aspect, wherein side walls are provided so as to form a casting mold cavity with the upper and lower molds, and a spot cooling means, which restricts thermal conduction so as not to be exerted in any direction other than a specific direction, is installed at least in either the upper or lower mold.

Still further, in a sixth aspect of the present invention, there is provided a casting apparatus of a cylinder head as described in the first aspect, wherein first and second elongated cores are to be assembled in a mold before molten metal is injected into a casting mold cavity, wherein core prints are placed on both ends of each of the two cores; the first core is assembled in the casting mold through the core prints; and the second core is assembled in the casting mold with core prints thereof being supported by the core prints of the first core.

Still further, in a seventh aspect of the present invention, there is provided a casting apparatus of a cylinder head as described in the sixth aspect, wherein a suction means is installed so as to suck, through at least either of the core prints of the two cores, gas generated in the core or the other core at the time of a casting process.

Still further, in an eighth aspect of the present invention, there is provided a casting apparatus of a cylinder head as described in the first aspect, wherein side wall casting molds which form the side walls are supported by the upper mold; a mold cooling means is installed on the upper mold so as to cool the mold in accordance with the temperature thereof; the side wall casting molds are installed in a manner so as to be switched between a mold-closed state for forming a sealed volume section and a mold-opened state for allowing the volume section to open; and under conditions that all the side wall casting molds are set in the mold-closed state and that the upper mold is cooled to a temperature in a predetermined temperature range, a mold wash is applied to inner faces of the side wall casting molds and the upper mold.

Still further, in a ninth aspect of the present invention, there is provided a casting apparatus of a cylinder head, which comprises a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a spot cooling means, which restricts thermal conduction so as not to be exerted in any direction other than a specific direction, is installed at least in either the upper or lower mold.

Still further, in a tenth aspect of the present invention, there is provided a casting apparatus of a cylinder head as described in the ninth aspect, wherein the spot cooling means is formed by installing a cooling medium path inside a cylindrical member, the cylindrical member having one end face facing the inside of the casting-mold cavity and a peripheral portion being fitted to a mounting hole formed in the mold.

Still further, in an eleventh aspect of the present invention, there is provided a casting apparatus of a cylinder head as described in the ninth aspect, wherein one portion of the side walls is formed by a sand wall, with the spot cooling means being installed in the vicinity of the sand wall.

Still further, in a twelfth aspect of the present invention, there is provided a casting apparatus of a cylinder head as described in the ninth aspect, wherein: a molten metal supply section for supplying the molten metal to be injected into the casting mold cavity through the gate is installed below the lower mold; a predetermined space is formed between the molten metal supply section and the lower mold; a cooling medium path for the spot cooling means is placed in the space; and a communicating path for allowing the molten metal supply section to communicate with the gate is formed therein.

Still further, in a thirteenth aspect of the present invention, there is provided a casting apparatus of a cylinder. head, which comprises a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold, and in that a spot cooling means, which restricts thermal conduction so as not to be exerted in any direction other than a specific direction, is installed in the lower mold.

Still further, in a fourteenth aspect of the present invention, there is provided a casting method for a cylinder head, which comprises the steps of preparing a pair of upper and lower molds that are separably joined to each other and cast-molding a cylinder head of an engine by injecting molten metal into a casting mold cavity formed between the two molds so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold.

Still further, in a fifteenth aspect of the present invention, there is provided a casting method for a cylinder head as described in the fourteenth aspect, wherein side walls are provided so as to form a casting mold cavity with the upper and lower molds, and a spot cooling means, which restricts thermal conduction so as not to be exerted in any direction other than a specific direction, is installed at least in either the upper or lower mold.

Still further, in a Sixteenth aspect of the present invention, there is provided a casting method for a cylinder head as described in the fourteenth aspect, wherein first and second elongated cores are to be assembled in a mold before molten metal is injected into a casting mold cavity, wherein core prints are placed on both ends of each of the two cores; the first core is assembled in the casting mold through the core prints; and the second core is assembled in the casting mold with core prints thereof being supported by the core prints of the first core.

Still further, in a seventeenth aspect of the present invention, there is provided a casting method for a cylinder head as described in the sixteenth aspect, wherein a suction means is installed so as to suck, through at least either of the core prints of the two cores, gas generated in the core or the other core at the time of a casting process.

Still further, in an eighteenth aspect of the present invention, there is provided a casting method for a cylinder head as described in the fourteenth aspect, wherein side wall casting molds which form the side walls are supported by the upper mold; a mold cooling means is installed on the upper mold so as to cool the mold in accordance with the temperature thereof; the side wall casting molds are installed in a manner so as to be switched between a mold-closed state for forming a sealed volume section and a mold-opened state for allowing the volume section to open; and under conditions that all the side wall casting molds are set in the mold-closed state and that the upper mold is cooled to a temperature in a predetermined temperature range, a mold wash is applied to inner faces of the side wall casting molds and the upper mold.

Still further, in a nineteenth aspect of the present invention, there is provided a casting method for a cylinder head, which comprises the step of preparing a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a spot cooling means, which restricts thermal conduction so as not to be exerted in any direction other than. a specific direction, is installed at least in either the upper or lower mold.

Still further, in a twentieth aspect of the present invention, there is provided a casting method for a cylinder head , which comprises the step of preparing a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold, and in that a spot cooling means, which restricts thermal conduction so as not to be exerted in any direction other than a specific direction, is installed in the lower mold.

BEST MODE FOR CARRYING OUT THE INVENTION

Referring to Figures, the following description will discuss embodiments of the present invention in detail by exemplifying a case in which they are applied to a casting process for a cylinder head for used in an automobile engine.

Figure 1:
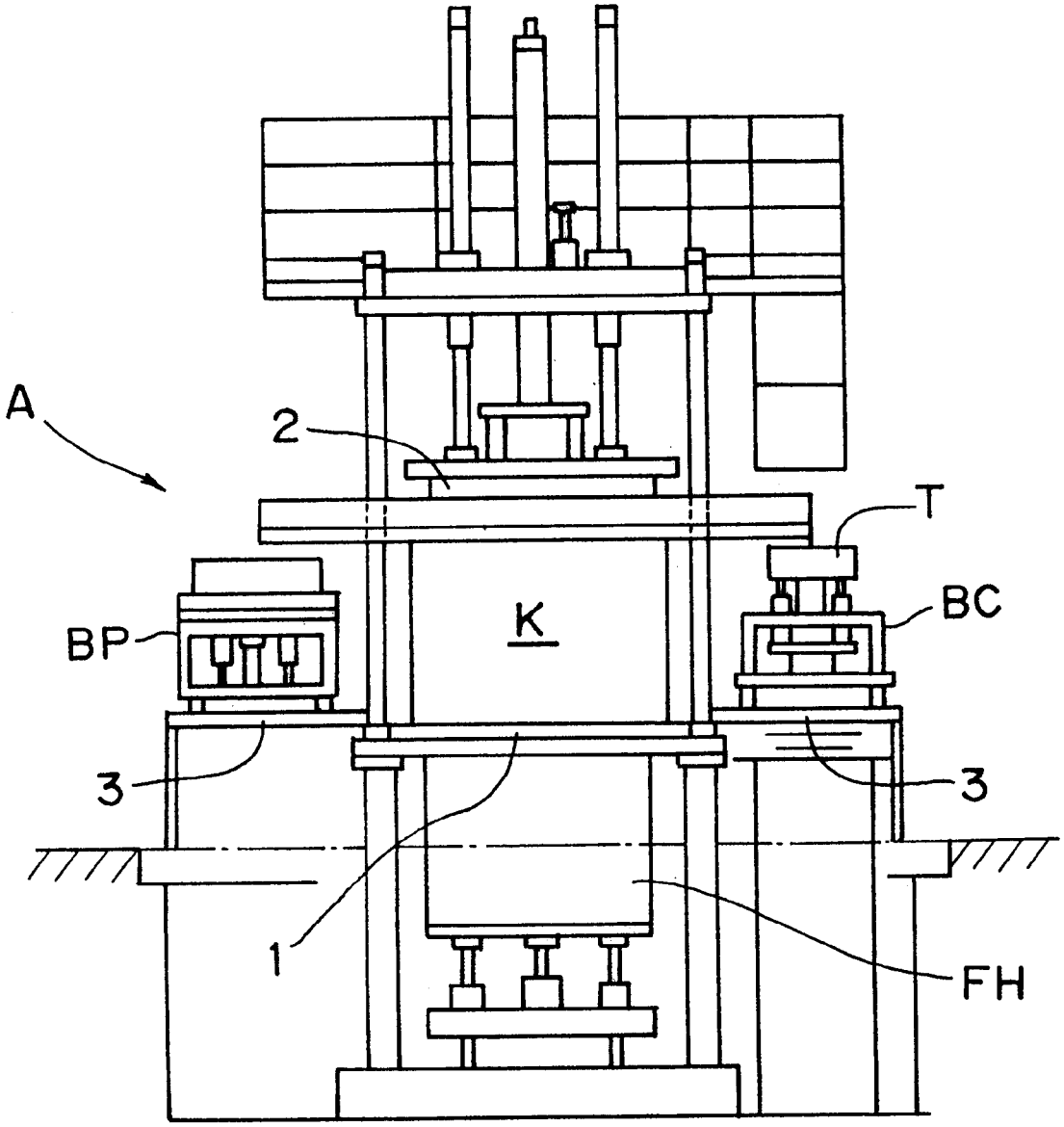
FIG. 1 is an explanatory front view that shows a casting apparatus in accordance with an embodiment of the present invention.
Figure 2:
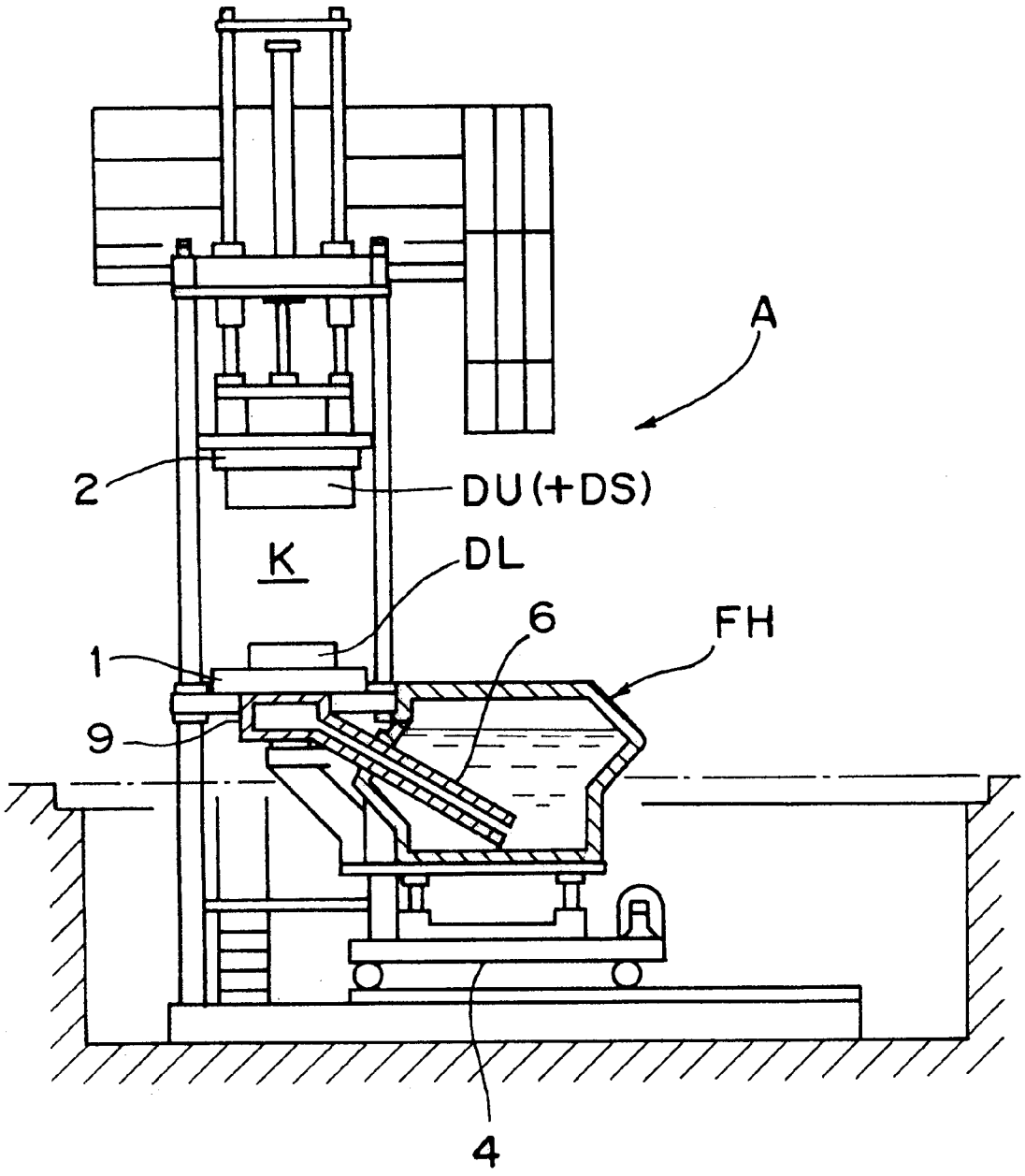
FIG. 2 is an explanatory side view that shows the casting apparatus.

FIGS. 1 and 2 are explanatory front and side views that show a casting apparatus in accordance with the present invention. This casting apparatus A is used for a so-called low-pressure casting process in which a lower mold DL and an upper mold DU are respectively attached to a lower platen 1 and an upper platen 2 so that the upper platen 2 is driven upward and downward with respect to the lower platen 1. In other words, the upper mold DU is allowed to shift upward and downward with respect to the lower mold DL; thus, the two molds are separably joined to each other (selectively between a mold-closed state in which their mold-joining faces contact each other and a mold-open state in which the two molds are separated from each other). As will be described later in detail, a plurality of side molds, which form side wall portions of a casting mold cavity and are allowed to slide, are attached to the upper mold DU.

A holding furnace FH for supplying molten metal at the time of casting is placed on the lower side of the lower platen 1 so that the molten metal is supplied from the lower mold DL side. In the present embodiment, for example, an aluminum (A1) alloy is used as a material for casting a cylinder head, and molten metal of the Al alloy is stored inside the holding furnace FH. The holding furnace FH is preferably secured onto a carriage 4 (holding furnace carriage), and the holding furnace carriage 4 is driven, if necessary, so that it is shifted with respect to the lower platen 1. Additionally, the outlines of the inner structure, etc. of the holding furnace FH and the low-pressure casting method using the holding furnace FH will be described later.

In the above-mentioned casting apparatus A, two carriages BC and BP are placed in such a manner that, when the upper mold DU has been raised and a mold open space K is formed between this and the lower mold DL, these two carriages are allowed to proceed and retreat to and from the mold open space K (in FIG. 2, these carriages are omitted for simplicity of the drawing).

As will be described later, the first carriage BP is basically used for setting a metal net to a gate of the lower mold DL and for taking the casted product out of the upper mold DU, and is, hereinafter, also occasionally referred to as "product receiving carriage". Moreover, as will be explained later in detail, the second carriage BC is basically used for setting a core, etc. into the lower mold DL and for applying a mold wash onto the upper mold DU, and is, hereinafter, also occasionally referred to as "core carriage". Moreover, these first and second carriages BP and BC are allowed to travel on the common rails 3. Additionally, detailed explanations of the structures, operations, etc. of the first and second carriages BP and BC will be given later.

Figure 3:
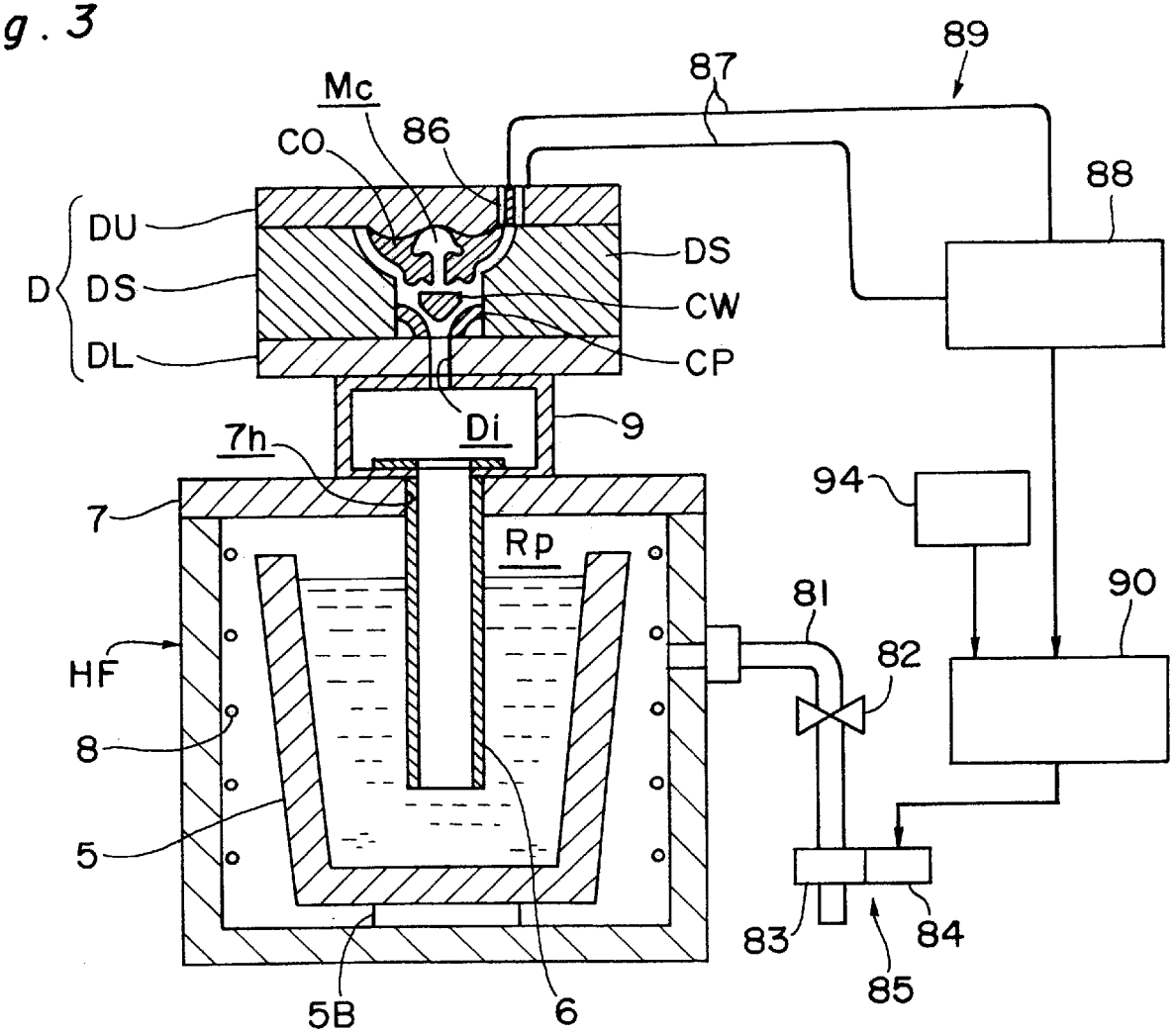
FIG. 3 is an explanatory vertical cross-sectional view of the holding furnace and casting mold that schematically shows the inner structure of the holding furnace of the casting apparatus.

Next, an explanation will be given of the holding furnace FH placed in the low-pressure casting apparatus A. FIG. 3 is an explanatory vertical cross-sectional view of the holding furnace and casting mold that schematically shows the inner structure of the holding furnace FH. As illustrated in this Figure, the holding furnace FH is formed into a box shape with an opening on the top, and a crucible 5 storing molten material (molten metal) is supported on a base 5B, and is housed inside thereof. A heater 8, which heats the molten metal inside the crucible and maintains it at a predetermined temperature, is placed on the inner wall face of the holding furnace FH.

Moreover, the upper opening of the holding furnace FH is closed in an air-tight state by a furnace lid 7 that is detachably attached thereto. Thus, an air-tight pressure room Rp covering the crucible 5 is formed inside the holding furnace FH.

A through-hole 7*h* is formed in the center of the lid 7, and a stoke 6 is inserted into this through-hole 7*h*. This stoke 6 communicates with a distributor 9 in its upper portion, and is dipped into the molten metal inside the crucible 5 in its lower portion. In the case when a plurality of gates Di is formed in the casting mold D, the distributor 9 is used for distributing and supplying the molten metal from the crucible 5 to the respective gates Di, and this is placed between the upper face of the holding furnace FH (that is, the upper face of the furnace lid 7) and the lower face of the casting mold D (that is, the lower face of the lower mold DL). Here, in the present embodiment, a plurality of gates Di (for example, four) are formed in the lower mold DL.

As will be described later, the casting mold D is constituted by the upper mold DU, the lower mold DL and a plurality of side molds DS, and inside a casting mold cavity Mc formed by the respective inner faces of these upper mold DU, lower mold DL and side molds DS, an oil jacket core CO, a water jacket core CW and a port core CP are placed in this order from above. This cavity Mc is allowed to communicate with the inside of the distributor 9 through the gates Di formed in the lower mold DL.

An air-supplying path 81 for supplying pressurized air to the pressure room Rp is formed in the holding furnace FH, and the pressure of the pressurized air supplied through the air-supplying path 81 is exerted on the face of the molten metal inside the crucible FH so that the molten metal inside the stoke 6 is raised. Then, the molten metal, thus raised, is supplied and injected into the casting mold cavity Mc of the casting mold D from the stoke 6 through the distributor 9 and the gates Di.

An opening and closing air-supply valve 82, which switches the supply and stop of the pressurized air, is placed in the air-supplying path 81, and a pressure control valve 83 for adjusting the pressure of the pressurized air is placed in the air-supplying path 81 on the upstream side of this opening and closing air-supply valve 82. Moreover, a servo mechanism 84 for controlling the degree of the opening angle of the pressure control valve 83 is attached to the pressure control valve 83. Thus, these pressure control valve 83 and the servo mechanism 84 constitute a variable pressure control means 85 for changing the pressurizing pattern of the pressure applied onto the face of the molten metal inside the crucible FH.

A ring-shaped insulator 86 is inserted and attached to the upper mold DU of the casting mold D, and two wires 87, which conduct when the molten metal is injected into and fills the casting mold cavity Mc, are connected to the respective upper portions of the upper mold DU on both sides of the insulator 86. Moreover, the two wires 87 are electrically connected to a molten metal filling detection circuit 88 which transmits a filling signal when the two wires 87 conduct to each other. The above-mentioned insulator 86, the wires 87 and the molten metal filling detection circuit 88 constitute a filling detection sensor 89 which detects the filling of the molten metal into the cavity Mc.

Furthermore, the molten metal filling detection circuit 88 is electrically connected to a pressure pattern control means 90 which varies the pressure pattern of the variable pressure control means 85, and a timer 94, which transmits an elapsed-time signal when a preliminarily set time has elapsed after the start of the supply of the molten metal into the casting mold cavity Mc, is electrically connected to the pressure pattern control means 90. The pressure pattern control means 90 has a so-called CPU (Central Processing Unit) installed therein so that the pressure pattern of the variable pressure control means 85 is changed based upon the filling signal from the filling detection sensor 89 or the elapsed-time signal from the timer 94.

Figure 4:
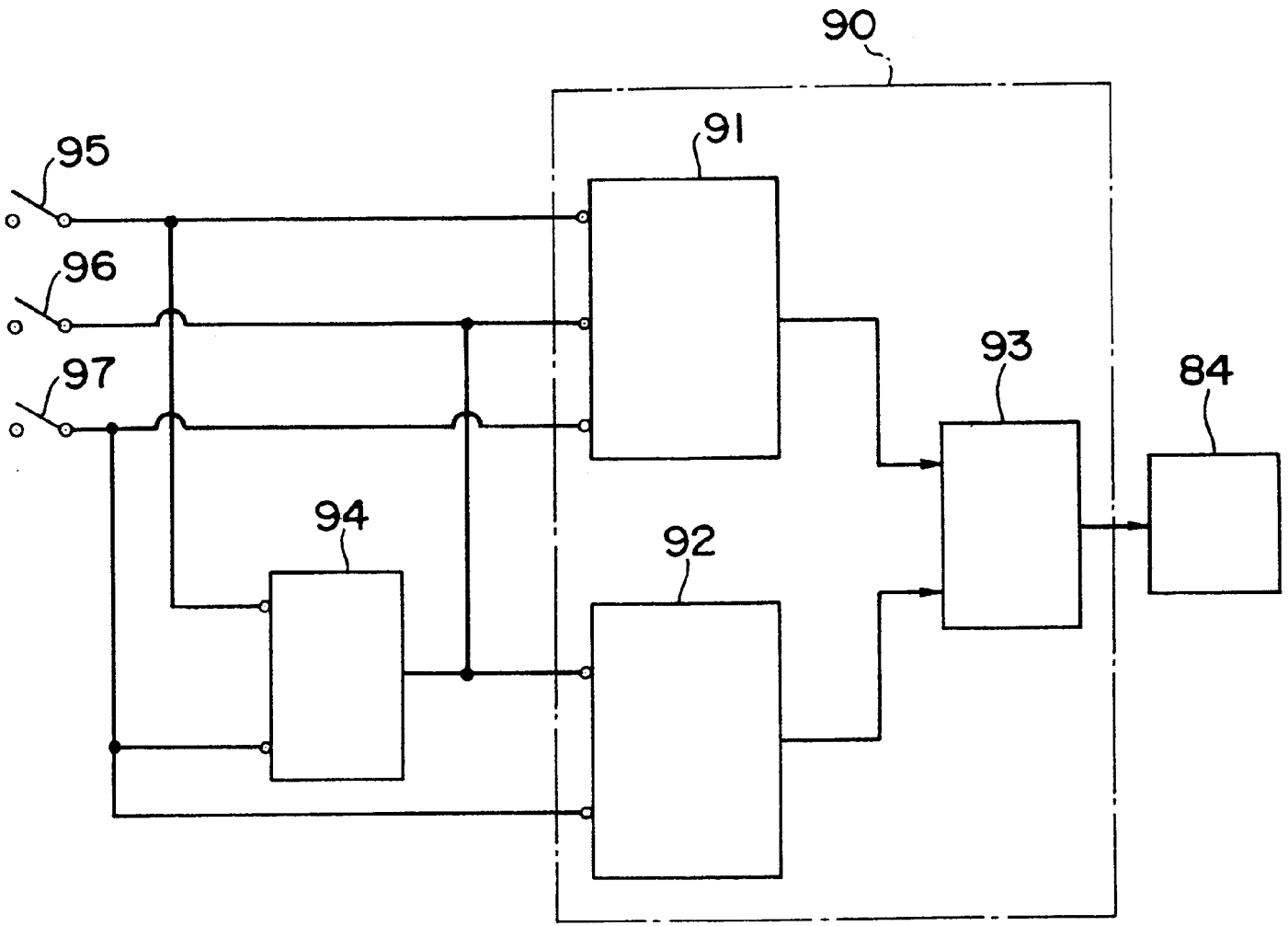
FIG. 4 is a block diagram that schematically shows the pressure control system of the casting mold apparatus.

FIG. 4 is a block diagram that schematically shows the pressure control system of the casting mold apparatus A. As illustrated in this Figure, the pressure control system is provided with a pressure start signal switch 95 which outputs an ON signal when the opening and closing air-supply valve 82 is turned ON so that the supply of the pressurized air to the pressure room Rp is started, a filling signal switch 96 which outputs an ON signal upon receipt of the filling signal that is transmitted from the filling detection sensor 89 when the molten metal is injected into the cavity Mc, and a casting completion switch 97 which outputs an ON signal upon completion of a casting process, and these switches 95, 96 and 97 are electrically connected to the pressure pattern control means 90.

The timer 94 to which the pressure start signal switch 95 and the casting completion switch 97 are connected and installed, is connected to the pressure pattern control means 90, and it is activated upon receipt of the ON signal from the pressure start signal switch 95, and when a predetermined time t2 has elapsed after the activation, it outputs an ON signal, and is reset upon receipt of the ON signal from the casting completion switch 97.

The pressure pattern control means 90 is more preferably provided with two CPUs, that is, the first and second CPUs 91 and 92.

The first CPU 91 is arranged so as to control the variable pressure control means 85 in the following manner: Upon receipt of the ON signal from the pressure start signal switch 95, the variable pressure control means 85 raises the pressure inside the pressure room Rp abruptly, while after the lapse of a predetermined time t1 after the start of the pressure application, it delays the pressure increasing rate, and upon receipt of the ON signal from either the filling signal switch 96 or the timer 94, it maintains the pressure at this time, while upon receipt of the ON signal from the casting completion switch 97, it outputs a first pressure signal for a pressure pattern so as to return the pressure inside the pressure room Rp to normal pressure.

Moreover, the second CPU 92 is arranged so as to control the variable pressure control means 85 in the following manner: Upon receipt of the ON signal from either the filling signal switch 96 or the timer 94, it raises the pressure inside the pressure room Rp, and when the pressure has reached a predetermined value, it maintains the pressure at this time, and upon receipt of the ON signal from the casting completion switch 97, it outputs a second pressure signal for a pressure pattern so as to return the pressure inside the pressure room Rp to normal pressure.

In this manner, the pressure pattern control means 90 is constituted by the first and second CPUs 91 and 92 for respectively outputting the first and second pressure signals whose pressure patterns are different from each other, and an addition circuit 93. This addition circuit 93 adds the first pressure signal from the first CPU 91 and the second pressure signal from the second CPU 92, and the resulting addition signal is outputted to the above-mentioned servo mechanism 84.

Next, an explanation will be given of the casting mold D that is used in the low-pressure casting apparatus A.

Figure 5:
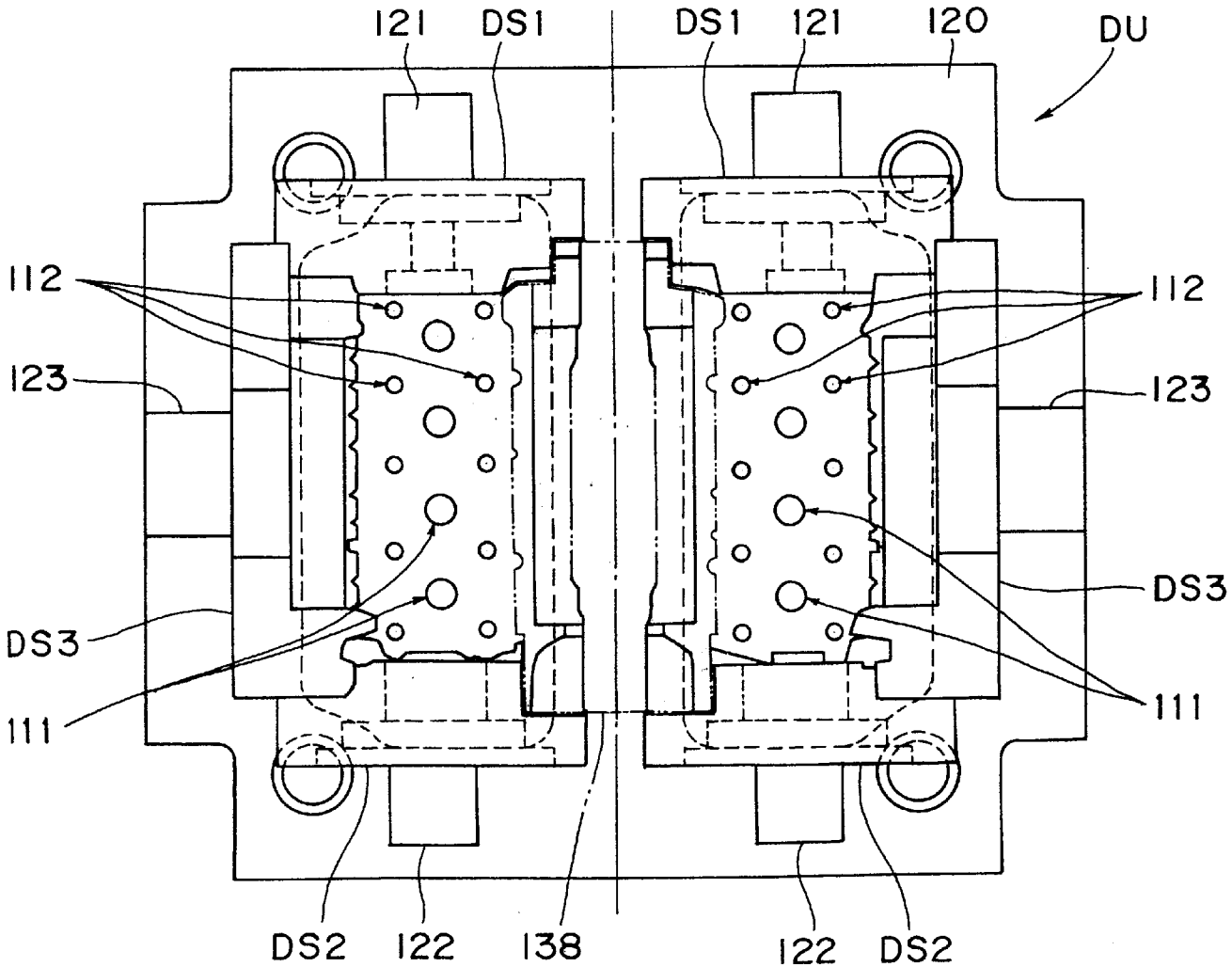
FIG. 5 is an explanatory bottom view of a upper mold of the casting apparatus.

FIG. 5 is an explanatory bottom view that schematically shows the structure thereof when the upper mold DU is viewed from its mold-fitting face (that is from below). As described above, the upper mold DU is separably attached to the lower mold DL in the vertical direction, and a plurality of side molds DSs (DS1, DS2 and DS3), which are allowed to slide and form the side wall portions of the casting mold cavity, are attached to the upper mold DU. Moreover, in the present embodiment, the casting mold D is designed to provide two cast products in a casting process at one time, that is, designed as twin-product casting mold; and as illustrated in FIG. 5, two molding sections are symmetrically formed in one die plate 110 also in the upper mold DU.

In these lateral molding sections, a plurality of plug-hole core protrusions 111 (four, in the present embodiment) are formed in its center portion, and a plurality of bolt-hole core protrusions 112 (five, on each side in the present embodiment) are formed on each side thereof. It is to be noted that the "plug-hole core protrusion" means a core protrusion corresponding to a plug-hole in a cylinder head, and the "bolt-hole core protrusion" means a core protrusion corresponding to a bolt hole in a cylinder head. In other words, each of the plughole core protrusions 111 is used to form a hole through which an ignition plug is inserted in a cylinder head, and each of the bolt-hole core protrusions 112 is used to form a bolt hole in the cylinder head.

Here, all the respective casting molds (the upper mold DU, lower mold DL and side molds) are made of, for example, steel.

A plurality of side molds DS (two pairs of DS1, DS2 and DS3: total six, in the present embodiment) are attached to the upper mold DU, and cylinder devices 121, 122 and 123 (side-mold driving cylinders) are respectively placed on the side molds DS1, DS2 and DS3.

Here, the side molds DS1, DS2 and DS3 are allowed to respectively slide along the die plate 110 of the upper mold DU (that is, in a direction virtually orthogonal to the mold closing direction of the upper mold DU and the lower mold DL) by driving these cylinder devices 121, 122 and 123.

As will be described later, at the time of casting and at the time of applying a mold wash thereto, that is, at the time of forming the casting mold cavity by closing the casting molds D, the side molds DS1, DS2 and DS3 are respectively driven inward into a closed state, as illustrated in FIG. 5. In contrast, in the case when the cast product is taken out of the casting molds D after completion of the casting process, the upper mold DU is raised so that the upper and lower casting molds DU and DL are opened, and the side molds DS1, DS2 and DS3 are then driven to slide outward and opened.

As will be described later, also in the lower mold DL, two mold sections are symmetrically formed in one die plate 130 in a manner so as to correspond to the upper mold DU, and a sand wall 138 is placed in the center of the right and left mold sections, in a manner so as to separate the two sections. This sand wall 138 is more preferably assembled into the lower mold DL in the same assembling process at the time of arranging cores CO, CW and CP inside the lower mold DL.

In this manner, in a state where the cores CO, CW and CP and the sand wall 138 are arranged in the lower mold DL, when the upper mold DU is lowered so as to close the casting molds DU and DL, the sand wall 138, assembled in the lower mold DL, is positioned in the center of the right and left sections of the upper mold DU; thus, one of side walls of the casting mold cavity of the respective right and left cylinder heads is formed. In other words, with respect to the casting mold cavity of each cylinder head, the three movable side molds DS1, DS2 and DS3 attached to the upper mold DU and the fixed sand wall 130 set in the lower mold DL constitute a casting mold face (side wall face) corresponding its side face.

Figure 6:
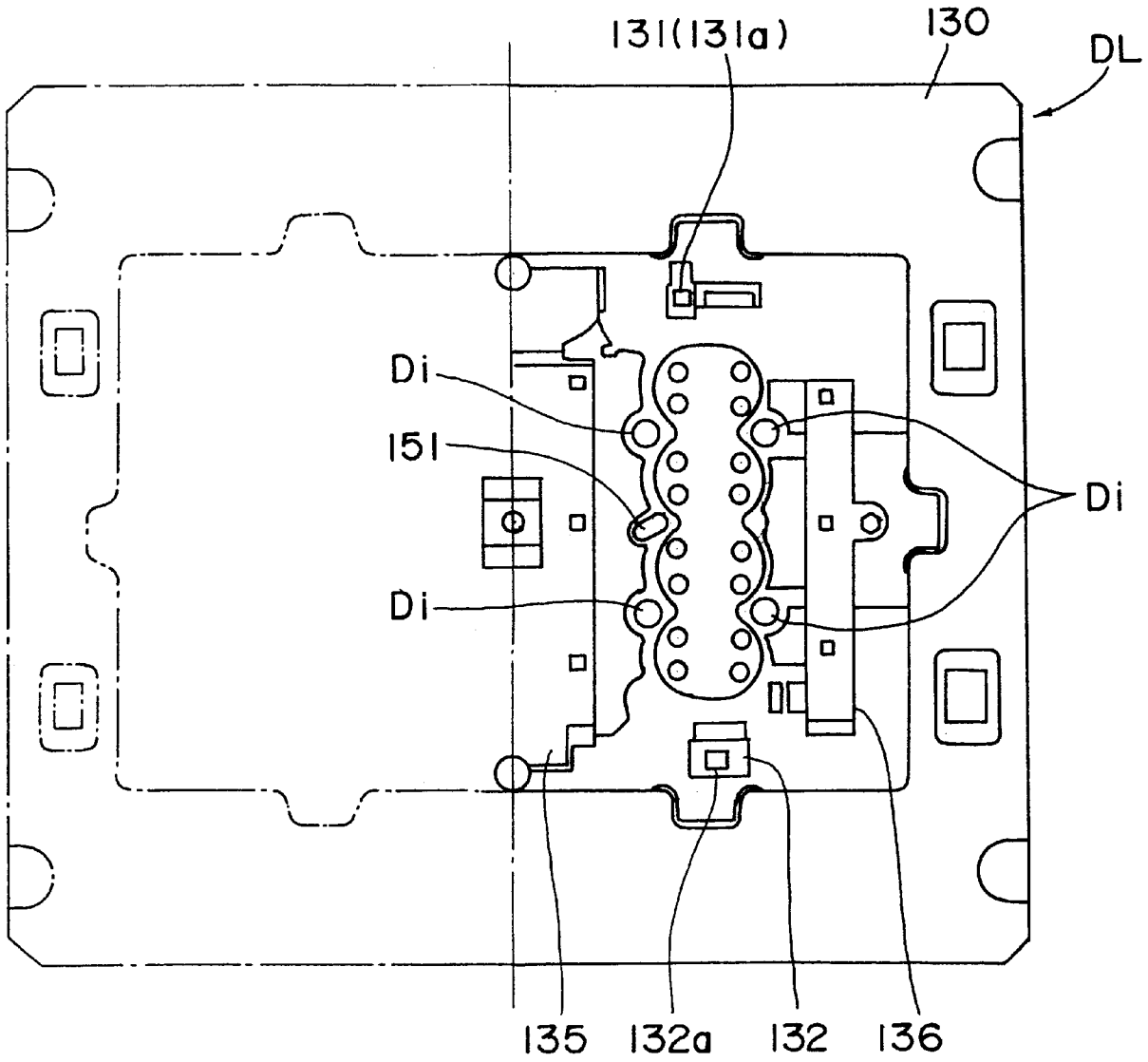
FIG. 6 is an explanatory plane view of a lower mold of the casting apparatus.

FIG. 6 is an explanatory plan view of the lower mold DL. In this lower mold DL also, two mold sections are symmetrically formed in one die plate, and in FIG. 6, only one side (right side) of the mold section is shown, and with respect to the other side (left side) that has the same shape as this except that it is formed on the left side, the detailed figure thereof is omitted.

Figure 7:
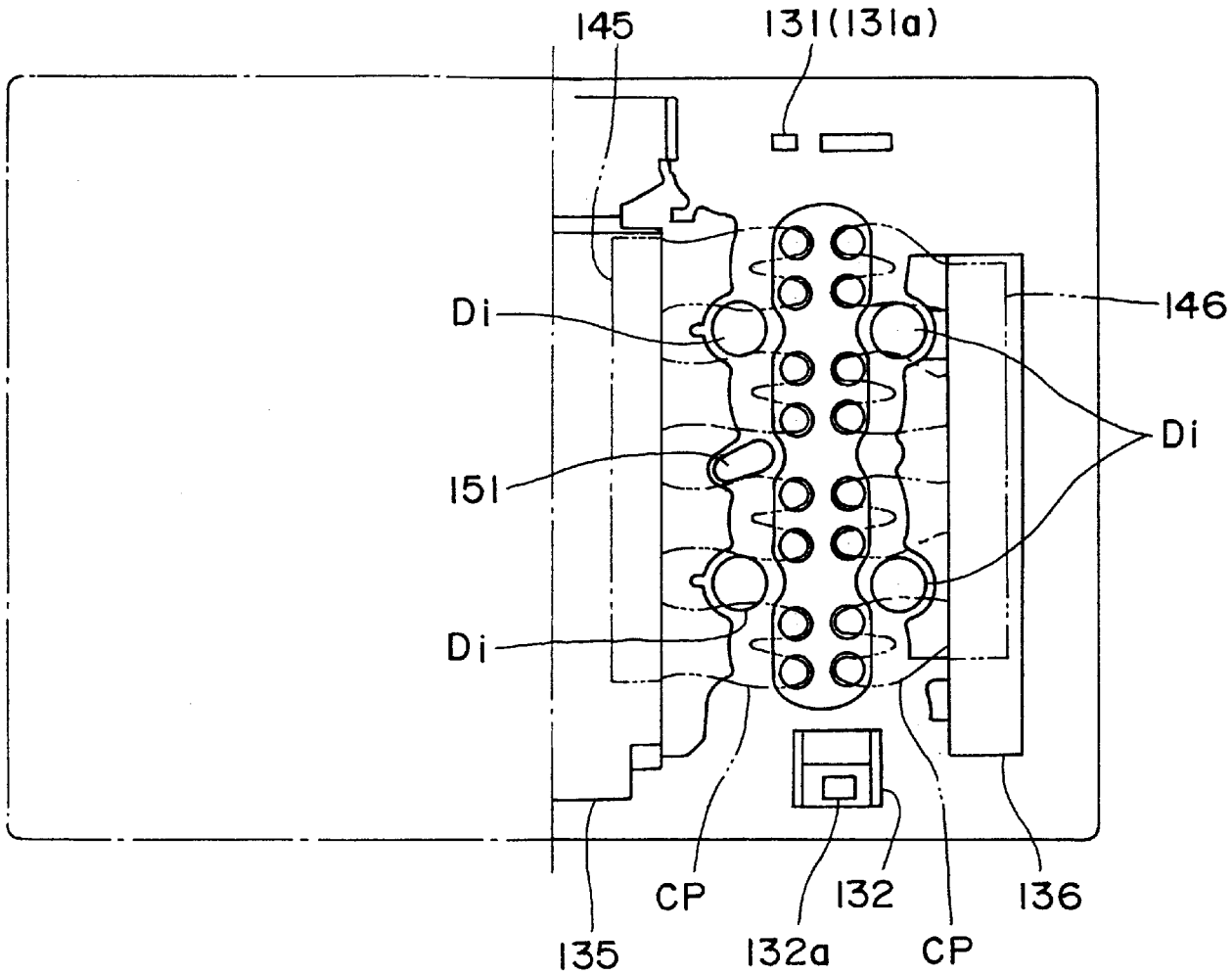
FIG. 7 is an explanatory plane view that shows the lower mold in state of setting a port core thereon.

As also illustrated in FIG. 7, core print receiving sections on which cores CO, CW and CP are assembled are placed in the respective right and left mold sections, as will be described later. More specifically, first and second core print receiving sections 131 and 132, spaced with a predetermined gap in the length direction of the respective mold sections, and third and fourth core print receiving sections 133 and 134, spaced with a predetermined gap in a manner so as to extend in the length direction of the respective mold sections, are placed therein.

The first and second core print receiving sections 131 and 132 are core print receiving sections on which the aforementioned water jacket core CW is assembled, and are allowed to receive the core prints of the water jacket core CW. Moreover, the third and fourth core print receiving sections 133 and 134 are core print receiving sections on which the aforementioned port core CP is assembled, and are allowed to receive the core prints of the port core CP.

Figure 8:
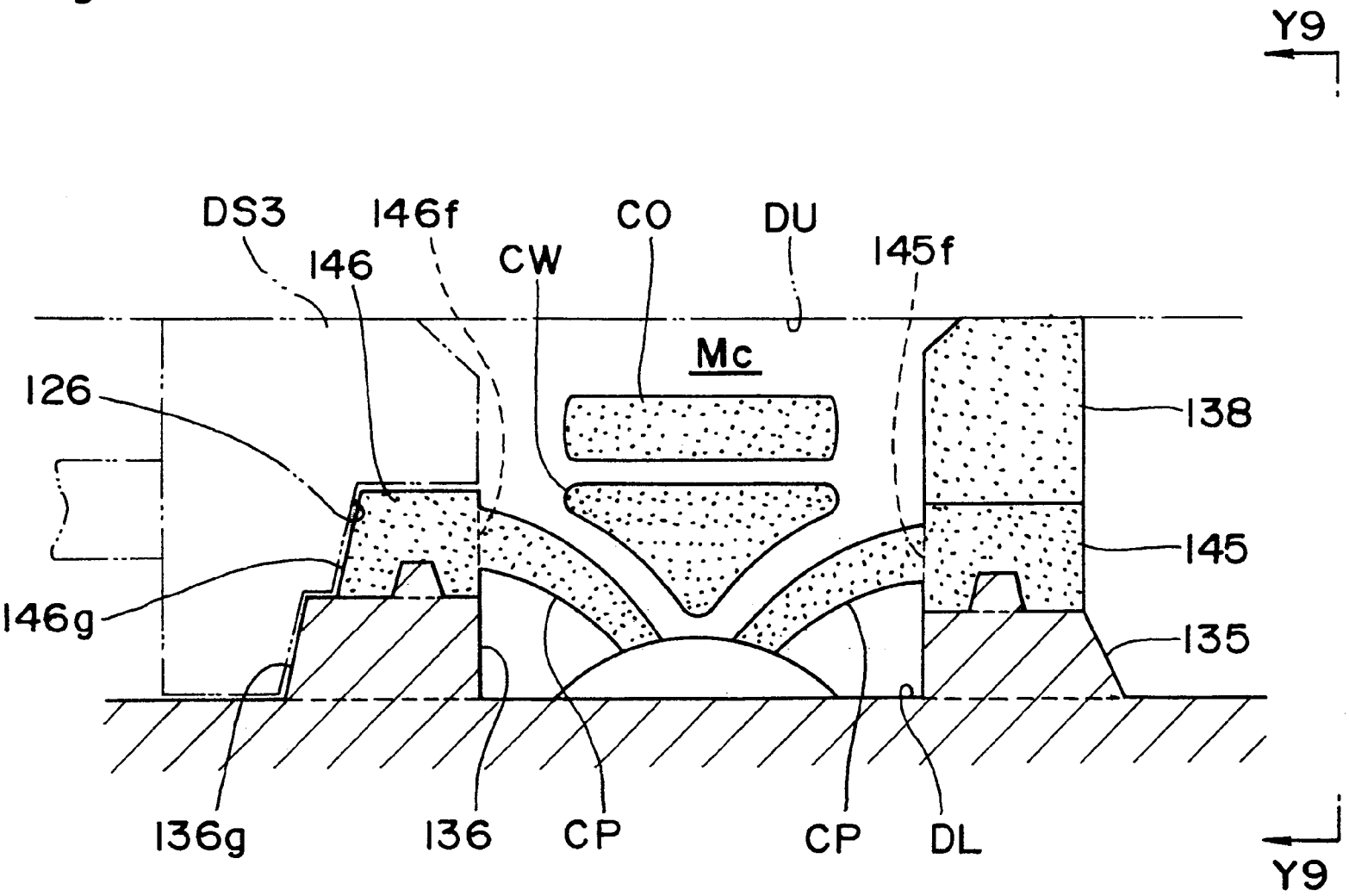
FIG. 8 is an explanatory vertical cross-sectional view shows the lower mold in state of setting cores thereon.

As described in FIG. 8 in detail, the oil jacket core CO, the water jacket core CW and the port core CP are assembled onto the lower mold DL in this order from above, by using the core print receiving sections 131 and 134.

The following description will discuss an assembling method of these cores CO, CW and CP onto the lower mold DL.

In the present embodiment, with respect to the oil jacket core CO and the water jacket core CW placed upper and lower positions, in a manner so as to extend in the length direction of the cylinder head, the water jacket core CW that is placed lower side is assembled onto the lower mold DL through the first and second core print sections 141 and 142 attached to both ends thereof, and the oil jacket core CO is assembled onto the lower mold DL with the core prints 143 and 144 attached to both ends thereof being supported by the water jacket core CW.

Here, in the present specification, "core prints" include both of the plate assembled integrally with the core main section and the plate used in combination with the core main body as a separated part.

Figure 11:
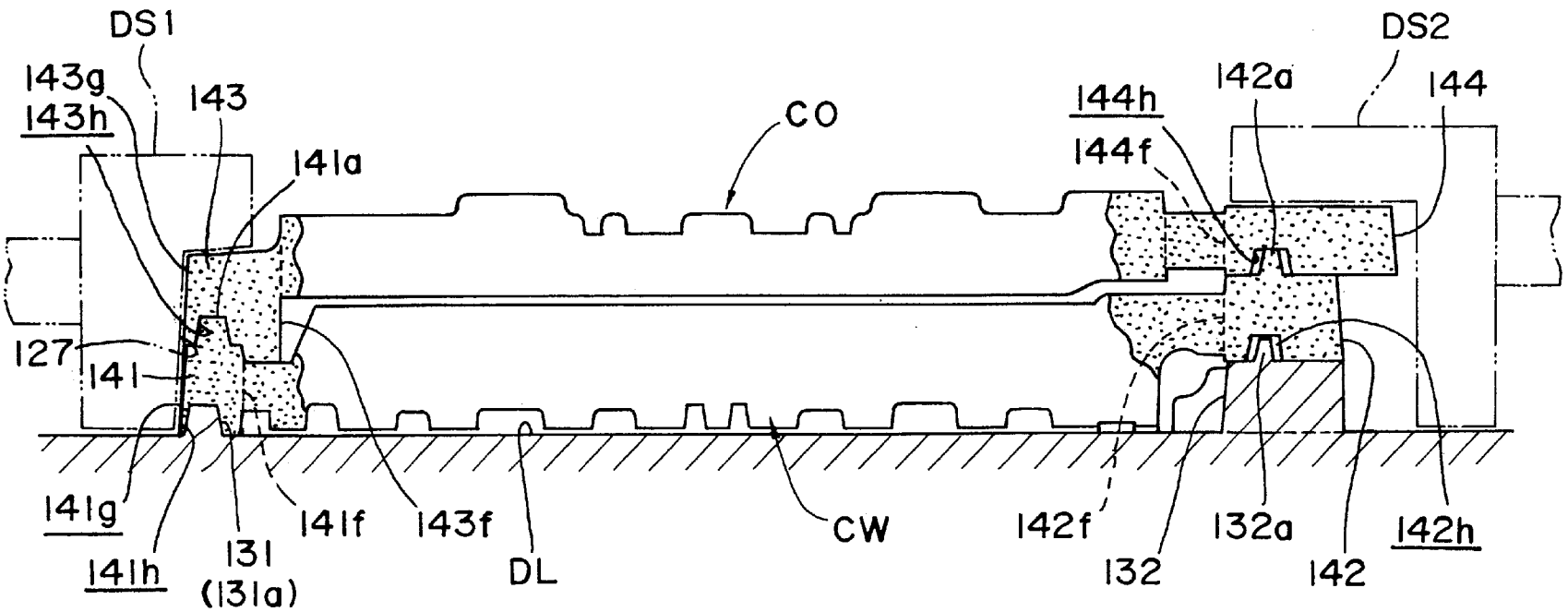
FIG. 11 is a partial explanatory vertical cross-sectional view that shows a state of setting a water jacket core and a oil jacket core onto the lower mold.

In other words, as illustrated in FIG. 11, the water jacket core CW, set on the lower side, is provided with the first and second core print sections 141 and 142 on its respective ends, and first and second engaging sections 141*h* and 142*h*, each having a concave shape with a lower opening, are formed in the respective core print sections 141 and 142. On the other hand, first and second core print stopping portions 131*a* and 132*a*, each having a convex shape protruding upward, are formed in the first and second core print receiving sections 131 and 132*a* of the lower mold DL. Then, the respective engaging sections (the first and second engaging sections 141*h* and 142*h* ) of the first and second core print sections 141 and 142 are fitted to the core print stopping portions (the first and second core print stopping portions 131*a* and 132*a* ) of the first and second core print receiving sections 131 and 132*a* from above so as to be engaged therewith; thus, the water jacket core CW is assembled onto the lower mold DL.

Moreover, with respect to the oil jacket core CO to be set on the upper side, core print sections 143 and 144 (third and fourth core print sections) are attached to both end portions thereof, and third and fourth engaging sections 143*h* and 144*h*, each having a concave shape with a downward opening, are formed in the respective core print sections 143 and 144 in the same manner as the water jacket core CW. On the other hand, third and fourth core print stopping portions 141*a* and 142*a*, each having a convex shape protruding upward, are formed on the upper faces of the first and second core print sections 141 and 142 of the water jacket core CW.

Then, the respective engaging sections (the third and fourth engaging sections 143*h* and 144*h*) of the third and fourth core print sections 143 and 144 are fitted to the core print stopping portions (the third and fourth core print stopping portions 141*a* and 142*a*) formed on the upper faces of the first and second core print sections 141 and 142 from above so as to be engaged therewith; thus, the oil jacket core CO is assembled onto the lower mold DL through the core print sections 141 and 142 of the water jacket core CW.

Here, in the case when the upper mold DU is lowered so that the upper and lower casting molds DU and DL are closed, the upper inner faces of the side molds DS1 and DS2, which are lowered together with the upper mold DU, are allowed to contact the upper faces of the core print sections 143 and 144 of the oil jacket core CO.

As described above, of the two cores CW and CO having an elongated shape, the oil jacket core CO, placed on the upper side, is assembled onto the lower mold DL with its core prints 143 and 144 being supported by the core prints 141 and 142; therefore, the two cores CW and CO are integrally assembled in the casting mold (lower mold DL) through the respective core prints so that the distance between the center axes of the two cores CW and CO is maintained at a constant value in a very stable manner, as compared with the case in which the two cores CW and CO are separately assembled into the casting molds respectively. Consequently, it is possible to positively carry out the thickness adjustment between the passages (water jacket and oil jacket) corresponding to the respective cores CW and CO.

Moreover, the application of the above-mentioned arrangement enables the following processes: The two cores CW and CO are preliminarily assembled integrally, and these assembled cores (CW+CO) can be further assembled into the lower mold DL; thus, it is possible to reduce the number of assembling processes for cores, and in the case of an automatic assembling process, it is possible to reduce the number of actuators, and consequently to simplify the structure of a core assembling device.

Figure 12:
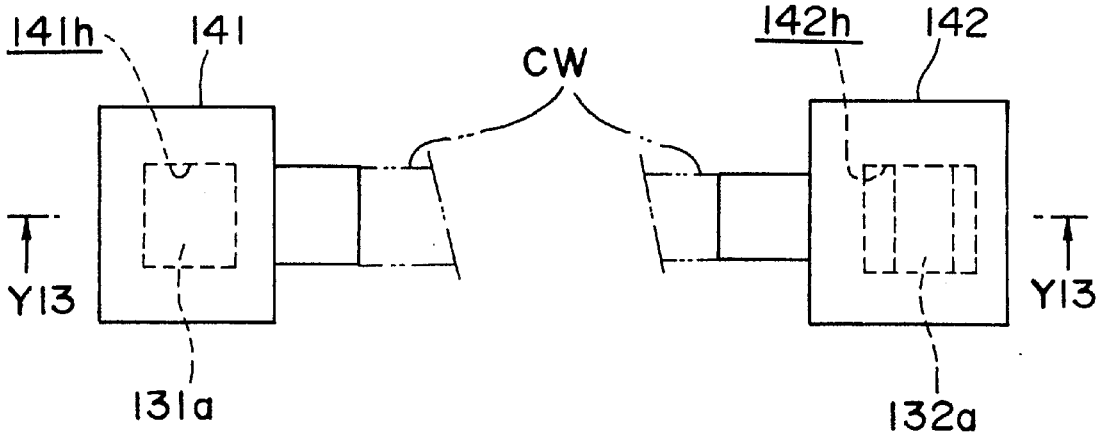
FIG. 12 is an enlarged explanatory plane view that shows an engaged portion between the lower mold and a core print of the water jacket core.
Figure 13:
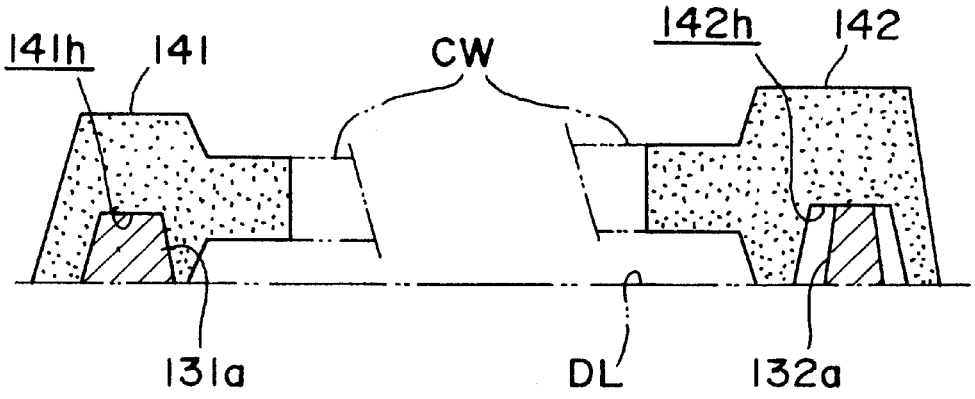
FIG. 13 is an explanatory vertical cross-sectional view taken along Y13—Y13 line of FIG. 12.

Moreover, as illustrated in FIGS. 12 and 13 in detail, in the present embodiment, the inner face of the first engaging section 141*h* and the outer face of the first core print stopping portion 131*a* are designed so as to have virtually the same shape and dimensions, with the result that the first engaging section 141*h* is engaged with the first core print stopping portion 131*a* without any gap over the entire face (four faces including a tapered face); therefore, the engagement is made is such a manner that no shift is allowed over the entire face.

Moreover, the second core print stopping portion 132*a* is designed so that the thickness dimension of its convex portion is smaller than the width of the concave portion of the second engaging section 142*h* by a predetermined amount only in the length direction of the core CW, and at the time when the core CW is assembled into the lower mold DL, a gap having not less than a predetermined amount is provided in each of the two sides of the second core print stopping portion 132*a* in the length direction. In this manner, the positional relationship between the two members is set.

As clearly shown by FIG. 12, with respect to the lateral direction of the core CW, the dimension of the inner face of the second engaging section 142*h* and the dimension of the outer face of the second core print stopping portion 132*a* are set to be virtually the same; therefore, the second engaging section 142*h* is engaged with the second core print stopping portion 132*a* in a manner so as to have no gap in the lateral direction, that is, in a manner so as not to move in this direction.

In other words, the second engaging section 142*h* is allowed to move only in the length direction of the core CW, with respect to the second core print stopping portion 132*a*, and not allowed to move in any other directions.

In this manner, the first engaging section 141*h*, placed on one end side of the water jacket core CW directly assembled onto the lower mold DL, is engaged by the first core print stopping portion 131*a* of the casting mold (lower mold DL) in a manner so as not to move therefrom, while the second engaging section 142*h*, placed on the other end side of the water jacket core CW, is engaged by the second core print stopping portion 132*a* of the lower mold DL in a manner so as to move only in the length direction of the core CW and so as not to move in any other directions; thus, after an accurate positioning has been made without causing any positional offset in the core CW, the difference between the amounts of thermal expansions of the core CW and the lower mold DL is effectively absorbed in the length direction of the core CW so that it becomes possible to prevent the core CW from damages such as cracks and chipping caused by the difference in the amounts of thermal expansions.

Moreover, also in the case of the third and fourth core print stopping portions 141*a* and 142*a* placed on the core prints 141 and 142 on both end sides of the water jacket core CW as well as the third and fourth engaging sections 143*h* and 144*h* formed in the core prints 143 and 144 on both end sides of the oil jacket core CO which is to be placed above the water jacket core CW, the third engaging section 143h is engaged by the third core print stopping portion 141*a* in a manner so as not to move therefrom, while the fourth engaging section 144*h* is engaged by the fourth core print stopping portion 142*a* in a manner so as to move only in the length direction of the core and so as not to move in any other directions, in the same manner as in the case of the combinations of the first and second core print stopping portions 131*a* and 132*a* formed on the lower mold DL and the first and second engaging sections 141*h* and 142*h* formed in the water jacket core CW.

With this arrangement, after an accurate positioning has been made without causing any positional offset in the oil jacket core CO with respect to the water jacket core CW, the difference between the amounts of thermal expansions of the two cores CO and CW is effectively absorbed. As a result, at the time of preliminarily setting the cores CO and CW or at the time of casting, it is possible to prevent the core CO and/or core CW from damages such as cracks and chipping caused by the difference in the amounts of thermal expansions of the cores CO and CW.

Moreover, in the present embodiment, at the time of casting, gases generated in the two elongated cores (oil jacket core CO and water jacket core CW) are sucked and externally released through the core print sections of the cores CO and CW.

Figure 14:
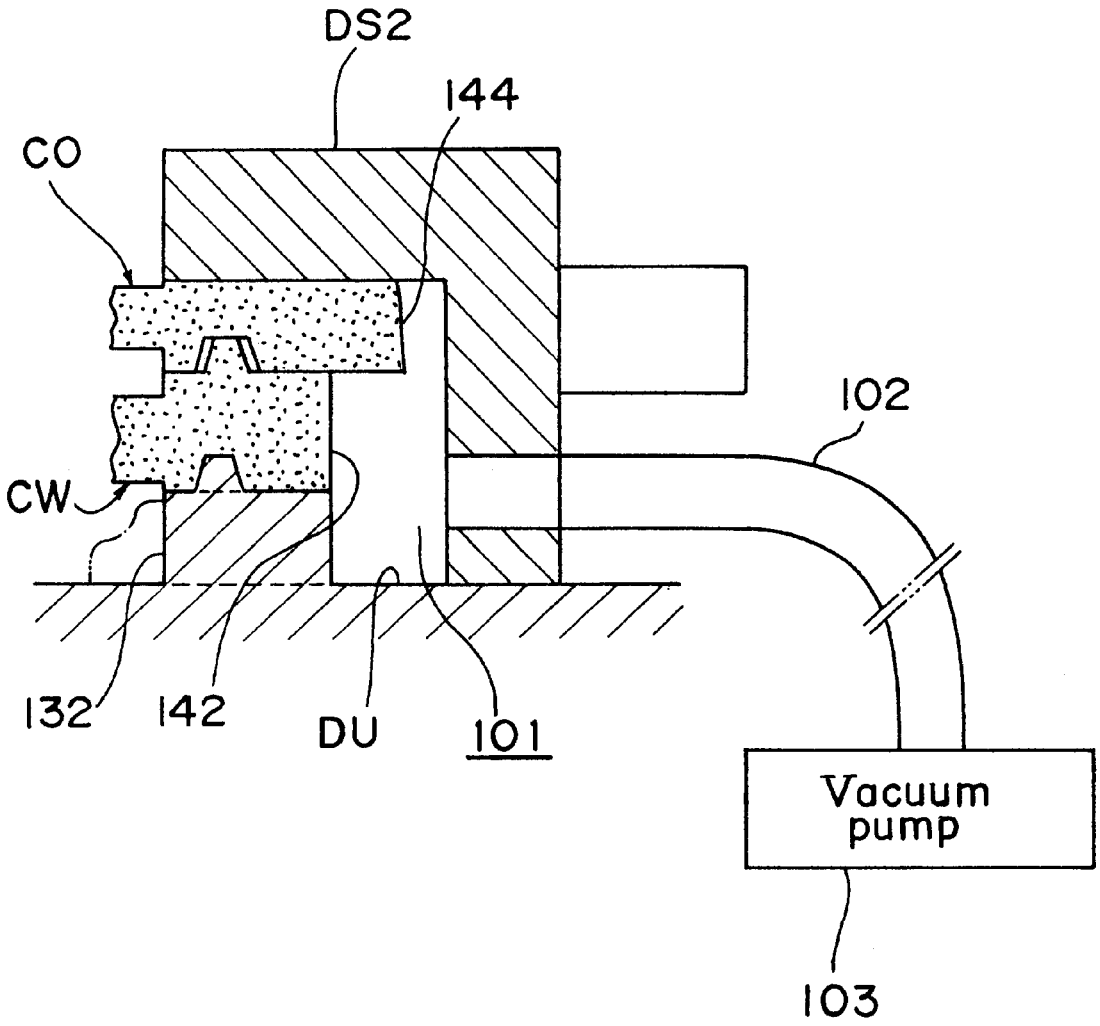
FIG. 14 is an enlarged explanatory vertical cross-sectional view of a core supporting section that shows a gas releasing mechanism of the casting mold.

That is, as illustrated in FIG. 14 in detail, for example, on the side of the fourth core print section 144 of the oil jacket core CO and the second core print section 142 of the water jacket core CW, when the upper mold DU is lowered so that the upper and lower casting molds DU and DL are closed, the outer faces of the core print sections 144 and 142, the surface of the lower mold DL including the outer face of the second core print receiving section 132*a* and the inner face of the side mold DS1 contacting the upper face of the core print section 144 of the oil jacket core CO constitute a sealed space 101.

One end of, for example, a flexible hose 102 that communicates with this sealed space 101 is connected to the side face of the side mold DS2 with the other end of the hose 102 being connected to a vacuum pump 103 serving as a gas suction means.

Here, the vacuum pump 103 is driven so as to vacuum the sealed space 101 so that gases, derived from binders of the oil jacket core CO and the water jacket core CW gasified at the time of casting, are sucked and released outside the casting mold cavity.

In this manner, since the suction means 103 (vacuum pump), which sucks gases generated from the two cores CO and CW at the time of casting through the core print sections 144 and 142 of the two cores CO and CW, is installed, it is possible to forcefully suck gases generated inside the cores CO and CW through the core print sections 144 and 142 and readily release them outside the casting mold cavity. even though the cores have an elongated shape. Thus, it becomes possible to effectively prevent the resulting cast product from gas defects.

In this case, the two cores CO and CW are integrally assembled inside the casting mold (lower mold DL) through the core print portions 144 and 142; therefore, even if one of the cores does not face the sealed space 101 and it is virtually cut off from the vacuum pump 103, the gas suction process is carried out through the core prints of the other core, it is possible to effectively discharge even gases generated in said one of the cores outside the casting mold.

Moreover, in the present embodiment, the water jacket core CW and the oil jacket core CO are assembled in the lower mold DL in such a manner as described above, so that at least one portion of the casting mold face corresponding to the side face of the cylinder head is formed by the inside face of the core prints of the cores CW and CO.

In other words, the respective inside faces 141*f* and 142f (see FIG. 11) of the core print portions 141 and 142 of the water jacket core CW and the respective inside faces 143*f* and 144*f* of the core print sections 143 and 144 of the oil jacket core CO constitute at least a part of the casting mold face corresponding to the side face of the cylinder head.

In this manner, since the inner faces 141*f* to 144*f* of the core prints 141 to 144 of the respective cores CW and CO are allowed to constitute at least a part of the casting mold face corresponding to the side face of the cylinder head, the core prints 141 to 144 of the cores CW and CO are utilized to form one portion of the casting mold face.

In this case, the heat transmission to the casting mold portion in which one portion of the casting mold face is formed by the side faces of the cores whose main material is casting sand is reduced to a great degree as compared with the other casting mold portions; thus, it becomes possible to provide a directivity to the cooling process of the molten metal after the casting process.

With this arrangement, the heat transmission to the casting mold (upper mold DU) on the side farther from the gates Di formed in the casting mold (lower mold DL) on the side bearing the water jacket core CW is reduced so that the cooling process of the molten metal after the pouring process has a proper directivity so as to allow the molten metal to solidify starting from the farthest portion from the gates Di.

In other words, the molten metal after the pouring process is allowed to cool off and solidify under such a directivity, with the result that gases existing inside the casting mold cavity is gradually driven toward the gates Di side and finally allowed to remain at gate portions at the time of completion of the solidification. Since these gate portions are cut off and removed as unnecessary portions after completion of the casting process, the possibility of remaining gases in the cast product itself is reduced correspondingly, thereby making it possible to effectively reduce defects occurring at the time of casting.

Figure 9:
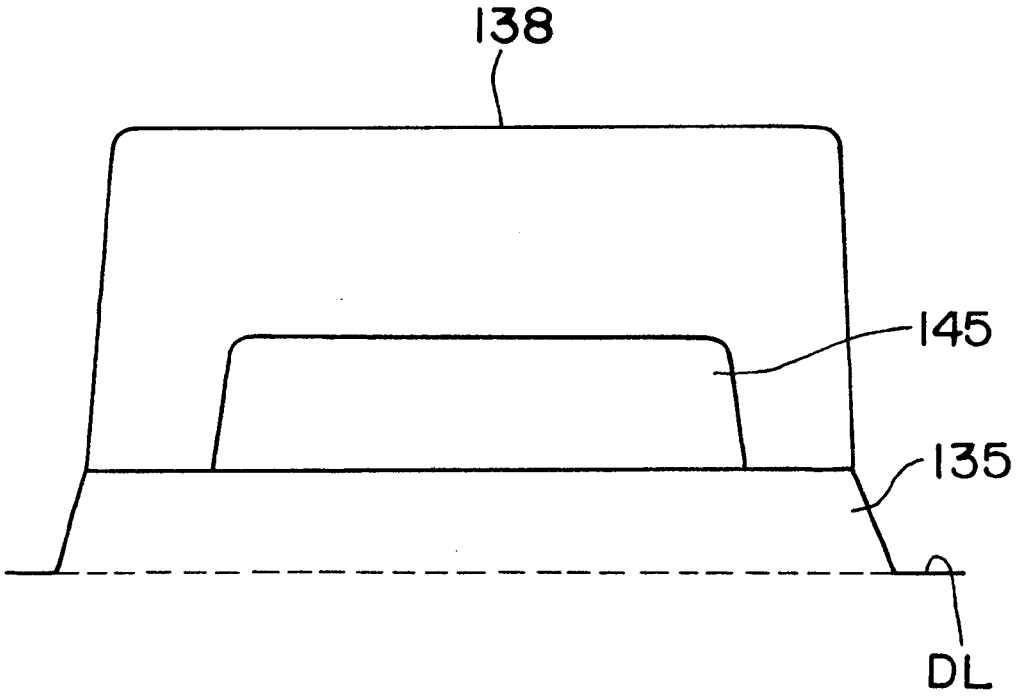
FIG. 9 is an explanatory drawing shown in a direction of arrows Y9—Y9 of FIG. 8.

Moreover, as clearly shown by FIGS. 7 to 9, a port core CP, corresponding to supply and exhaust ports of the cylinder head, is assembled in the lower mold DL as a third core extending in a direction virtually orthogonal to the water jacket core CW and the oil jacket core CO, with its core prints 145 and 146 being supported by casting mold side walls including core print receiving sections 135 and 136; thus, the inside faces 145*f* and 146*f* of these core prints 145 and 146 of the port core CP are allowed to form at least a part of the casting mold face corresponding to the other side face of the cylinder head.

Here, in particular, with respect to the port core CP on the left side in FIG. 7 (that is, on the center side of the lower mold DL corresponding to the right side in FIG. 8), at least one portion of the casting mold side wall supporting the core print 145 is formed as a sand wall 138.

Therefore, with respect to the casting mold portion including the casting mold face corresponding to the other side faces of the cylinder head as well, the heat transmission to said portion is reduced to a great degree as compared with the other casting mold portions, for the same reasons as described above, with the result that the cooling process of the molten metal after the pouring process has a proper directivity so as to allow the molten metal to solidify starting from the farthest portion from. the gates Di. Consequently, it becomes possible to contribute to a reduction in the occurrence of defects during casting.

As clearly shown by FIG. 11, in the present embodiment, guiding tapered portions 141*g* and 143*g*, which are used for smoothly guiding the tapered inner face 127 of the side mold DS1 at the time of closing the upper mold DU toward the lower mold DL, are formed on the outer face of the core print 141 of the water jacket core CW and the outer face of the core print 143 of the oil jacket core CO.

With such guiding tapered portions 141*g* and 143*g* formed on the outer faces of the core prints 141 and 143 of the cores CW and CO, when the upper mold DU is closed toward the lower mold DL, it is possible to smoothly carry out the closing process of the two molds, without the need for installing special guiding sections in a separate manner.

Moreover, as clearly shown by FIG. 8, in the present embodiment, on the outer face of the core print 146 of the port core CP, a tapered portion 146*g*, which is used for smoothly guiding the tapered inner face 126 of the side mold DS3 at the time of closing the upper mold DU toward the lower mold DL, is installed. More preferably, the same type of a taper portion 136*g* is also formed on the outer face of the core print receiving section 136.

With the arrangement of such a guiding taper portion 146*g* that is formed on the outer face of the core print 146 of the port core CP and, more preferably, the same type of taper portion 136*g* also formed on the outer face of the core print receiving section 136, when the upper mold DU is closed toward the lower mold DL, it is possible to smoothly carry out the closing process of the two molds, without the need for installing special guiding sections in a separate manner.

Figure 10A:
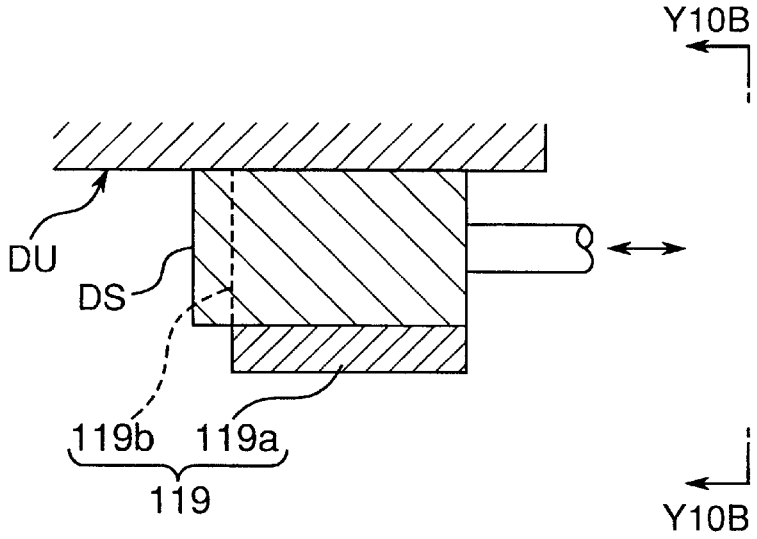
FIG. 10A is an explanatory vertical cross-sectional view of the upper mold and side molds that shows a slide guide mechanism of the side mold.
Figure 10B:
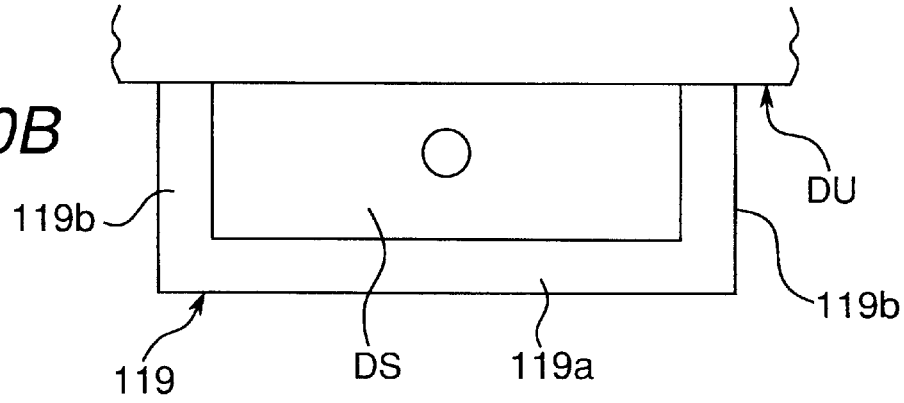
FIG. 10B is an explanatory view in a direction of arrows Y10B—Y10B of FIG. 10A.

Furthermore, in the present embodiment, the side molds DS (DS1 to DS3), which are slidable in a direction virtually orthogonal to the mold closing direction of the upper mold DU and lower mold DL, are attached to the upper mold DU; and as indicated by FIGS. 10A and 10B, a lower guiding portion 119*a*, which is positioned on the lower side of the upper side mold DS and used for guiding the sliding process of the side mold DS, is formed on the upper mold DU.

Both end sides of this lower guiding portion 119*a* are respectively connected to lateral guiding portions 119*b*, and a frame-shaped sliding guide 119 for guiding the sliding operation of the side mold DS is constituted by these paired lateral guiding portions 119*b* and the lower guiding portion 119*a*. With this arrangement, it is possible to smoothly carry out the sliding process of the side mold DS, without the need for installing special guiding sections in a separate manner.

In the present embodiment, the mold temperature of the casting mold D is controlled so as to be cooled in a predetermined range in order to accelerate the solidification of the molten metal after pouring and in order to properly maintain the temperature (mold temperature) of the casting mold D at the time of applying a mold wash to the casting mold D.

Next, an explanation will be given of a controlling operation for cooling the casting mold D in accordance with the present embodiment.

First, an explanation will be given of a controlling operation for cooling the upper mold DU. As described earlier, in each of the right and left mold sections, the plug-hole core protrusions 111 are formed in its center portion, and the bolt-hole core protrusions 112 are formed on each side thereof (see FIG. 5). In the present embodiment, a cooling control mechanism for the upper mold DU is attached to these protrusions 111 and 112.

Figure 15:
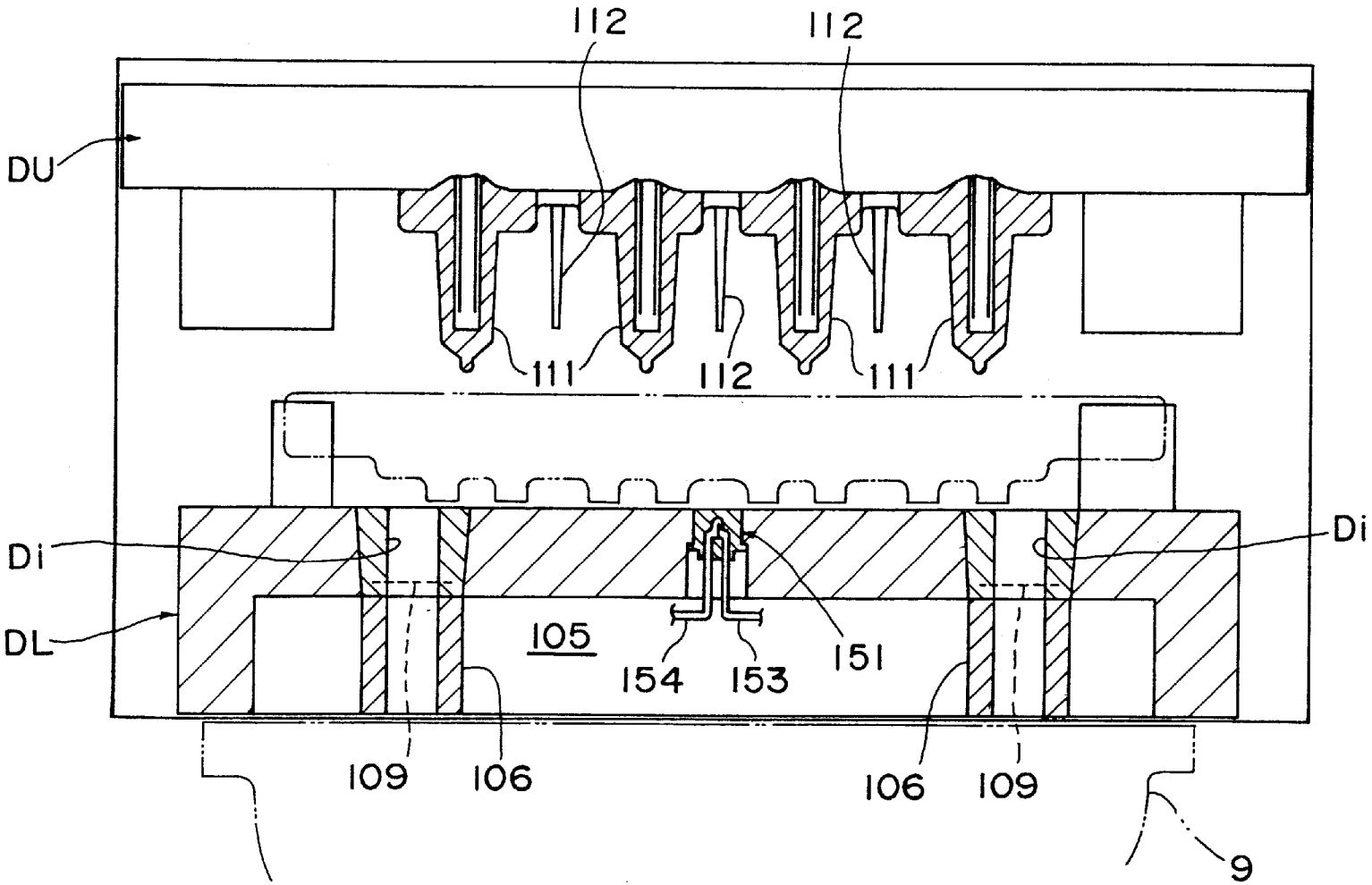
FIG. 15 is an explanatory vertical cross-sectional view of the casting mold that shows a matching state of the upper mold and the lower mold.
Figure 16:
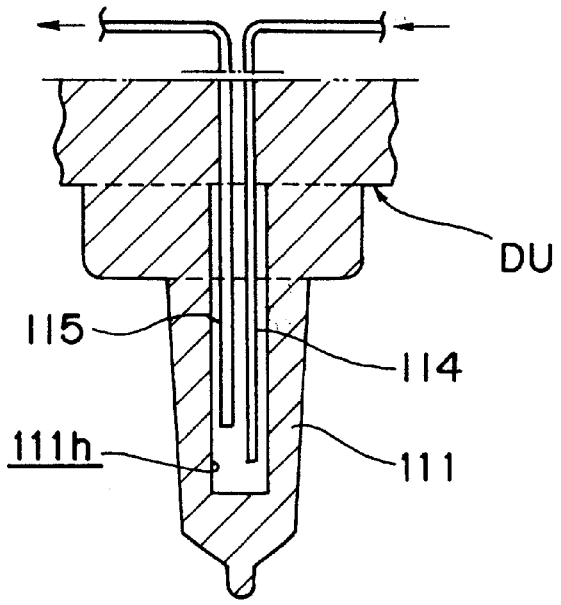
FIG. 16 is an enlarged explanatory vertical cross-sectional view that shows a plug-hole forming portion of the upper mold.

In other words, as illustrated in FIGS. 15 and 16, an empty section lllh is formed inside each plug-hole core protrusion 111 in a manner so as to extend in its axis direction, and as shown in FIG. 16 in detail, a directing pipe 114 for directing a cooling medium into the empty section 111*h* and a discharging pipe 115 for discharging the cooling medium outside the empty section 111*h* are inserted into the empty section 111*h*. The directing pipe 114 is connected to a supply source (not shown) of the cooling medium, and the discharging pipe 115 is connected to a collecting device (not shown) of the cooling medium. A cooling medium circulating system including the directing pipe 114 and the supply source (not shown) as well as the discharging pipe 115 and the collecting device (not shown) of the cooling medium constitutes a cooling means in the plug-hole core protrusion 111.

Figure 17:
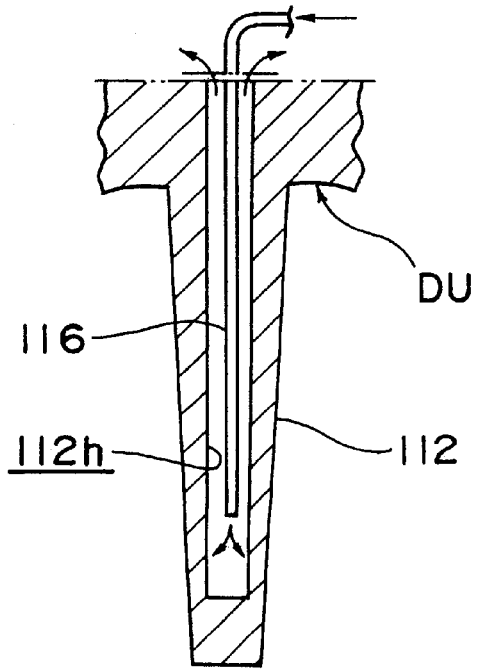
FIG. 17 is an enlarged explanatory vertical cross-sectional view that shows a bolt-hole forming portion of the upper mold.
Figure 18:
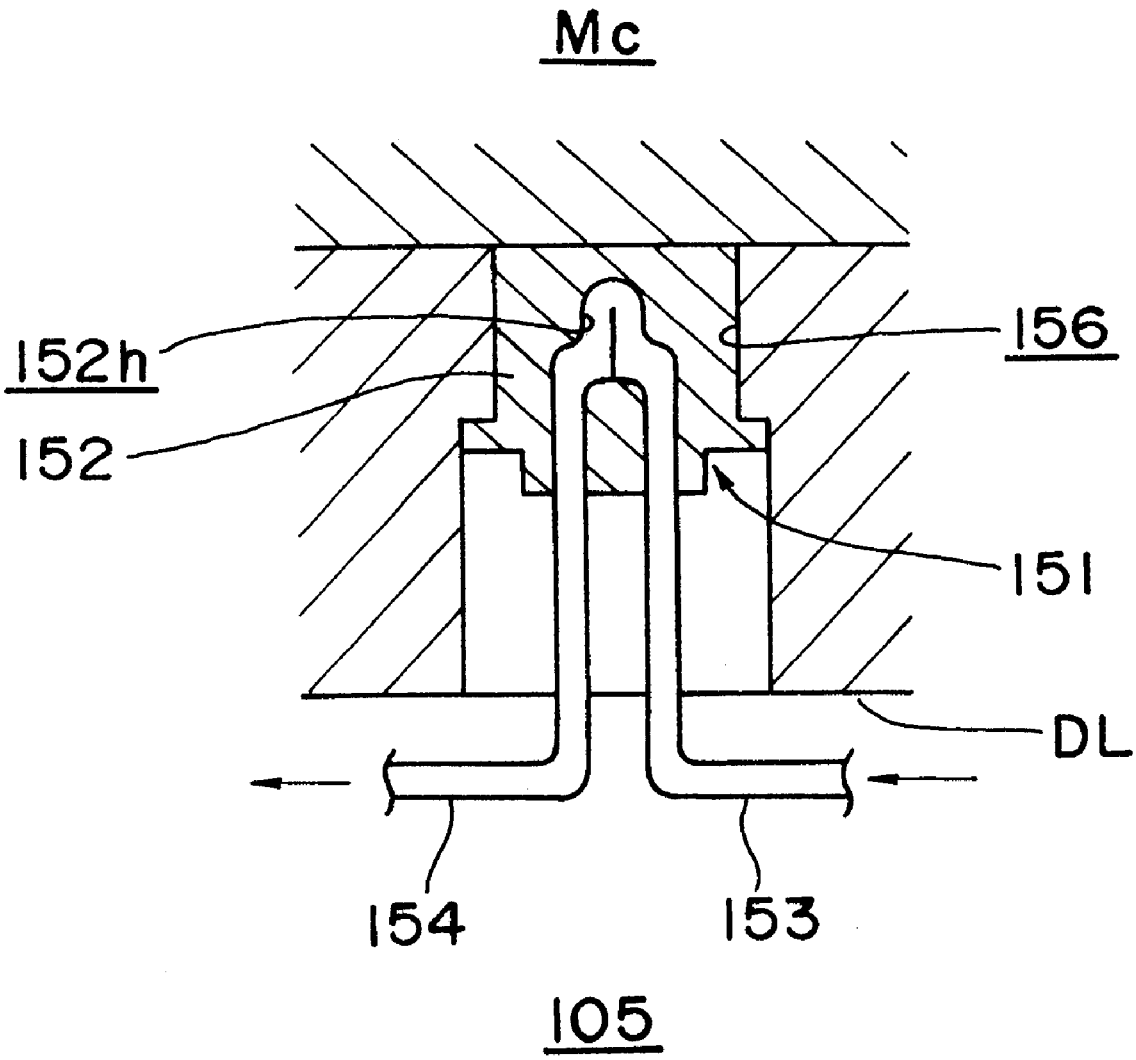
FIG. 18 is an enlarged explanatory vertical cross-sectional view that shows a spot cooling mechanism of the lower mold.

Moreover, as illustrated in FIG. 17 in detail, an empty section 112*h* is formed inside each bolt-hole core protrusion 112 in a manner so as to extend in its axis direction, and a directing pipe 116 for directing a cooling medium into the empty section 112*h* is inserted into the empty section 112*h*. In the case of the bolt-hole core protrusion 112, the cooling medium, directed into the empty section 112*h*, is discharged outside through the opening of the empty section 112*h*. The directing pipe 116 is connected to a cooling medium supply source (not shown) different from that used for the plug-hole core protrusions 111; thus, a cooling means for the bolt-hole core protrusions 112 is constituted by a cooling-medium supplying system including the cooling-medium supply source and the directing pipe 116.

In the present embodiment, in order to provide a proper directivity for a cooling process in the molten metal after pouring and to obtain a high-quality cast product less susceptible to defects, with respect to cooling means attached to the protrusions 111 and 112, those attached to the inside protrusions comparatively closer to the center of the casting mold DU (that is, the plug-hole core protrusions 111) are designed so as to have a greater cooling capability than those attached to the outer protrusions (that is, the bolt-hole core protrusions 112) comparatively closer to the periphery of the mold.

More specifically, liquid (for example, water) is used as the cooling medium of the cooling means attached to the plug-hole core protrusions 111, and gas (for example, air) is used as the cooling medium of the cooling means attached to the bolt-hole core protrusions 112.

In this manner, since the cooling means is attached to each of the core protrusions 111 and 112 installed in the upper mold DU, it is possible to provide a proper directivity to the cooling process of the molten metal after pouring process so as to forcefully cool the casting mold (upper mold DU) at the side farther from the gates Di and consequently to allow the molten metal to solidify starting from the farthest portion from the gates Di. Moreover, with respect to cooling means attached to the protrusions 111 and 112, those attached to the inner core protrusions comparatively closer to the center of the casting mold, that is, the plug-hole core protrusions 111 are designed so as to have a greater cooling capability than those attached to the outer core protrusions, that is, the bolt-hole core protrusions 112 comparatively closer to the periphery of the mold; therefore, with respect to the center portion and the outer portion of the casting mold cavity, it is possible to provide a proper directivity to a cooling process for the molten metal so as to allow the molten metal to gradually cool off starting from the portion closest to the center.

In other words, upon solidifying the molten metal after casting, the application of the cooling means makes it possible to accelerate the solidification of the molten metal, and it is also possible not only to simply increase the rate of solidification, but also to carry out a cooling process having a proper directivity by utilizing the inherent shape of the cylinder head; thus, it becomes possible to effectively reduce the occurrence of problems such as gas defects, etc., and consequently to provide high-quality cast products in a stable manner.

In particular, the cooling medium of the cooling means attached to the plug-hole core protrusions 111 located inside is liquid (water) and the cooling medium of the cooling means attached to the bolt-hole core protrusions 112 located outside is gas (air); therefore, with respect to the cooling means attached to the plurality of protrusions 111 and 112, by utilizing the thermal conduction characteristics, it is possible to positively provide such a setting that those attached to the inside protrusions 111 comparatively closer to the center of the mold have a greater cooling ability than those attached to the outside protrusions 112 comparatively closer to the periphery of the mold.

Moreover, in particular, since the protrusions 111 and 112 are formed so as to correspond at least to the plug holes comparatively closer to the center of the cylinder and the bolt holes comparatively closer to the periphery of the cylinder head, it is possible to carry out cooling and solidifying processes having a proper directivity with respect to the molten metal after casting, by utilizing the plug holes and bolt holes that are inherent to the cylinder head.

Furthermore, in the present embodiment, with respect to the inside protrusions (that is, the plug-hole core protrusions 111), in order to remove residual cooling medium inside the empty section 111*h* of the protrusion 111 after stoppage of the cooling operation of the cooling means attached thereto, a purging air supply pipe (residual liquid removing means) for air-purging the empty section 111*h* is attached thereto, although not specifically shown in the Figure.

The application of such a residual liquid removing means makes it possible to positively solve a problem in which liquid that has served as the cooling medium resides inside the empty section 111*h* of the protrusion 111 in an uncontrollable state in its temperature, resulting in degradation in precision of the temperature control, when the cooling means in the protrusion 111 is operated for the next cycle of casting operation. Moreover, this also possible to prevent the generation of rust inside the empty section 111*h* of the protrusion 111.

Next, an explanation will be given of a controlling operation for cooling the lower mold DL.

In the present embodiment, as illustrated in FIG. 15, a spot cooling mechanism 151, which restricts the thermal conduction so as not to be exerted in any direction other than a specific direction, is installed in the lower mold DL.

This spot cooling mechanism 151 is constituted by a main body 152 that is fitted to a mounting hole 156 formed at a predetermined position of the lower mold DL, a supply pipe 153 for supplying a cooling medium to a cooling medium path 152*h* formed inside the main body 152 and a discharging pipe 154 for discharging the cooling medium through the cooling medium path 152*h*. The main body 152, which includes the cooling medium path 152*h* inside thereof, is formed into a cylinder-like shape.

The supply pipe 153 is connected to a supply source (not shown) of a cooling medium, and the discharging pipe 154 is connected to a collection device (not shown) for the cooling medium. The cooling medium path 152*h* formed inside the main body 152, the supply pipe 153, the supply source of the cooling medium (not shown), the discharging pipe 154 and the collection device (not shown) constitute a cooling medium circulation system of the spot cooling mechanism 151.

In the spot cooling mechanism 151, the peripheral portion of the main body 152 is fitted to the mounting hole 156 installed in the lower mold DL so that the tip face of the main body 152 faces the inside of the casting mold cavity Mc.

In this manner, the spot cooling mechanism 151 has its one end face allowed to face the inside of the casting mold cavity Mc, the molten metal at this portion is selectively cooled with a directivity in the length direction of the main body 152. Moreover, since the main body 152 has its peripheral portion fitted to the mounting hole 156 formed in the lower mold DL, it is possible to change the thermal conduction property with this fitting portion serving as a border.

In the present embodiment, the lower mold DL may be made of steel while the main body 152 may be made of, for example, an aluminum alloy; thus, by changing the materials of the two members, the thermal conduction property is changed with the fitting portion of the two members serving as a border so that the cooling process by the spot cooling mechanism 151 is allowed to have the above-mentioned directivity.

Here, instead of this arrangement, or in addition to this arrangement, a gap may be provided in the fitting portion of the two members so as to restrict the thermal conduction through the fitting portion. Moreover, for example, an insulating layer such as a ceramics flame coating layer may be formed in the fitting portion of the two members so that the thermal conduction may be restricted so as not to be exerted in any direction other than the length direction of the main body 152.

As described above, the spot cooling mechanism 151, which restricts the thermal conduction so as not to be exerted in any direction other than a specific direction (in the length direction of the main body 152 in which it faces the casting mold cavity Mc) of the lower mold DL, is installed so that a specific portion of the molten metal inside the casting mold cavity Mc is allowed to cool off and solidify with a directivity in a predetermined direction; thus, it becomes possible to effectively reduce the possibility of problems such as gas defects, and consequently to provide high-quality cast products in a stable manner.

Moreover, as described earlier, in the present embodiment, one portion of the casting mold face corresponding to the side face of the cylinder head is formed by a sand wall, the sand wall 138 is assembled in the lower mold DL, and the above-mentioned spot cooling mechanism 151 is installed in the vicinity of the sand wall 138 (see FIGS. 6 and 7). Here, the spot cooling mechanism 151 is installed in the vicinity of the sand wall 138 that is as far as possible from the gates Di.

As described above, the spot cooling mechanism 151 is installed in the vicinity of the sand wall 138 so that the vicinity of the sand wall 138, which has a low thermal conduction property and is hard to be cooled, can be forcefully cooled selectively.

Moreover, as described earlier, in the present embodiment, the distributor 9, which serves as a molten metal supplying section for supplying the molten metal to be injected into the casting mold cavity Mc through the gates Di, is installed below the lower mold DL. Here, in the lower face side of the lower mold DL is formed a recess 105 having a predetermined depth, and the supply pipe 153 and the discharging pipe 154 serving as the cooling medium paths of the spot cooling mechanism 151 are placed in the space 105 having a recessed shape. Moreover, a communicating cylinder 106 that allows the distributor 9 to communicate with the gates Di is also installed in the space 105 having a recessed shape.

Here, in order to prevent foreign matters, etc. that give adverse effects on the mechanical properties of the resulting cast product from entering the inside of the casting mold cavity Mc, a screen mesh (metal mesh 109) is attached to the gates Di. This metal mesh 109 is normally removed when the cast product is taken out, and this is newly attached for each casting cycle.

In this manner, the molten metal supply section 9 (distributor) for supplying the molten metal to be injected into the casting mold cavity Mc through the gates Di is installed below the lower mold DL; a predetermined space 105 is formed between the distributor 9 and the lower mold DL; the cooling medium paths 153 and 154 for the spot cooling mechanism 151 are placed in the space 105; and the communicating cylinder 106 for allowing the distributor 9 to communicate with the gates Di is placed therein. Therefore, the cooling medium paths 153 and 154 are readily placed below the lower mold DL where it is normally difficult to provide a space, without causing any problems, and the spot cooling mechanism 151 is easily installed on the lower mold DL side.

As described above, on the upper mold DU side, a cooling means is attached to each of the core protrusions 111 and 112 formed on the upper mold DU; therefore, it is possible to provide a proper directivity to the cooling process of the molten metal after the casting process so as to allow the molten metal to solidify starting from the farthest portion from the gates Di by forcefully cooling the casting mold (upper mold DU) starting from the side farthest from the gates Di. Moreover, with respect to the cooling means attached to the core protrusions 111 and 112, those attached to the inside core protrusions 111 (plughole core protrusions) comparatively closer to the center of the mold are provided with a greater cooling ability than those attached to the outside core protrusions 112 (bolt-hole core protrusions) comparatively closer to the periphery of the mold; therefore, with respect to the center side and the peripheral side of the molding cavity Mc as well, it is possible to carry out a cooling process for the molten metal having such a directivity that the molten metal is gradually cooled off starting from the portion closest to the center.

Furthermore, the spot cooling mechanism 151, which restricts the thermal conduction so as not to be exerted in any direction other than a specific direction, is installed on the lower mold DL side; therefore, a specific portion of the molten metal inside the casting mold cavity Mc is allowed to cool off and solidify with a proper directivity in a predetermined direction from the lower mold DL side.

In other words, upon solidifying the molten metal after casting, the application of the cooling means makes it possible to accelerate the solidification of the molten metal, and it is also possible not only to simply increase the rate of solidification, but also to carry out a cooling process having a proper directivity by utilizing the inherent shape of the cylinder head; thus, it becomes possible to effectively reduce the occurrence of problems such as gas defects, etc., and consequently to provide high-quality cast products in a stable manner.

Here, in the present embodiment, the spot cooling mechanism 151 is only installed in the lower mold DL; however, this may be installed only in the upper mold DU or in both of the casting molds DU and DL.

Next, an explanation will be given of the first and second carriages BP and BC, and in particular, of the second carriage (core carriage) BC, installed in the low-pressure casting apparatus A.

As described earlier, when the upper mold DU has been raised and an opened space K is formed with respect to the lower mold DL (see FIG. 1), these carriages BP and BC are allowed to proceed and retreat to and from the opened space K; thus, after a core and a sand wall have been loaded onto the core carriage BC outside the opened space K, this is allowed to proceed (advance) into the opened space K, and lowers the core and the sand wall, maintained thereon, and sets them into the lower mold DL.

Moreover, as will be described later, the core carriage BC also carries a coating box T used for coating the casting-mold inner surface of the upper mold DU and the side molds DS with a powder mold wash and the coating box T is raised inside the opened space K so as to apply the powder mold wash to the upper mold inner surface (that is, a fitting face to the lower mold DL, which faces down). Here, in the present embodiment, with respect to the mold wash, for example, a material having silica clay as its main component is used. Instead of this, another mold wash having, for example, carbon as its main component may be preferably used.

The upper mold DU and the side molds DS are lowered to be fitted to the lower mold DL, and molten metal is supplied and injected into a cavity Mc formed by these molds DU, DS and DL so that a predetermined cast product (cylinder head) is cast-molded. Then, the resulting cast product is taken out in a direction opposite to the standby position of the core carriage BC by the product receiving carriage BP in a state where the upper mold DU has been raised and the opened space K is formed.

Figure 19:
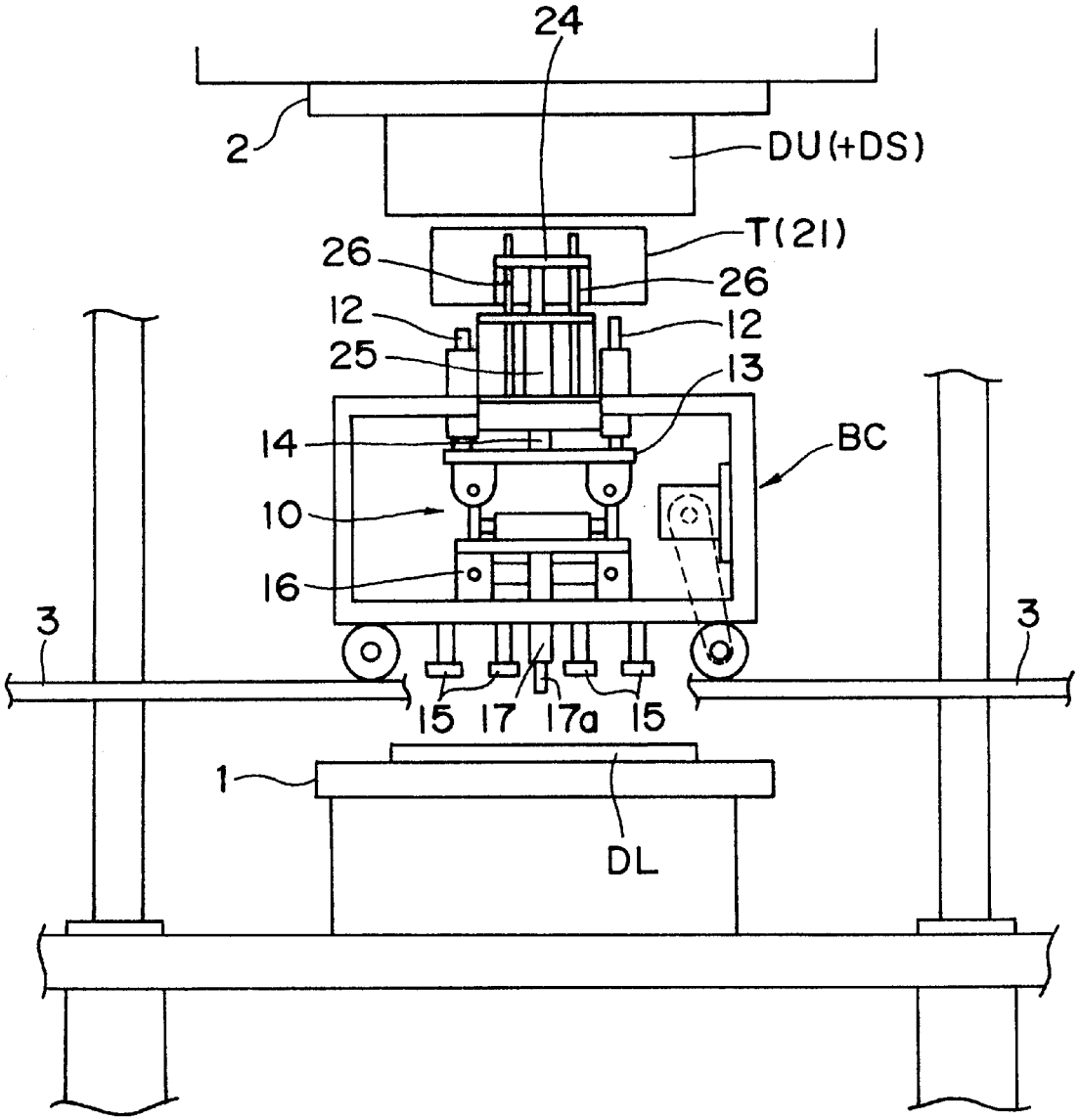
FIG. 19 is an explanatory front view that shows a second carriage (a core carriage) in accordance with an embodiment of the present invention.
Figure 20:
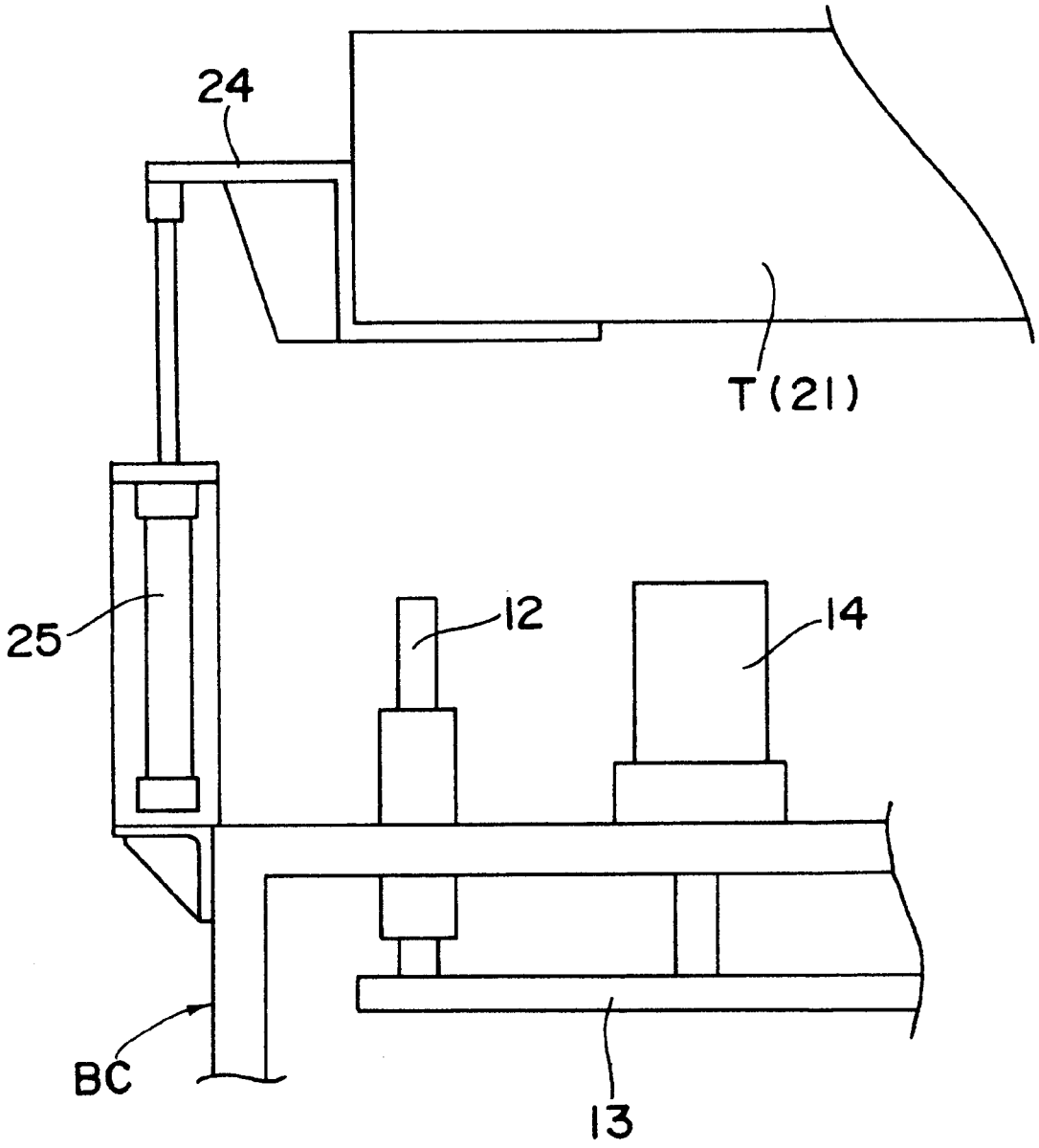
FIG. 20 is an enlarged explanatory drawing that shows an upward and downward driving section of a coating box of the second carriage.
Figure 21:
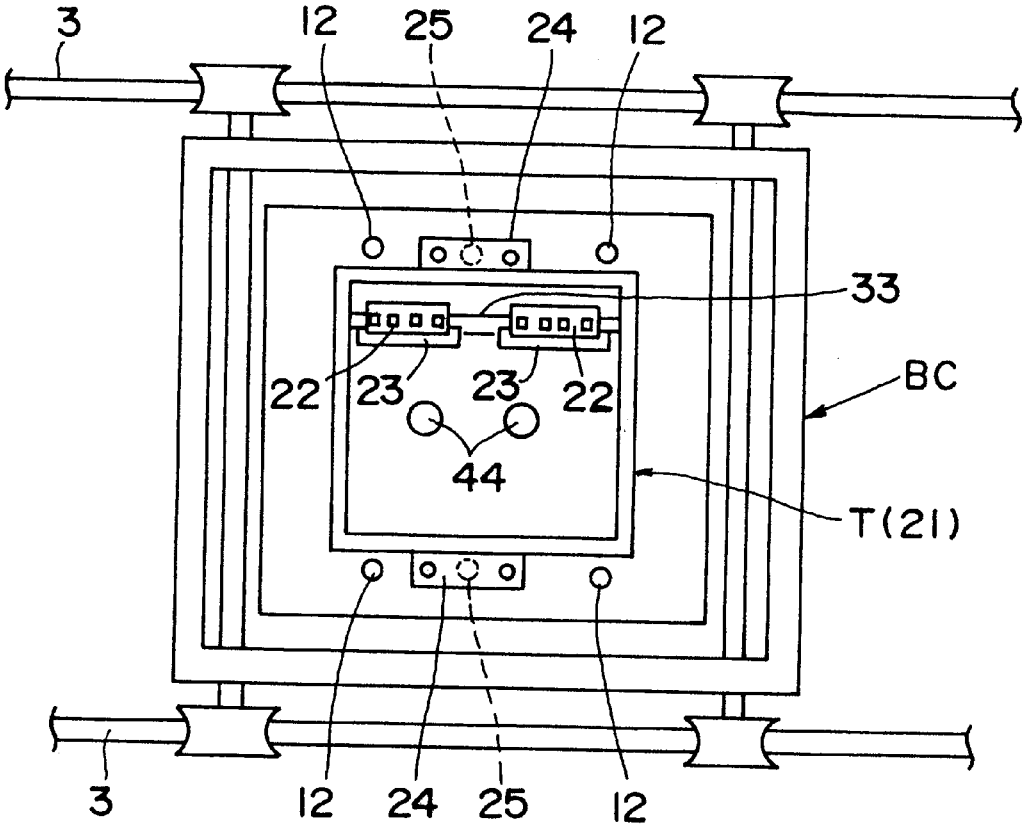
FIG. 21 is an explanatory plane view of a covering member mounted on the second carriage.

Referring to FIGS. 19 to 21, a detailed explanation will be given of the core carriage (the second carriage) BC. The core carriage BC is provided with a core setting device 10 on its lower portion. The core setting device 10 is provided with a base plate 13 that is allowed to move up and down while being guided by a guide rod 12, and this base plate 13 is driven to move up and down by a cylinder device 14 serving as an upward and downward driving means of the core setting device 10. A plurality of holding claws 15, which are opened and closed in the direction of the paper face of FIG. 19, are supported on its lower portion, and an open and closing mechanism 16 including an actuator for opening and closing the holding claws 15 is installed therein.

The above-mentioned core setting device 10 has a positioning pin 17*a* that are placed side by side with the holding claws 15 and extends in a longitudinal direction. The positioning pin 17*a* is virtually constituted by a piston rod of a cylinder device 17 placed in the longitudinal direction, and the core carriage BC has moved to a predetermined position inside the opened space K. so that the positioning pin 17*a* is lowered to be inserted into a positioning hole (not shown) of the lower mold DL; thus, the positioning of the core carriage BC inside the opened space K is carried out. In this positioned state, the setting of the cores and the sand wall as described earlier and the coating of the inner surface of the upper mold DU and the side molds DS with the powder mold wash are carried out.

Figure 22:
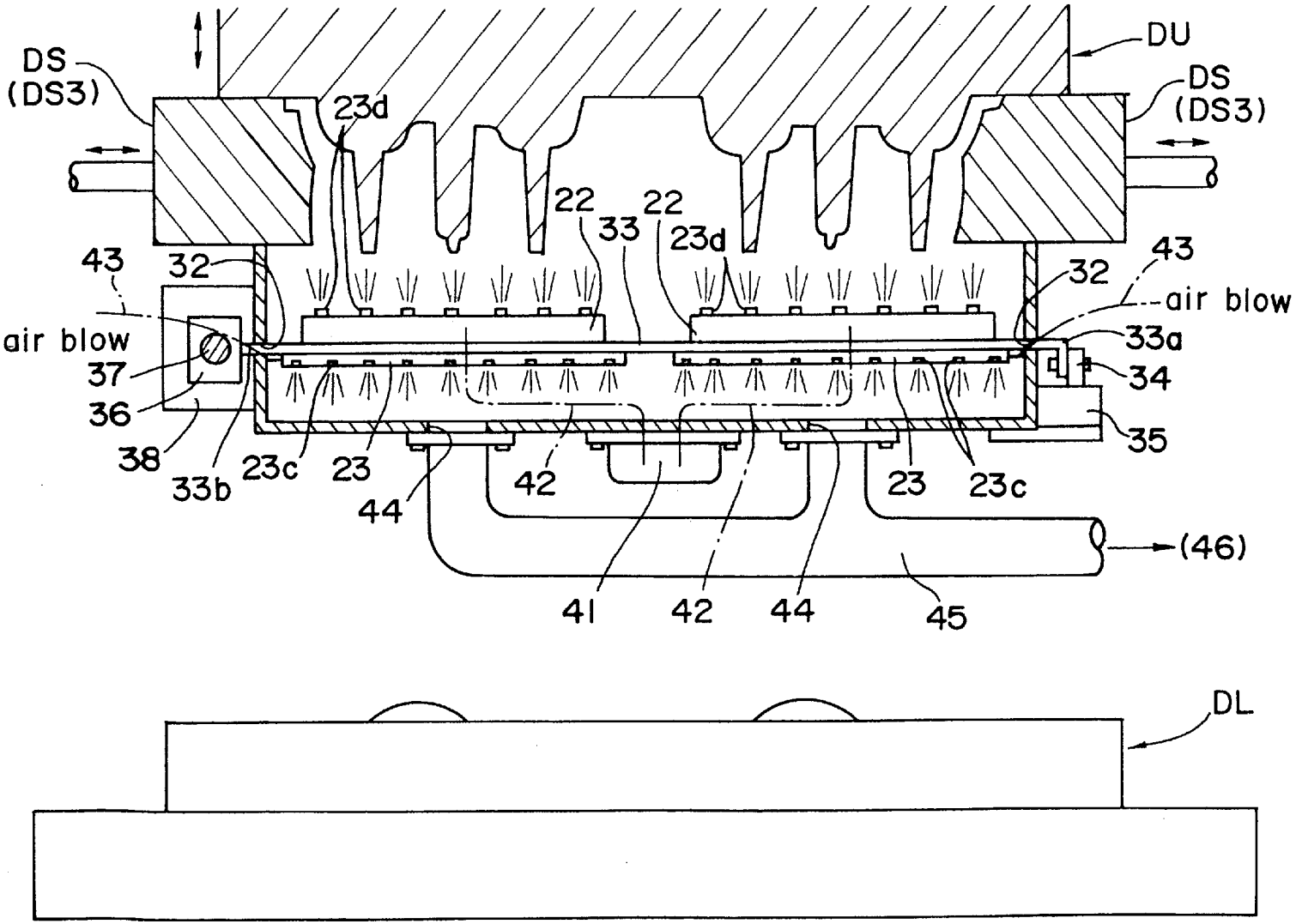
FIG. 22 is an explanatory vertical cross-sectional view that shows the relationship among the cast molds, the covering member, a spray nozzle and a blow nozzle.
Figure 23:
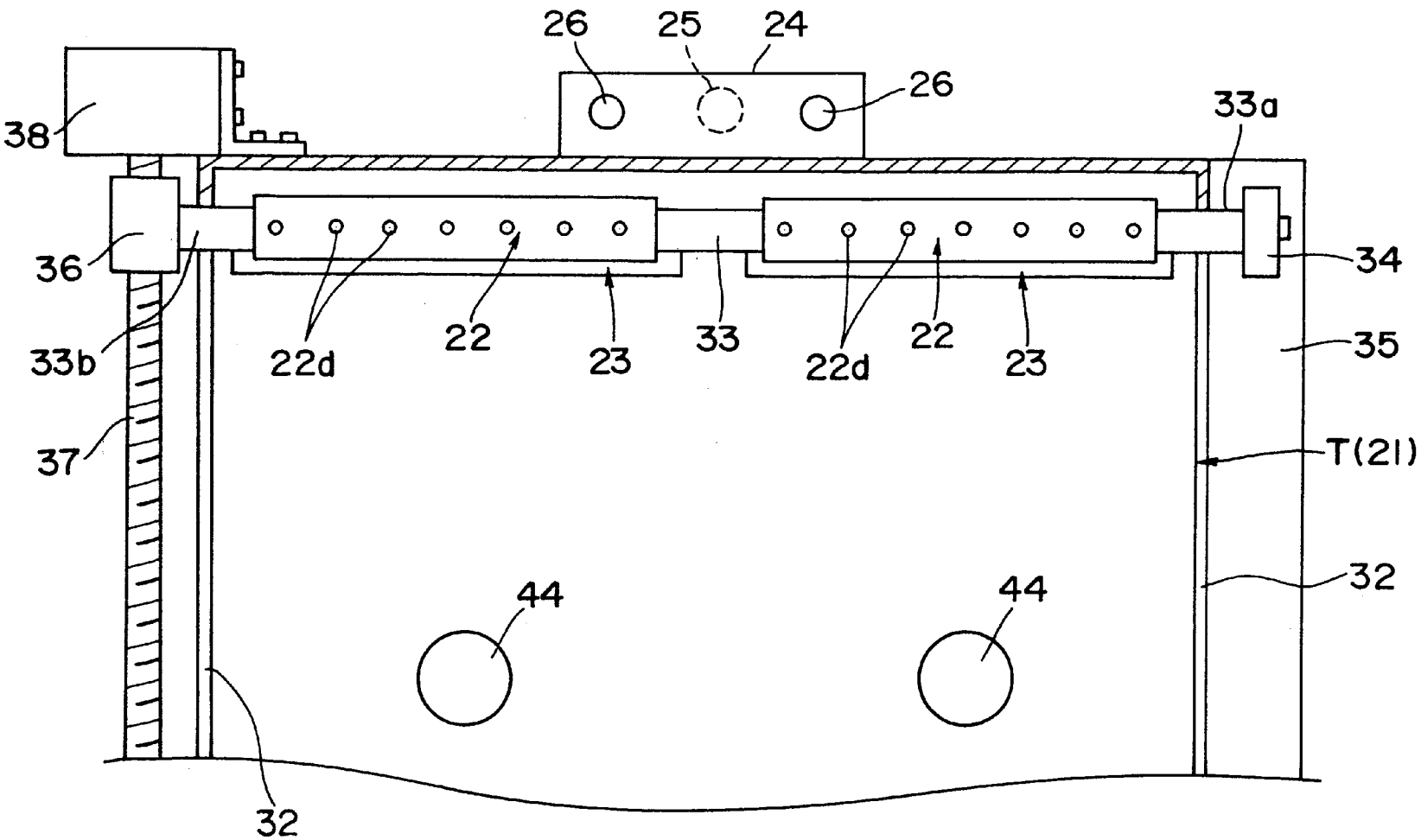
FIG. 23 is an explanatory plane view that shows the spray nozzle, the blow nozzle and a spray nozzle driving section placed in the covering member.

The outer shell of the above-mentioned coating box T is virtually constituted by a covering member 21, and as illustrated in FIGS. 21 to 23, a spray nozzle 22 used for spraying the powder mold wash and a blow nozzle 23 used for blowing air are maintained inside thereof. The covering member 21, which is formed into a box shape with only an upward opening, has a bottom wall and front and rear side walls and right and left side walls; thus, when it is positioned inside the opened space K, the upward opening is allowed to face the upper mold inner face.

The covering member 21 is held on the core carriage BC in a manner so as move upward and downward at a position higher than the core setting device 10 (base plate 13), more specifically, at a position higher than the upper frame of the core carriage BC. In other words, the plate 24 is installed on the outer wall of the covering member 21, and, a cylinder device 25 serving as a upward and downward driving means is placed between this plate 24 and the frame of the core carriage BC. A guide rod 26, which extends upward from the core carriage BC, is allowed to penetrate the plate 24 so as to freely slide in the longitudinal direction so that, in response to the extension and shrinkage of the cylinder device 25, the covering member 21 is driven smoothly upward and downward.

Referring to FIGS. 22 to 25, a detailed explanation will be given of constituent elements such as the covering member 21, the spray nozzle 22 and the blow nozzle 23.

The covering member 21 is provided with a flange portion 21*a* formed around the entire upper end edge thereof, and a packing 31 made of a flexible member such as rubber is fixed over the entire face of the flange portion 21*a*. In this manner, as illustrated in FIG. 22, the covering member 21 is raised in the opened space K, and when the packing 31 comes into contact with the lower face of the upper mold DU and pressed thereon, the covering member 21, the upper mold DU and the side molds DS are cooperatively arranged to form the sealed space M inside the covering member 21.

At this time, in the present embodiment, the side molds DS, which are installed in a manner so as to switch between the mold-closed state for forming a sealed volume section and the mold-opened state for opening the volume section, are all supported on the upper mold DU as described above, and with all the side molds DS being maintained in the mold-closed state, a mold wash is applied to the inner faces of the respective side molds DS and the upper mold DU; therefore, different from the case in which at least one part of the side molds is supported in the lower mold DL having the gates Di, it is not necessary to execute the coating processes of the mold wash twice in a separate manner. In other words, the mold wash is applied to the inner faces of the upper mold DU and all the side molds DS by carrying out the coating process only once; thus, it is possible to improve the efficiency of the coating process.

At lower portions of the front and rear side walls of the covering member 21, slits 32 are formed in a manner so as to stretch long in parallel with each other, and these slits 32 extend virtually all through the length of the covering member 21 in the lateral direction. A holding member 33 having an elongated rod shape is placed inside the covering member 21, and the respective ends of this holding member 33 are allowed to penetrate the slits 32 so as to freely slide therein. A roller 34, which serves as a traveling wheel outside the covering member 21, is attached to one end 33*a* of the holding member 33 so as to freely rotate thereon, and this roller 34 is allowed to travel on a guide rail 35 secured on the outside of the side wall of the covering member 21.

A nut member 36 is secured to the other end 33*b* of the holding member 33 outside the covering member 21, and this nut member 36 is engaged with the circumference of a threaded rod 37 that extends long along the slits 32. The threaded rod 37 is supported on the covering member 21 so as to rotate thereon, and its one end is connected to a rotary actuator (for example, an electric motor in the present embodiment) 38. In this arrangement, by rotating the actuator 38, for example, forwardly, the nut member 36, that is, the holding member 33, is driven downward in FIG. 23, while by rotating the actuator 38 reversely, the holding member 33 is driven upward in FIG. 23.

Figure 24:
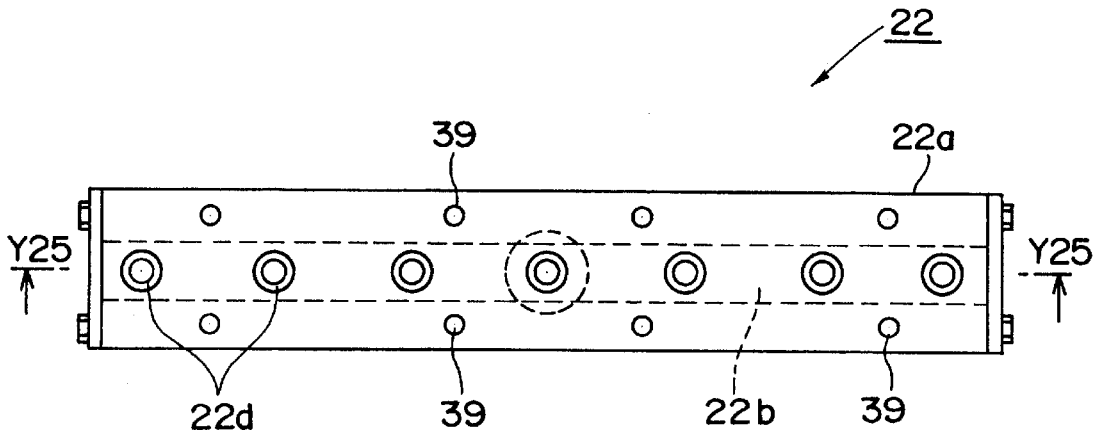
FIG. 24 is an explanatory plane view of the spray nozzle.
Figure 25:
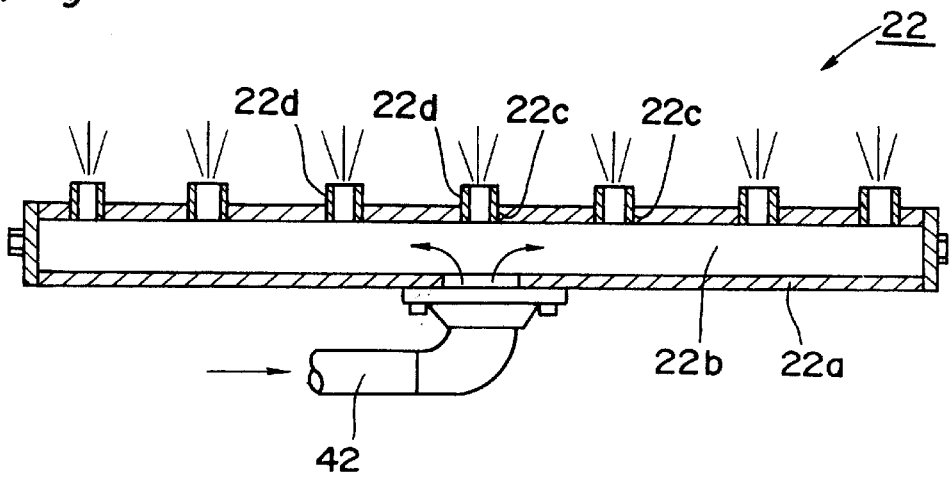
FIG. 25 is an explanatory vertical cross-sectional view taken along Y25—Y25 line of FIG. 24.

The spray nozzle 22 and the blow nozzle 23 are secured to the holding member 33. As illustrated in FIGS. 24 and 25 in detail, the spray nozzle 22 has an elongated cylinder main body 22*a* with its respective ends closed, and this cylinder main body 22*a* has a long, thin inner common space 22*b* and a plurality of communicating holes 22*c* that respectively communicate with the common space 22*b*. These communicating holes 22*c* are formed in series with each other in the length direction of the cylinder main body 22*a* with intervals, and nozzle members 22*d* are respectively attached to the communicating holes 22*c*.

A pair of the spray nozzles 22 are installed in the length direction of the holding member 33 with a gap between them, and secured to the holding member 33. Each spray nozzle 22 has a securing screw hole 39 for the holding member 33. The securing process of the spray nozzle 22 to the holding member 33 is carried out with the nozzle member 22*d* facing up.

Although the blow nozzle 23 also has virtually the same structure as the spray nozzle 22, it does not have a member corresponding to the nozzle member 22*d*, and its opening corresponding to the communicating holes 22*c*, as it is, serves as a blow air outlet 23*c* (see FIG. 22).

Then, the blow nozzle 23 is secured to the holding member 33 with this blow air outlet 23*c* being set downward to face the bottom wall of the covering member 21. In the same manner as the spray nozzle 22, a pair of the blow nozzles 23 are formed along the length direction of the holding member 33 with a gap between them.

As described above, in the present embodiment, the mold wash applying means, installed on the core carriage BC, is provided with the covering member 21 serving as a closing member for forming a sealed coating space in combination with the upper mold DU and the side molds DS in a mold-closed state, and the spray nozzle 22 serving as a coating mechanism positioned inside the coating space M when the coating space M is formed; therefore, in a state where the closed space (coating space) M is formed by using the covering member 21, the mold wash is automatically applied to the inner faces of the upper mold DU and the side molds DS by using the spray nozzle 22.

Moreover, the mold wash applying means is attached to the second carriage (core) BC that is allowed to proceed and retreat to and from the opened space K of the upper and lower casting molds DU/DL, and the carriage BC is provided with a core assembling device 10 for holding a core and assembling the core into the lower mold DL on the side opposite to the side to which the mold wash applying means is attached, with the result that it is possible to carry out the automatic assembling process of the core while the automatic applying process of the mold wash is being carried out.

The supply of the powder mold wash to the spray nozzle 22 is carried out from a connecting member 41 attached to the bottom wall of the covering member 21 through a flexible hose 42 installed inside the covering member 21. This hose 42 is connected in such a manner that it is allowed to communicate with the common space 22*b* of the spray nozzle at a virtually middle position in the length direction thereof (see FIGS. 24 and 25).

The supply of blow air to the blow nozzle 23 is carried out through a long, thin flexible hose 43 that passes through the above-mentioned slit 32. Moreover, on the bottom wall of the covering member 21, two suction openings 44 are formed in the center thereof. These suction openings 44 are connected to the suction device 46 (see FIG. 26) through the hose 45.

Figure 26:
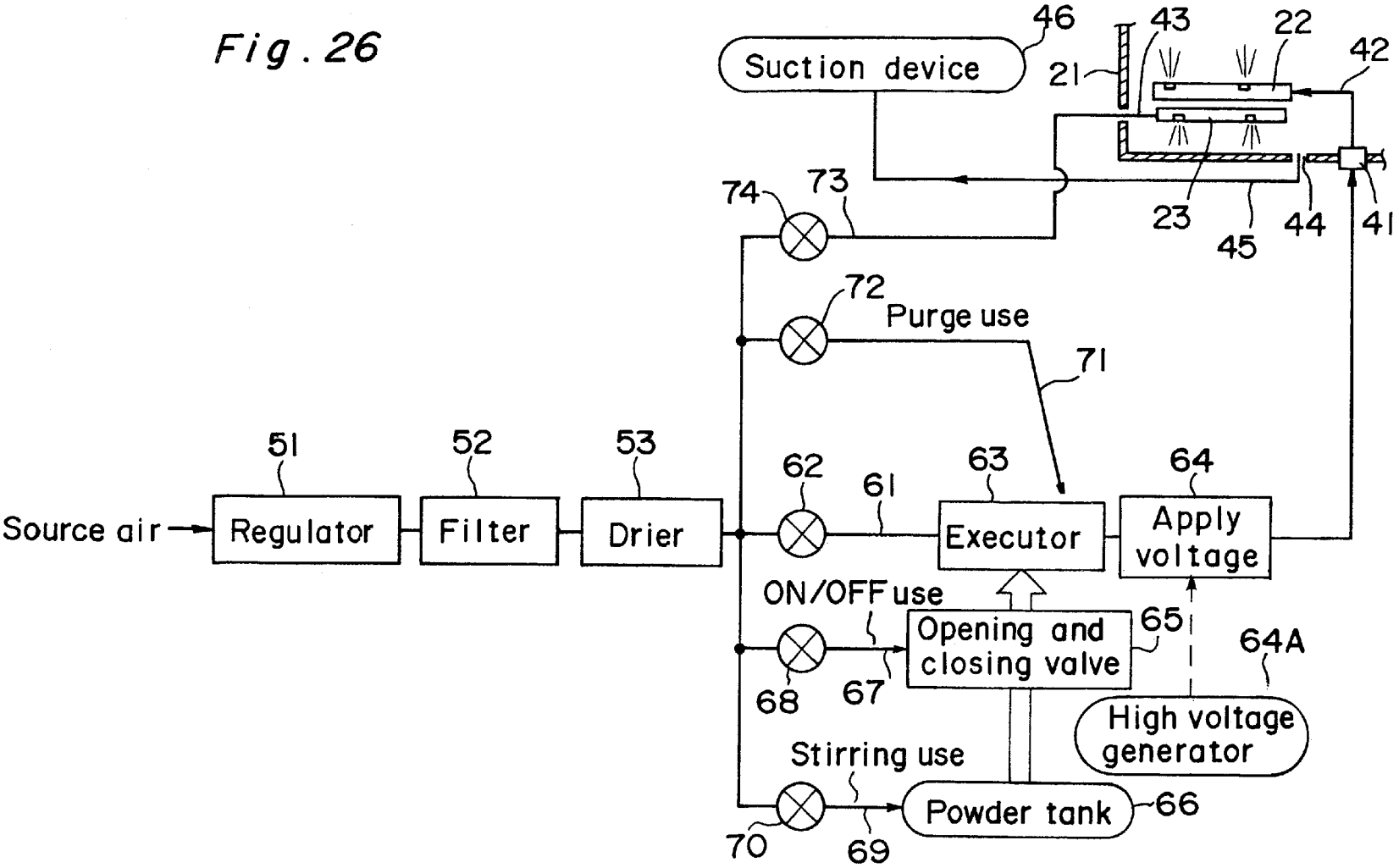
FIG. 26 is a system diagram of the spray nozzle, the blow nozzle and a suction device.

FIG. 26 schematically explains the connection paths of the spray nozzle 22, the blow nozzle 23 and the suction opening 44. As illustrated in FIG. 26, original air, supplied from the air supply source (not shown) successively passes through a regulator 51, a filter 52 and a dryer 53 so as to form clean dry air with a predetermined adjusted pressure.

There are branch paths of five systems in parallel with each other on the downstream side of the dryer 53. One of the branch paths 61 forms a supply path for the powder mold wash, and is connected to the spray nozzle 22, after successively passing through an electromagnetic opening and closing valve 62, an executor 63 and a high-voltage applying section 64. To the executor 63 is connected a reservoir tank 66 for the powder mold wash through an air opening and closing valve 65; thus, in a state where the opening and closing valve 65 is open, powder mold wash is sucked from the tank 66 by air supplied by the path 61 so that the powder mold wash is pressed and sent to the spray nozzle 22.

Another branch path 67 is connected to the air opening and closing valve 65, and an electromagnetic opening and closing valve 68 is connected to this branch path 67. Thus, in response to the opening and closing of the electromagnetic opening and closing valve 68, the air opening and closing valve 65 is opened and closed.

Here, the high-voltage applying section 64 uses a high-voltage generator 64A so as to apply a voltage to the powder mold wash so that a predetermined high-voltage difference is exerted between the agent and the upper mold DU connected to, for example, a +(plus) electrode, that is, a so-called electrostatic suction method is used for adhesion of the powder mold wash (namely, electrostatic coating of the mold wash).

In this manner, the electrode is connected to the upper mold DU, and the mold wash is electrostatically applied to the inner surfaces of the upper mold DU and the side molds DS; therefore, it is possible to sufficiently improve the homogeneity and adhering property in the application of the mold wash to the inner surfaces of the casting mold.

[0095]

Still another branch path 69 is connected to the tank 66, and an electromagnetic opening and closing valve 70 is inserted to the branch path 69. When this opening and closing valve 70 is opened, the powder mold wash inside the tank 66 is stirred so as to effectively assist the transportation of the powder mold wash to the executor 63.

Still another branch path 71 is connected to the tip portion of the executor 63, and an electromagnetic opening and closing valve 72 is inserted in the branch path 71. Thus, when the opening and closing valve 72 is opened, purging air is supplied to the spray nozzle 22 through the executor 63.

Moreover, the other branch path 73 is connected to the blow nozzle 23, and an electromagnetic opening and closing valve 74 is inserted in the branch path 73. Thus, blowing air is supplied through the blow nozzle by opening the opening and closing valve 74.

Figure 27:
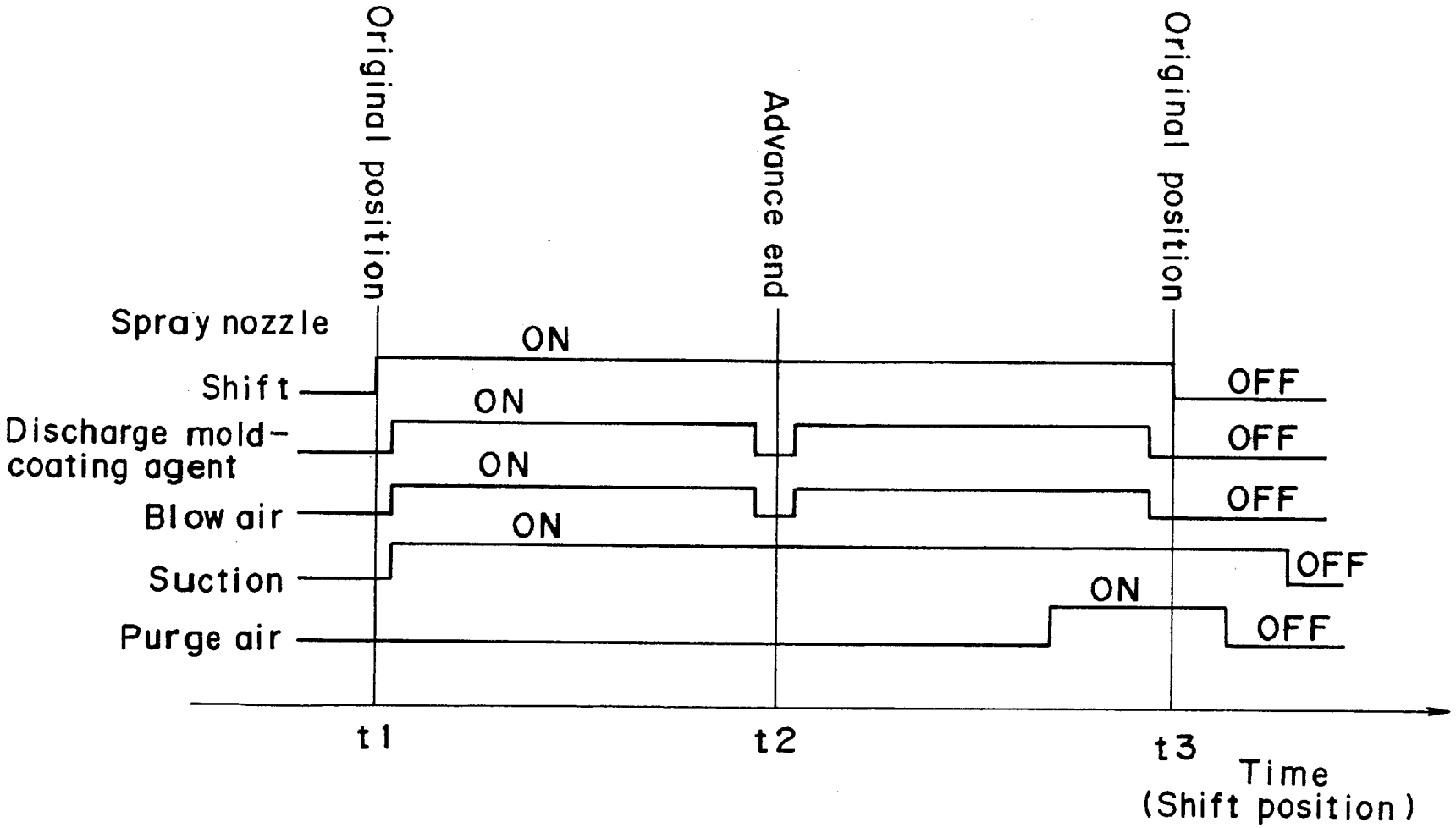
FIG. 27 is a time chart that shows one example of the relationship among the shift of the spray nozzle, the spraying process of the powder mold wash, the blow air supply and the suction process and supply of purging air.

FIG. 27 is a time chart that shows one example of the relationship among the shift of the spray nozzle 22, the spraying process of the powder mold wash from the spray nozzle 22, the blow air supply from the blow nozzle 23, and the suction process and supply of purging air through the suction opening 44.

In this example shown in FIG. 27, the spray nozzle 22 is operated in such a manner that after having been shifted from the original position at one end of the covering member 21 to the advance end thereof, it is again returned to the original position; and in this reciprocal movement, the coating of the inner surfaces of the upper and side molds with the powder mold wash is complete. Here, in this case, the shifting velocity of the spray nozzle 22 is set to a constant velocity.

The application of the powder mold wash from the spray nozzle 22 is started from a position where the spray nozzle 22 has slightly advanced from the original position, and is once suspended at a position slightly before or after the advance end. Then, the spraying process of the powder mold wash is resumed, and the spraying process of the powder mold wash is complete slightly before the original position. Moreover, the air blowing process is carried out in the same manner as the spraying process of the powder mold wash.

The suction process from the suction opening 44 is started at the same time with the start of the spraying process of the powder mold wash. However, with respect to the completion of the suction process, it is delayed from the completion of the spraying process of the powder mold wash due to an additional operation in which residual powder mold wash inside the sealed space M formed by the covering member 21 is sucked and collected. In other words, after the return of the spray nozzle 22 to the original position, the suction process is carried out for a while.

Here, the supply of purging air is started slightly before the completion of the spraying process of the powder mold wash. The supply of this purging air is continued for a while even after the return of the spray nozzle 22 to the original position; however, the supply is stopped earlier than the completion of the suction process.

Here, in the present embodiment, the cylinder device 14, which drives the holding claws 15 used for holding the core upward and downward, is supported by a floating mechanism.

Figure 31:
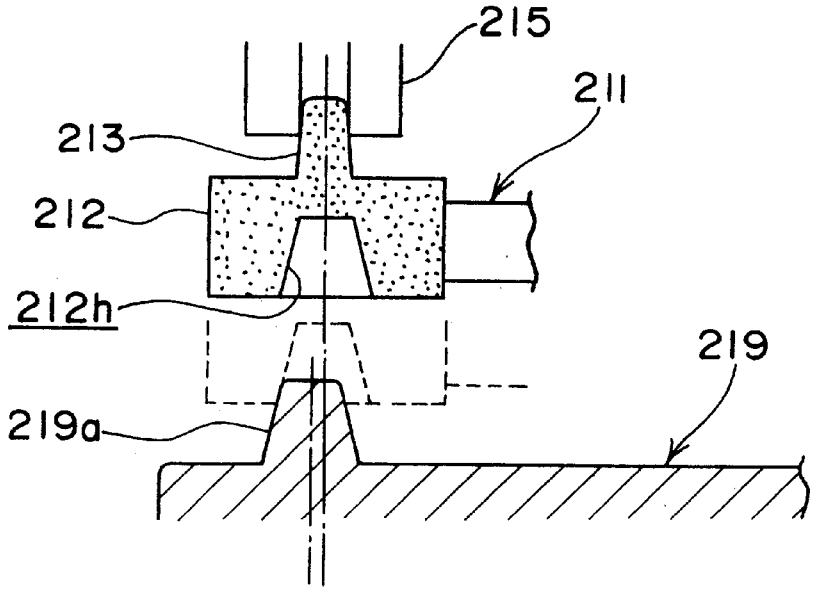
FIG. 31 is a schematic drawing that explains the operation of a driving mechanism for core holding claws in accordance with a prior art.

In other words, conventionally, for example, as shown in FIG. 31, a protruding portion 213 formed on the upper face of a core print 212 for a core 211 is held by a damper 215 in the horizontal direction, and in general, the core 211 is assembled into a casting mold 219.

Here, a positioning process is made so that the engaging section 212*h* of the core print 212 is properly engaged by a core print stopping section 219*a* installed in the casting mold 219, and the assembling process is carried out. In an actual operation, however, a positional offset tends to occur between the two members due to a difference in the amounts of thermal expansion, etc. between the casting mold 219 and the core 211. In the case when the assembling process is carried out with this positional offset (see the portion indicated by a broken line in FIG. 31), it is difficult to allow the engaging section 212*h* to properly engage the core print stopping section 219*a* (to be properly fitted thereto), since, in this conventional example, the engagement is made by releasing the clamp by the damper 215 and utilizing the gravity of the core 211. For this reason, the core 211 is assembled in its floating state, and when a casting process is carried out in this state, defective cast products tend to be produced.

Figure 32:
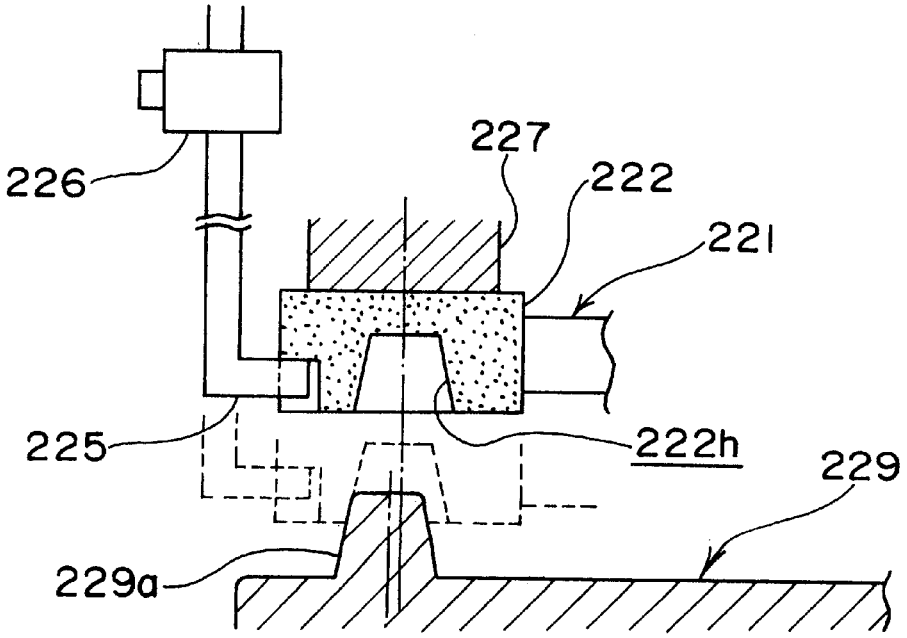
FIG. 32 is a schematic drawing that explains the operation of a driving mechanism for core holding claws in accordance with another prior art.

Moreover, in another conventional example, for example, as illustrated in FIG. 32, a core print 222 is clamped by exerting a force in the longitudinal direction by using holding claws 225 that are opened and closed by a cylinder 226, in a state where the upper face of the core print 222 is stopped by pressing a pressing tool 227 thereon.

In this case, although the assembling process is carried out while the core print 222 is being pressed, the core 221 tends to be damaged or chipped in the event of a positional offset between the engaging section 222*h* of the core print 222 and the core print stopping section 229*a* of the casting mold 229.

Figure 30:
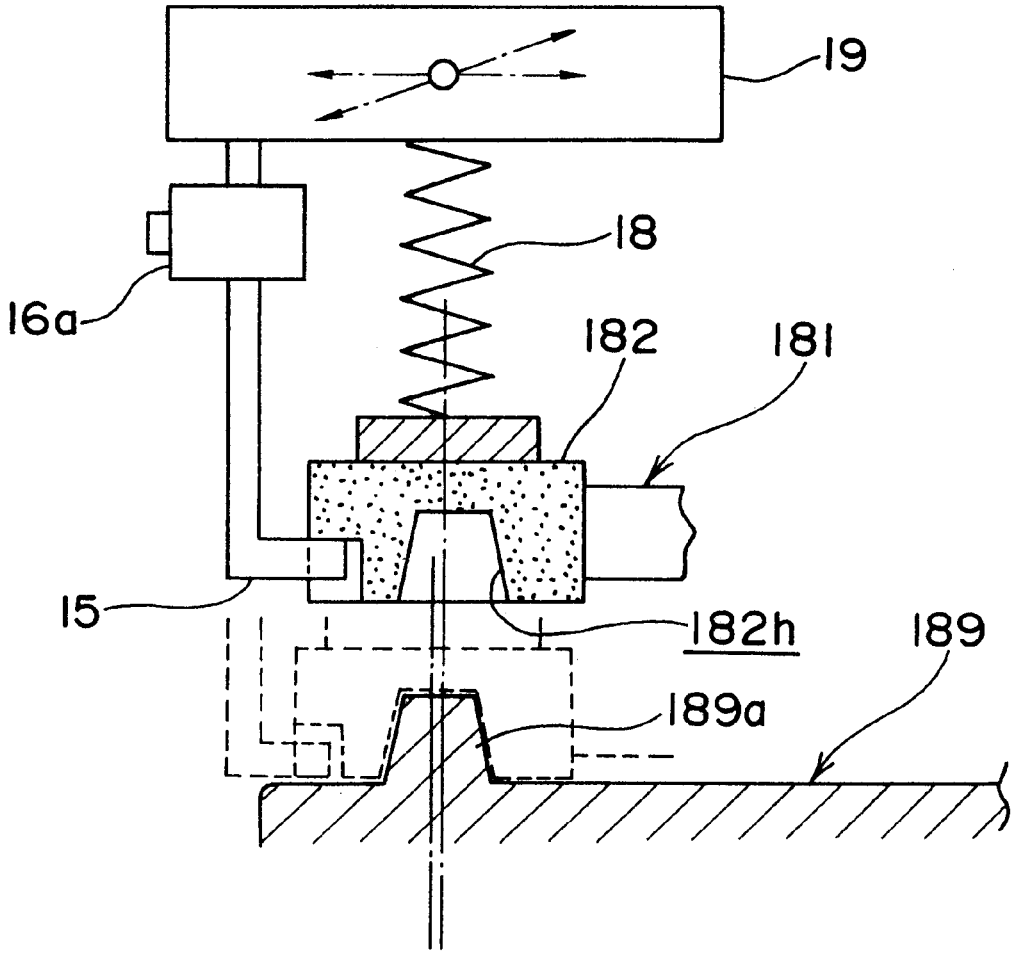
FIG. 30 is a schematic drawing that explains the operation of the driving mechanism for core holding claws.

As schematically illustrated in FIG. 30, in the present embodiment, the cylinder device 16*a* for opening and at closing the holding claws 15 for holding the core 181 is supported by a floating device 19. Moreover, a compressed spring 18 is placed on the upper face of the core print 182, and the upper end of this compressed spring 18 is secured to the floating device 19. Therefore, the core print 182 is always pressed downward by an elastic force of the spring 18.

The above-mentioned floating device 19 is a conventionally well-known device that is commercially available, and, for example, this is locked (fixed) in a state where an air pressure is applied thereto by a function of a built-in ball body and pressurized air, while in a state where no air is exerted, the locked state is released to form a floating state (in a state where it is floatably supported).

By supporting the upper end of the spring 18 through the floating device 19, the upper end supporting section of the spring 18 (therefore, the core print 182 as well) is allowed to freely shift in its position within a floating range.

In the above-mentioned arrangement, in the case when the engaging section 182*h* of the core print 182 is engaged with the core print stopping portion 189*a* of the casting mold 189 so as to set the core 181 in the casting mold 189, even if a positional offset occurs between the upper engaging section 182*h* and the core print stopping portion 189*a*, the position of the core print 182 is automatically adjusted finely by utilizing the floating function of the floating device 19 or cooperatively utilizing the elastic function of the spring 18 in the horizontal direction; thus, a smooth, accurate engaged state is obtained, with the tapered face of the engaging section 182*h* being guided by the tapered face of the core print stopping portion 189*a*, and with the pressing force of the spring 18 being applied thereto.

This arrangement makes it possible to eliminate the possibility of floating core and damages to the core, which is distinct from the conventional arrangements.

[0104]

Figure 28:
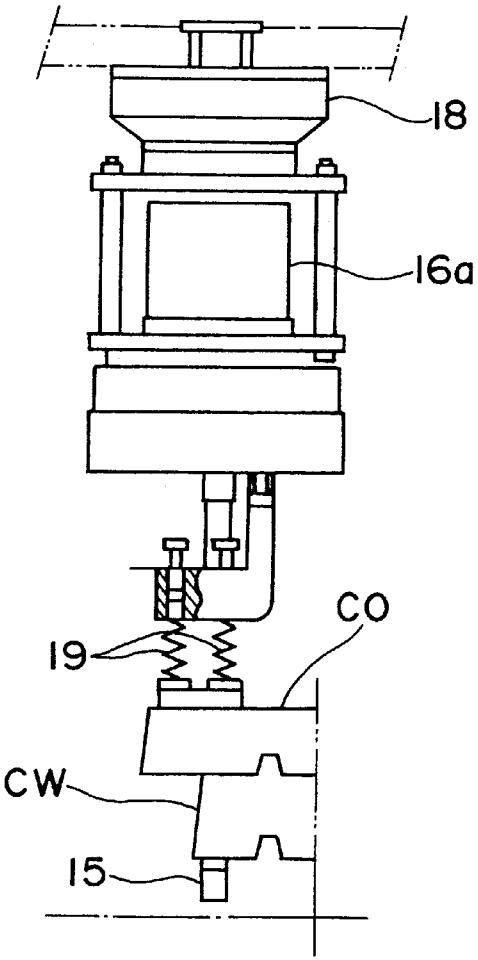
FIG. 28 is an explanatory side view of a driving mechanism for core holding claws installed in a core setting device.
Figure 29:
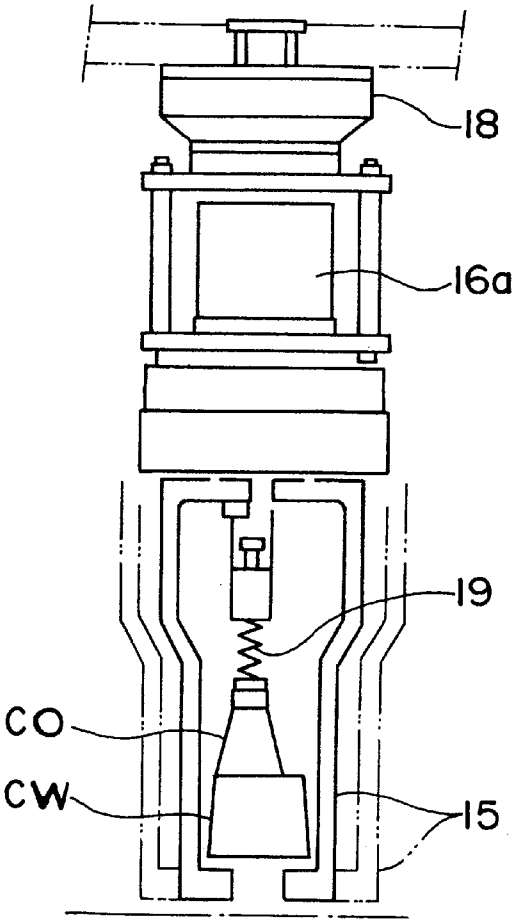
FIG. 29 is an explanatory front view of the driving mechanism for core holding claws.

FIGS. 28 and 29 show a device to which the above-mentioned core holding/assembling mechanism is specifically applied. The cylinder device 16*a* for opening and closing the holding claws 15 for supporting a core is supported by the floating device 19 placed above the device, and the compressed spring 18 is placed on the upper face of the base pate section 143 of the core CO.

Here, a pair of the core holding mechanisms, each constituted by members such as the holding claws 15, cylinder device 14 and floating device 19, are installed on the respective sides of the core CO in the length direction.

Figure 33:
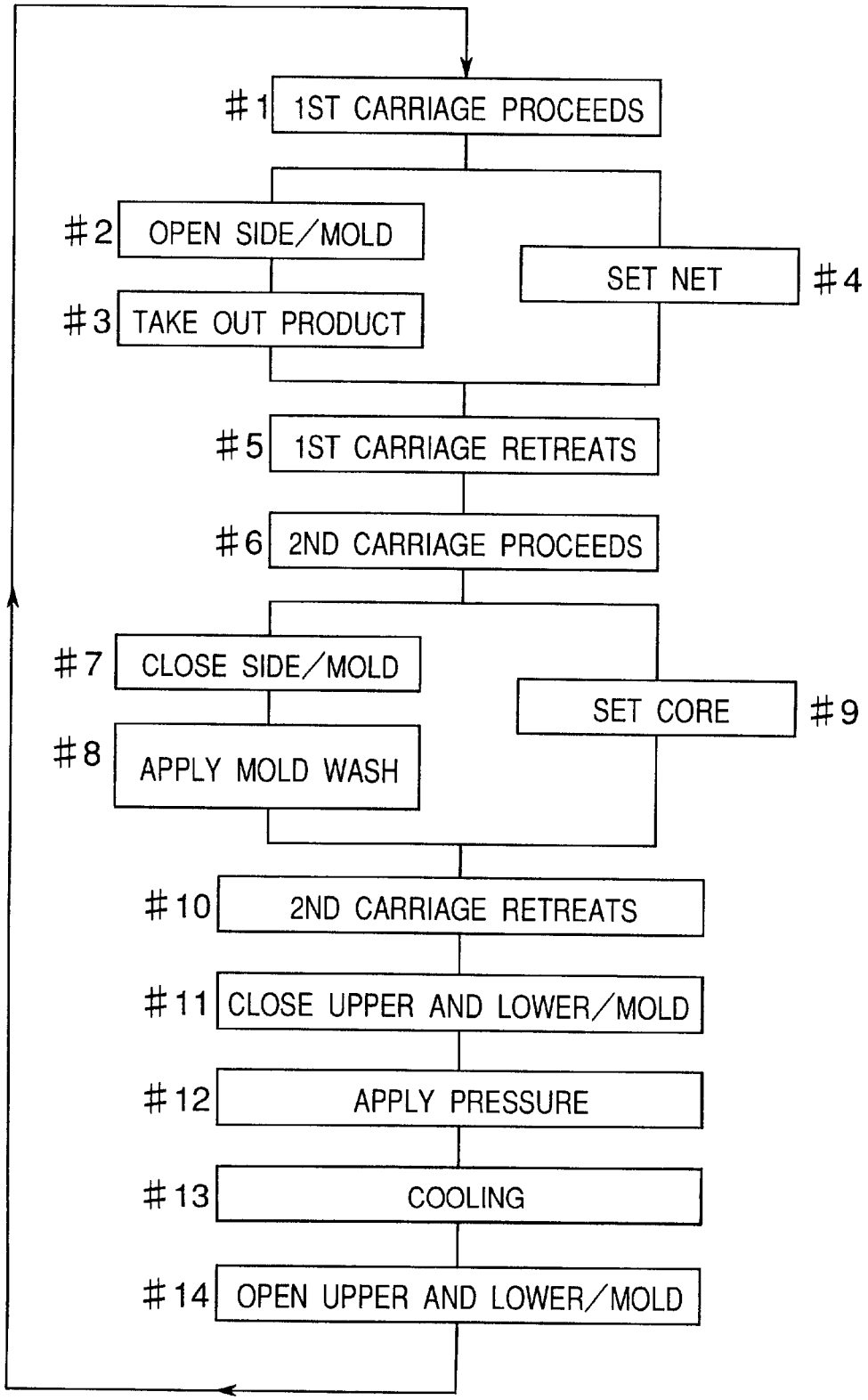
FIG. 33 is a flow chart of a casting process using the low pressure casting apparatus.
Figure 34:
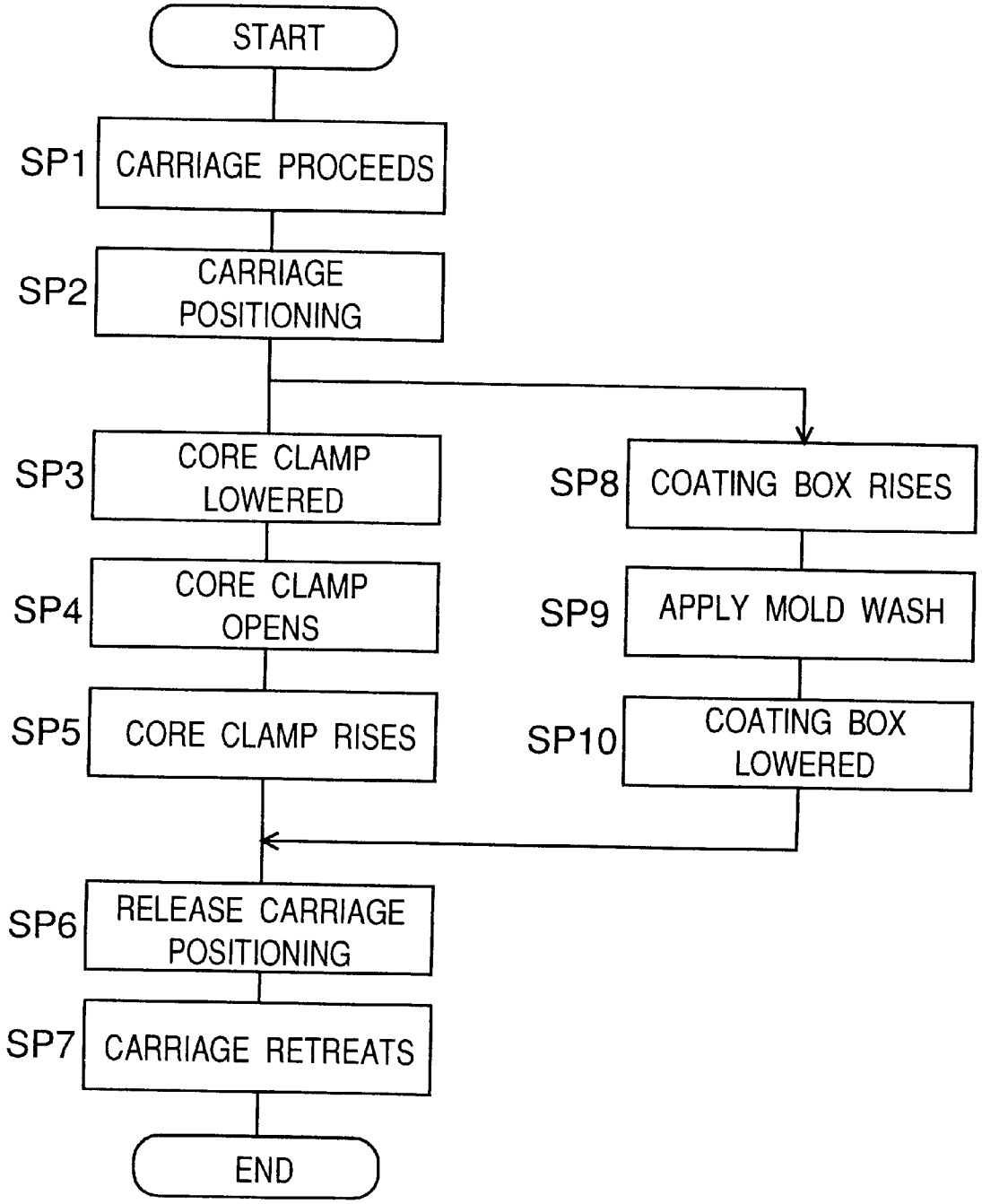
FIG. 34 is a flow chart that shows an applying process of the mold wash and a core setting process with attention being focused on a movement of the core carriage.
Figure 35:
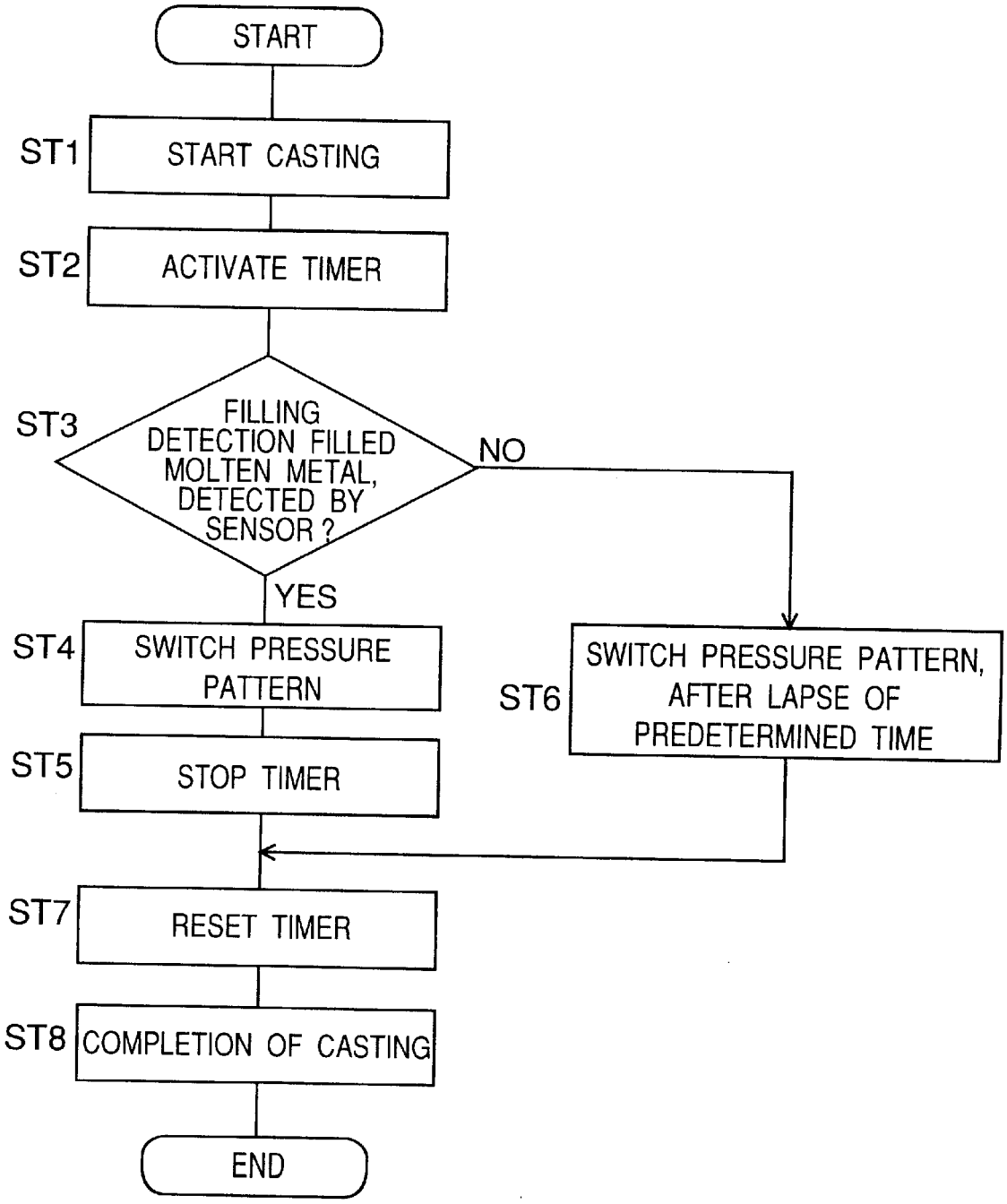
FIG. 35 is a flow chart that shows a pressure control method in the low-pressure casting apparatus.

Next, referring to flow charts shown in FIGS. 33 to 35, an explanation will be given of a casting process that is carried out by using a casting apparatus A having the above-mentioned arrangement.

In this casting process, a sequence of processes are executed repeatedly, and in this case, the explanation is started with a process for taking out a cast product (produced article) that has been molded in the previous process from a casting mold D.

When, upon completion of the casting process, the upper and lower molds DU/DL are opened, the first carriage (product receiving carriage) BP is first allowed to advance to the opened space K at step #1, and at step #2, the side molds DS(DS1 to DS3) are opened. Here, the mold-opening process at this step #2 may be carried out in parallel with step #1.

Next, at step #3, an ejector mechanism (not shown) on the upper mold DU side is driven so as to take a cast product from the upper mold DU. In this case, since the inner face of the upper mold DU is coated with the mold wash, the cast product is easily separated from the upper mold DU. The product, thus taken out, is received by the first carriage BP on its upper side.

Here, in parallel with the step #2 and/or the step #3, a metal net 109, held on a metal holder (not shown), is set to a gate Di formed in the lower mold DL (step #4). Here, a rod-shaped sensor, which is used for confirming whether or not any fragment of a metal net 109 used in the previous cycle, or any lump of residual aluminum remaining from the casting in the previous cycle, is plugging the gate Di, is installed in the upper mold DU; thus, it is possible to confirm whether or not the gate Di is appropriately opened prior to the setting of the metal net 109.

Thereafter, at step #5, the first carriage BP is allowed to retreat from the opened space K in the longitudinal direction. Then, in place of this, the second carriage (core carriage) BC is allowed to advance into the open space K (step #6).

Then, on the upper side of the second carriage BC, after all the side molds DS have been closed at step #7, the mold wash is applied to the inner faces of all the side molds DS and the upper mold DU (step #8).

At a lower portion of the second carriage BC, in parallel with the steps #7 and #8, the setting (assembling) of the core to the lower mold DL is carried out by the core setting device 10 (step #9). At this time, three types of cores CW, CO and CP and a sand wall 138 are maintained at a lower portion of the second carriage BC, and these cores CW, CO and CP and this sand wall 138 are set in the lower mold DL. Here, a rod-shaped sensor, which is used for confirming whether or not any chipped core resulting from damage to the core used in the previous cycle remains in the lower mold DL, is installed in the core setting device 10; thus, it is possible to confirm whether or not any fragment of a damaged core remains in the core setting position in the lower mold DL.

Referring to the flow chart of FIG. 34, an explanation will be given of the applying process (step #8) of the mold wash and the core setting process (step #9) in detail, with attention being focused on the movement of the second carriage BC.

More specifically, when the upper mold DU is raised and the mold is opened as described above, the core carriage BC is shifted toward the opened space K (SPl). Next, a positioning process for the core carriage BC is carried out by utilizing a positioning pin 17*a* (SP 2). Thereafter, the setting of the core and the coating of the powder mold wash are carried out in parallel; and SP3 to SP5 of FIG. 34 represent processes for setting the core, and SP8 to SP10 represent processes for spraying the. mold wash.

Upon setting the core in the lower mold DL, first, the base plate 13, that is the core, is lowered by the cylinder device 14 (SP3). Thereafter, the holding claws 15 are opened so that the core is set in the lower mold DL (SP4). Then, the base plate 13 is raised by the cylinder 14 (SP5).

Upon application of the powder mold wash, first, the coating box T, that is, the covering member 21, is raised by the cylinder device 25 (SP8) Then, as described earlier, the powder mold wash is applied to the inner surfaces of the upper mold (SP9), and the coating box T is then lowered by the cylinder device 25 (SP10).

Upon completion of the process of SP5 and the process of SP6, the positioning pin 17a is raised so that the positioning relationship between the core carriage BC and the lower mold DL is released (SP6). Thereafter, the core carriage BC is allowed to retreat, that is, shifted outward from the opened space K (SP7).

Here, the above-mentioned mold wash application process is not intended to be limited by the arrangement shown in Figures; and, for example, the direction of the spray nozzle 22 for spraying the powder mold wash is properly changed depending on the direction of the inner face of the casting mold to which the powder mold wash is applied. Moreover, the direction of the blow nozzle 23 is also appropriately changed by taking it into consideration the scattering effect of the powder mold wash. Furthermore, the coating box T, that is, the covering member 21, may be provided as an independent part separated from the core carriage BC.

As described above, after all the side molds DS have been supported onto the upper mold DU with all the side molds DS being set in a mold-closed state, the mold wash is applied to the inner faces of the side molds DS and the upper mold DU; therefore, different from the case in which at least one portion of the side molds is supported on the lower mold DL, it is not necessary to carry out the coating process of the mold wash twice in a separate manner. In other words, since the mold wash is applied to the inner faces of the upper mold DU and all the side molds DS by a coating process at one time, it is possible to improve the efficiency of the coating process.

In particular, in a state where the upper and lower molds DU/DL capable of separably joining to each other in the vertical direction are separated from each other, the mold wash applying means of the second carriage BC is allowed to shift into the opened space K of the two molds so as to apply the mold wash; therefore, it is possible to apply the mold wash by utilizing the mold-opening operation between the two main casting molds DU/DL.

Moreover, while the mold wash applying means is applying the mold wash to the inner faces of the upper mold DU and the side molds DS, the core is assembled in the lower mold DL; therefore, the applying process of the mold wash and the assembling process of the core both of which are carried out with respect to the casting mold can be executed in parallel with each other. Thus, it is possible to improve the production efficiency of the casting process as a whole.

After the above-mentioned coating process of the mold wash (step #8) and the core setting process (step #9) have been completed and after the second darriage BC has retreated (step #10), the upper mold DU is lowered toward the lower mold DL to form a closed state (step #11).

Then, at step #12, the inside of the holding furnace FH is pressurized so as to carry out a low-pressure casting. Referring to the flow chart of FIG. 35 and graphs of FIGS. 36 to 38, a detailed explanation will be given of the pressure control in this pressurizing process (step #12).

First, at step ST1, compressed air is supplied into the pressure room 20 through the air supply path 42 so that the molten metal inside the crucible 12 is raised, and the molten metal is supplied to the cavity 32 of the casting mold 30 through the stoke 22, thereby starting the casting as well as activating the timer 60 at step ST2.

Figure 36:
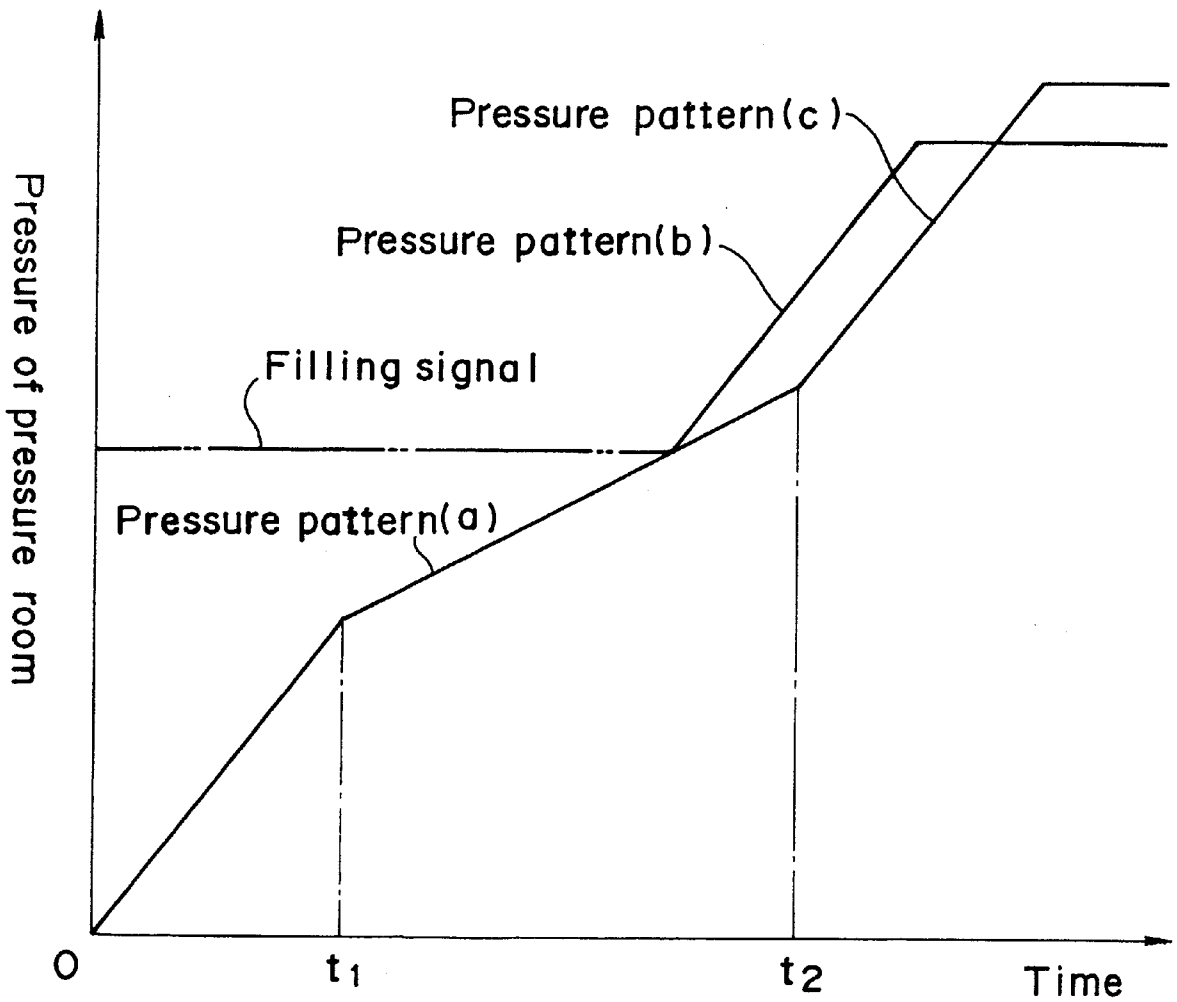
FIG. 36 is a pressure pattern diagram that shows a pressure control method in the low-pressure casting apparatus.

In this case, as shown in a pressure pattern (a) in FIG. 36, after starting the supply of the compressed air, until the predetermined time t1 required for the molten metal to reach the gate 40 of the casting mold 30 has elapsed, the pressure is abruptly raised so as to quickly push up the molten metal, thereby preventing the temperature of the molten metal from dropping. After the predetermined time t1 required for the molten metal to reach the gate 40 has elapsed, the pressure increasing rate is reduced so as to smoothly inject the molten metal between the sand cores.

Next, at step ST3, based upon the presence or absence of the filling signal, a judgment is made as to whether or not the filling detection sensor 58 has detected the filling of the molten metal, and if the filling detection sensor 58 has detected the filled state, the pressure inside the pressure room 20 is increased as shown by a pressure pattern (b) in FIG. 36 at step ST4, and since the filling detection sensor 58 is normally functioning, the timer 60 is stopped at step ST5.

Moreover, in the case when the filling detection sensor 58 does not detect the filled state of the molten metal at step ST3, upon receipt of an elapsed-time signal that is released from the timer 60 after the lapse of the predetermined time t2 since the start of the compressed air supply, the pressure inside the pressure room 20 is increased at step ST6, as shown by a pressure pattern (C) in FIG. 36. With this arrangement, even in the event of an erroneous detection in the filling detection sensor 58, the pressure inside the pressure room 20 can be increased after the lapse of the predetermined time t2 since the start of the compressed air supply; thus, it is possible to prevent defective products.

Next, at step ST7, the timer 30 is reset so as to be ready for the next casting process, and at step ST8, the casting process is complete.

Figure 37:
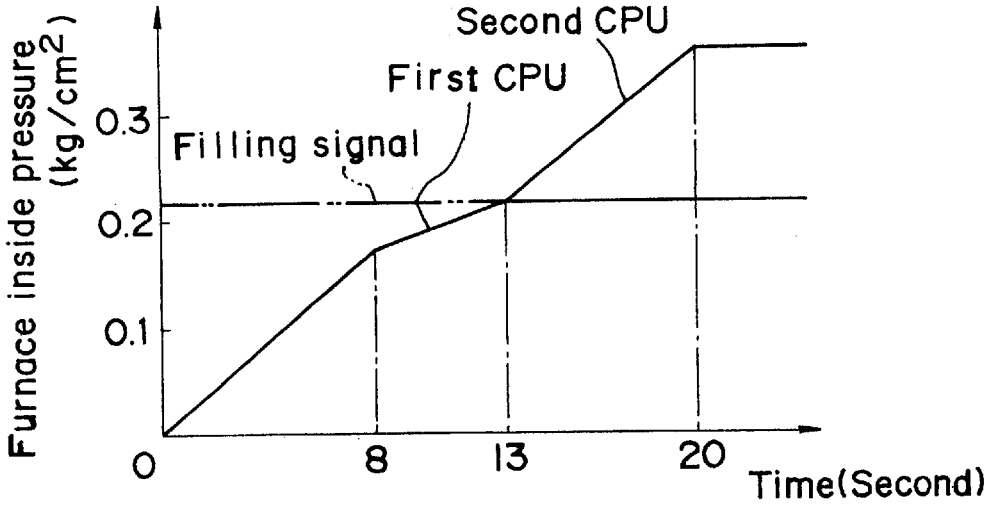
FIG. 37 is a pressure pattern diagram that shows a concrete example of the pressure control method in the low-pressure casting apparatus.

FIG. 37 shows a specific pressure pattern of the pressure control method in the present embodiment. In other words, simultaneously with the start of the pressure application to the pressure room 20, the first CPU 70 and the timer 60 are activated, and 8 seconds after the start of the pressure application, the first CPU 70 starts to decrease the pressure-increasing rate, and when the filling detection sensor 58 outputs the filling signal (normally, 13 seconds after the start of the pressure application), the first CPU 70 maintains the pressure at this time, while the second CPU 72 increases the pressure of the pressure room 20. When the pressure inside the pressure room 20 has reached a predetermined value (normally, 20 seconds after the start of the pressure application), the second CPU 72 also maintains the pressure at this time. In this case, after the lapse of 18 seconds since the start of the pressure application, the timer 60 outputs an ON signal, so as to activate the second CPU 72; thus, even in the event of an erroneous detection in the filling detection sensor 58, the second CPU 72 is activated 18 seconds after the start of the pressure application.

Figure 38:
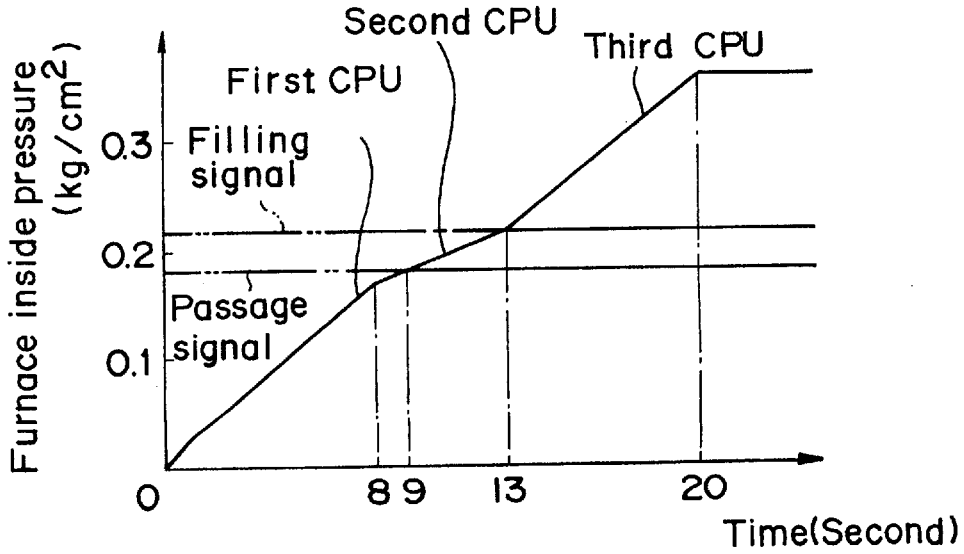
FIG. 38 is a pressure pattern diagram that shows a modified example of the pressure control method in the low-pressure casting apparatus.

Moreover, FIG. 38 shows a pressure pattern in a modified example of the above-mentioned pressure control method. In this modified example, a gate passage sensor, which outputs a passage signal when the molten metal passes through the gate 40, is installed in the lower mold 26 of the casting mold 30, and the third CPU is placed in addition to the first CPU 70 and the second CPU 72. Here, the following pressure application pattern is preset: When the gate passage sensor outputs the passage signal (normally, nine seconds after the start of the pressure application), the first CPU 70 maintains the pressure at this time, while the second CPU 72 increases the pressure inside the pressure room 20, and based upon the filling signal (normally, 13 seconds after the start of the pressure application), the second CPU 72 maintains the pressure at this time, while the third CPU increases the pressure inside the pressure room 20. In this case, the timer 60 is set in such a manner that the ON signal is outputted so as to activate the third CPU in response to either of the two cases that takes place earlier, that is, the lapse of 15 seconds from the pressure application, and the lapse of 5 seconds since the receipt of the passage signal from the gate passage sensor.

When the pressure pattern is set as shown by this modified example, an error occurring between the lapse of time and the degree of the rise of the molten metal is minimized, with the result that the third CPU can be activated 15 seconds after the pressure application; thus, since it can be activated earlier than the case as described in the aforementioned embodiment (18 seconds after the start of pressure application), it is possible to maintain high quality products even in the event of an erroneous detection in the filling detection sensor 58. Moreover, since the gate passage sensor is installed, the rate of pressure increase up to the passage of the molten metal through the gate 40 can be increased as compared with the aforementioned embodiment; therefore, it is possible to prevent a temperature drop of the molten metal. Moreover, although a gate passage sensor is required, a CPU having only simple functions may be used as the first CPU 70, which provides cost effectiveness.

As described above, in the above-mentioned low-pressure casting apparatus A, the variable pressure control means is operated so that in the case when the filling detection sensor is normal, the pressure pattern is changed by the filling signal and, in the case when the filling detection sensor fails to detect, it is changed by the elapsed-time signal; therefore, independent of the normal or abnormal of the filling detection sensor, the pressure pattern can be changed. Thus, even in the event of an erroneous detection in the filling detection sensor, it is possible to maintain the quality of the products above the permissible level, and consequently to prevent the generation of detective products.

After completion of the pressure process (step #12), or in the mid-course of the last stage of the step, the solidification of the molten metal after the casting is accelerated at step #13, and in order to properly maintain the temperature (mold temperature) of the casting mold D at the time of applying the mold wash to the casting mold D, a cooling process for cooling off the casting mold D to a temperature in a predetermined range is carried out. Thus, the casting process is completed, and the upper and lower molds DU/DL are opened (step #14), and the sequence returns to step #1, and the same casting cycle is repeated.

In the above-mentioned successive casting cycle, periods of time required for the respective processes are, for example, described as follows: The pressure process (step #12), which is the longest, lasts for approximately 200 seconds, the next cooling process (step #13) lasts for approximately 40 seconds, and the core setting process (step #9) lasts for approximately 20 seconds. Moreover, the processes other than these last for a total of approximately 60 to 70 seconds. Therefore, a time period of only approximately 60 to 70 seconds is left from the completion of the cooling process at step #13 to the mold wash application process (step #8).

In other words, in such a short interval of time, the cooling process for accelerating the solidification of the molten metal after casting has to be executed, and the cooling control for the casting mold so as to improve the adhering property (contacting property) of the mold wash also has to be executed. In this case, these control operations tend to interfere with each other, failing to provide appropriate cooling control operations.

Therefore, in the present embodiment, as described above, in the cooling process for accelerating the solidification of the molten metal after casting (step #13), the cooling means, placed on the core protrusions 111 and 112 of the upper mold DU, carries out a cooling control on the temperature of the upper mold DU in accordance with the temperature of the upper mold DU, by taking into consideration an optimal temperature range (for example, 260 to 320° C.) at the time of application of the mold wash to the upper mold DU, that is, more specifically, so as to set the temperature of the upper mold DU in a range of 260 to 320° C. Here, in the case of the lower mold DL having the gate Di, to which no mold wash is applied, the control range of the mold temperature is preferably set, for example, in a range of 450 to 510° C.

In other words, in the present embodiment, with respect to the upper mold DU, the cooling control for accelerating the solidification of the molten metal after casting is commonly utilized as the cooling control for the casting mold so as to improve the adhering property (contacting property) of the mold wash, which is carried out later (approximately, 60 to 70 seconds later).

In this manner, since the application of the mold wash is carried out in a state where the temperature of the upper mold DU is maintained in a predetermined temperature range, it is possible to carry out an appropriate application under a proper casting temperature; therefore, it becomes possible to improve the adhering property of the mold wash to the inner faces of the upper mold DU and the side molds DS.

Here, in the above-mentioned embodiment, the so-called twin-product casting mold D is used; however, the present invention is not intended to be limited by this, and is effectively applied to a normal single-product casting mold. Moreover, in the present embodiment, all the side molds DS are of the movable type; however, those of the fixed type, that is, those having one portion of the side molds fixed to the upper mold, may be used. Furthermore, the present embodiment has exemplified a case in which engine cylinder blocks are cast-molded; however, not limited to cylinder blocks, the present invention may be effectively applied to processes for cast-molding various other cast products.

Thus, the invention is not intended to be limited by the above-mentioned embodiment, and various modifications and changes in designing may of course be made within the scope of the present invention.

EFFECTS OF THE INVENTION

In the casting apparatus of a cylinder head in accordance with a first aspect of the present invention, the cooling means is attached to each of the core protrusions that are formed on the upper mold so as to form holes; therefore, it is possible to provide a proper directivity to the cooling process of the molten metal after casting process so as to forcefully cool the casting mold (upper mold) at the side farther from the gate and consequently to allow the molten metal to solidify starting from the farthest portion from the gates. Moreover, with respect to cooling means attached to the plurality of core protrusions corresponding to holes, those attached to the inner core protrusions comparatively closer to the center of the casting mold are designed so as to have a greater cooling capability than those attached to the outer core protrusions; therefore, with respect to the center portion and the outer portion of the casting mold cavity, it is possible to provide a proper directivity to a cooling process for the molten metal so as to allow the molten metal to gradually cool off, starting from the portion closest to the center.

In other words, upon solidifying the molten metal after the casting process, the solidification of the molten metal is accelerated by the application of the cooling means, and by utilizing the shape inherent to the cylinder head, it is possible not only to simply increase the solidifying rate, but also to carry out the cooling process with a proper directivity; thus, it becomes possible to effectively reduce the occurrence of problems such as gas defects, and consequently to obtain high quality cast products more stably.

Moreover, in accordance of a second aspect of the present invention, basically the same effects as the first aspect of the invention are obtained. In particular, a cooling medium of the cooling means attached to the core protrusions located inside is liquid and a cooling medium of the cooling means attached to the core protrusions located outside is gas; therefore, with respect to the cooling means attached to the plurality of core protrusions, by utilizing the difference in thermal conduction characteristics between liquid and gas, it is possible to positively provide such a setting that those attached to the inner core protrusions comparatively closer to the center of the mold have a greater cooling ability than those attached to the outer core protrusions comparatively closer to the periphery of the mold.

In accordance with a third aspect of the present invention, basically the same effects as the second aspect of the invention are obtained. In particular, a removing means is installed so as to remove residual cooling medium (that is, liquid) inside the core protrusions after stoppage of the cooling operation of the cooling means attached the protrusions; therefore, it is possible to positively prevent the liquid that has served as the cooling medium from residing inside the core protrusions in an uncontrollable state in its temperature, and consequently to prevent degradation in precision of the temperature control, when the cooling means in the protrusion is operated for the next cycle of casting operation. Moreover, it is also possible to prevent the generation of rust inside the protrusions.

In accordance with a fourth aspect of the present invention, basically the same effects as the first aspect of the inventions are obtained. In particular, the core protrusions correspond to at least a plug hole located comparatively closer to the center of the cylinder head and a bolt hole located comparatively closer to the periphery of the cylinder head; therefore, by utilizing the plug hole and the bolt hole inherent to the cylinder head, it is possible to carry out cooling and solidifying processes with an appropriate directivity on the molten metal after the casting process.

In accordance with the fifth aspect of the present invention, basically the same effects as the first aspect of the inventions are obtained. In particular, a spot cooling means, which restricts thermal conduction so as not to be exerted in any direction other than a specific direction, is installed at least in either the upper or lower mold; therefore, a specific portion of the molten metal inside the casting mold cavity is allowed to cool off and solidify with a directivity in a predetermined direction. Thus, it becomes possible to effectively reduce the possibility of problems such as gas defects, and consequently to provide high-quality cast products in a stable manner.

In accordance with the sixth aspect of the present invention, basically the same effects as the first aspect of the invention are obtained. In particular, of the first and second elongated cores, the second core is assembled in the casting mold with core prints thereof being supported by the core prints of the first core; therefore, since the two cores are integrally assembled in the casting mold through the respective core prints, the distance between the axes of the cores is more stably maintained at a fixed value as compared with the case in which the two cores are assembled in the casting mold in a separate manner. Thus, it becomes possible to positively control the thickness between the paths corresponding to the respective cores.

Moreover, the application of the above-mentioned arrangement enables the following processes: The two cores are preliminarily assembled integrally, and these assembled cores can be further assembled into the lower mold; thus, it is possible to reduce the number of assembling processes for cores, and in the case of an automatic assembling process, it is possible to reduce the number of actuators, and consequently to simplify the structure of a core assembling device.

In accordance with the seventh aspect of the present invention, basically the same effects as the sixth aspect of the invention are obtained. In particular, a suction means is installed so as to suck, through at least either of the core prints of the two cores, gas generated in the core or the other core at the time of a casting process; therefore, it is possible to forcefully suck gas generated inside the cores through the core print sections and readily release it outside the casting mold cavity. even though the cores have an elongated shape. Thus, it becomes possible to effectively prevent the resulting cast product from gas defects.

In this case, the two cores and are integrally assembled inside the casting mold through the core print portions and; therefore, even if one of the cores is virtually cut off from the suction means, the gas suction process is carried out through the core prints of the other core, it is possible to effectively discharge even gas generated in said one of the cores outside the casting mold.

In accordance with the eighth aspect of the present invention, basically the same effects as the first aspect of the invention are obtained. In particular, a plurality of side wall casting molds are supported by the upper casting mold, the side wall casting molds being placed in a manner so as to be switched between a mold-closed state for forming a sealed volume section and a mold-opened state for allowing the volume section to open; and under a condition that all the side wall casting molds are set in the moldclosed state, a mold wash is applied to inner faces of the side wall casting molds and the upper casting mold. Therefore, different from the case in which at least one portion of the side wall casting molds is supported on the lower casting mold in which the gate is formed, it is not necessary to divide the coating process of the mold wash into two processes. In other words, it is possible to apply the mold wash to the inner faces of the upper casting mold and all the side wall casting molds during one coating process, and consequently to improve the efficiency of the coating process.

In particular, in the case when, on the upper casting mold, a mold cooling means for cooling the casting mold in accordance to its temperature is installed, and under a condition that the upper casting mold is cooled to a temperature in a predetermined temperature range, the coating of the mold wash is carried out; therefore, it is possible to carry out the coating process at an appropriate temperature of the casting mold, and consequently to improve the adhering property of the mold wash to the inner face of the casting mold.

In the casting apparatus of a cylinder head in accordance with the ninth aspect of the present invention, a spot cooling means, which restricts thermal conduction so as not to be exerted in any direction other than a specific direction, is installed at least in either the upper or lower mold; therefore, a specific portion of the molten metal inside the casting mold cavity is allowed to cool off and solidify with a directivity in a predetermined direction. Thus, it becomes possible to effectively reduce the possibility of problems such as gas defects, and consequently to provide high-quality cast products in a stable manner.

In accordance with the tenth aspect of the present invention, basically the same effects as the ninth aspect of the invention are obtained. In particular, the spot cooling means is formed by installing a cooling medium path inside a cylinder member, with the cylinder member having one end face facing the inside of the casting-mold cavity; therefore, the molten metal in this portion is selectively cooled off under a proper directivity in the length direction of the cylinder member. Moreover, since the cylinder member has its peripheral portion fitted to the mounting hole formed in the mold, it is possible to change the thermal conduction property with this fitting portion serving as a border. For example, it becomes possible to easily provide such setting as to restrict thermal conduction so as not to be exerted in any direction other than the length direction of the cylinder member, by differentiating the materials of the cylinder member and the casting mold or installing a thermal insulating layer in the fitting section.

In accordance with the eleventh aspect of the present invention, basically the same effects as the ninth aspect of the invention are obtained. In particular, one portion of the side wall is formed by a sand wall, with the spot cooling means being installed in the vicinity of the sand wall; therefore, it is possible to forcefully cool the vicinity of the sand wall which has a low thermal conduction and is less susceptible to cooling, in a selected manner.

In accordance with the twelfth aspect of the present invention, basically the same effects as the ninth aspect of the invention are obtained. In particular, a molten metal supply section for supplying the molten metal to be injected into the casting mold cavity through the gate is installed below the lower mold; a predetermined space is formed between the molten metal supply section and the lower mold; a cooling medium path for the spot cooling means is placed in the space; and a communicating path for allowing the molten metal supply section to communicate with the gate is formed therein; therefore, it is possible to form the cooling medium path below the lower mold which normally makes it difficult to form a space therein, and consequently to easily install the spot cooling means on the lower mold side.

In the casting apparatus of a cylinder head in accordance with the thirteenth aspect of the present invention, on the upper mold side, cooling means is attached to each of the core protrusions that are formed on the upper mold; therefore, it is possible to provide a proper directivity to the cooling process of the molten metal after casting process so as to forcefully cool the casting mold (upper mold) at the side farther from the gate and consequently to allow the molten metal to solidify starting from the farthest portion from the gates. Moreover, with respect to cooling means attached to the plurality of core protrusions corresponding to holes, those attached to the inner core protrusions comparatively closer to the center of the casting mold are designed so as to have a greater cooling capability than those attached to the outer core protrusions; therefore, with respect to the center portion and the outer portion of the casting mold cavity, it is possible to provide a proper directivity to a cooling process for the molten metal so as to allow the molten metal to gradually cool off, starting from the portion closest to the center.

Moreover, a spot cooling means, which restricts thermal conduction so as not to be exerted in any direction other than a specific direction, is installed in the lower mold; therefore, a specific portion of the molten metal inside the casting mold cavity is allowed to cool off and solidify under a directivity in a predetermined direction from the lower mold side.

In other words, upon solidifying the molten metal after the casting process, the solidification of the molten metal is accelerated by the application of the cooling means, and by utilizing the shape inherent to the cylinder head, it is possible not only to simply increase the solidifying rate, but also to carry out the cooling process with a proper directivity; thus, it becomes possible to effectively reduce the occurrence of problems such as gas defects, and consequently to obtain high quality cast products more stably.

In the casting method for a cylinder head in accordance with the fourteenth aspect of the present invention, the cooling means is attached to each of the core protrusions that are formed on the upper mold so as to form holes; therefore, it is possible to provide a proper directivity to the cooling process of the molten metal after casting process so as to forcefully cool the casting mold (upper mold) at the side farther from the gate and consequently to allow the molten metal to solidify starting from the farthest portion from the gates. Moreover, with respect to cooling means attached to the plurality of core protrusions corresponding to holes, those attached to the inner core protrusions comparatively closer to the center of the casting mold are designed so as to have a greater cooling capability than those attached to the outer core protrusions; therefore, with respect to the center portion and the outer portion of the casting mold cavity, it is possible to provide a proper directivity to a cooling process for the molten metal so as to allow the molten metal to gradually cool off, starting from the. portion closest to the center.

In other words, upon solidifying the molten metal after the casting process, the solidification of the molten metal is accelerated by the application of the cooling means, and by utilizing the shape inherent to the cylinder head, it is possible not only to simply increase the solidifying rate, but also to carry out the cooling process with a proper directivity; thus, it becomes possible to effectively reduce the occurrence of problems such as gas defects, and consequently to obtain high quality cast products more stably.

In accordance with the fifteenth aspect of the present invention, basically the same effects as the fourteenth aspect of the inventions are obtained. In particular, a spot cooling means, which restricts thermal conduction so as not to be exerted in any direction other than a specific direction, is installed at least in either the upper or lower mold; therefore, a specific portion of the molten metal inside the casting mold cavity is allowed to cool off and solidify with a directivity in a predetermined direction. Thus, it becomes possible to effectively reduce the possibility of problems such as gas defects, and consequently to provide high-quality cast products in a stable manner.

In accordance with the sixteenth aspect of the present invention, basically the same effects as the fourteenth aspect of the invention are obtained. In particular, of the first and second elongated cores, the second core is assembled in the casting mold with core prints thereof being supported by the core prints of the first core; therefore, since the two cores are integrally assembled in the casting mold through the respective core prints, the distance between the axes of the cores is more stably maintained at a fixed value as compared with the case in which the two cores are assembled in the casting mold in a separate manner. Thus, it becomes possible to positively control the thickness between the paths corresponding to the respective cores.

Moreover, the application of the above-mentioned arrangement enables the following processes: The two cores are preliminarily assembled integrally, and these assembled cores can be further assembled into the lower mold; thus, it is possible to reduce the number of assembling processes for cores, and in the case of an automatic assembling process, it is possible to reduce the number of actuators, and consequently to simplify the structure of a core assembling device.

In accordance with the seventeenth aspect of the present invention, basically the same effects as the sixteenth aspect of the invention are obtained. In particular, a suction means is installed so as to suck, through at least either of the core prints of the two cores, gas generated in the core or the other core at the time of a casting process; therefore, it is possible to forcefully suck gas generated inside the cores through the core print sections and readily release it outside the casting mold cavity. even though the cores have an elongated shape. Thus, it becomes possible to effectively prevent the resulting cast product from gas defects.

In this case, the two cores and are integrally assembled inside the casting mold through the core print portions and; therefore, even if one of the cores is virtually cut off from the suction means, the gas suction process is carried out through the core prints of the other core, it is possible to effectively discharge even gas generated in said one of the cores outside the casting mold.

In accordance with the eighteenth aspect of the present invention, basically the same effects as the fourteenth aspect of the invention are obtained. In particular, a plurality of side wall casting molds are supported by the upper casting mold, the side wall casting molds being placed in a manner so as to be switched between a mold-closed state for forming a sealed volume section and a mold-opened state for allowing the volume section to open; and under a condition that all the side wall casting molds are set in the mold-closed state, a mold wash is applied to inner faces of the side wall casting molds and the upper casting mold. Therefore, different from the case in which at least one portion of the side wall casting molds is supported on the lower casting mold in which the gate is formed, it is not necessary to divide the coating process of the mold wash into two processes. In other words, it is possible to apply the mold wash to the inner faces of the upper casting mold and all the side wall casting molds during one coating process, and consequently to improve the efficiency of the coating process.

In particular, in the case when, on the upper casting mold, a mold cooling means for cooling the casting mold in accordance to its temperature is installed, and under a condition that the upper casting mold is cooled to a temperature in a predetermined temperature range, the coating of the mold wash is carried out; therefore, it is possible to carry out the coating process at an appropriate temperature of the casting mold, and consequently to improve the adhering property of the mold wash to the inner face of the casting mold.

In the casting method for a cylinder head in accordance with the nineteenth aspect of the present invention, a spot cooling means, which restricts thermal conduction so as not to be exerted in any direction other than a specific direction, is installed at least in either the upper or lower mold; therefore, a specific portion of the molten metal inside the casting mold cavity is allowed to cool off and solidify with a directivity in a predetermined direction. Thus, it becomes possible to effectively reduce the possibility of problems such as gas defects, and consequently to provide high-quality cast products in a stable manner.

In the casting method for a cylinder head in accordance with the twentieth aspect of the present invention, on the upper mold side, cooling means is attached to each of the core protrusions that are formed on the upper mold; therefore, it is possible to provide a proper directivity to the cooling process of the molten metal after casting process so as to forcefully cool the casting mold (upper mold) at the side farther from the gate and consequently to allow the molten metal to solidify starting from the farthest portion from the gates. Moreover, with respect to cooling means attached to the plurality of core protrusions corresponding to holes, those attached to the inner core protrusions comparatively closer to the center of the casting mold are designed so as to have a greater cooling capability than those attached to the outer core protrusions; therefore, with respect to the center portion and the outer portion of the casting mold cavity, it is possible to provide a proper directivity to a cooling process for the molten metal so as to allow the molten metal to gradually cool off, starting from the portion closest to the center.

Moreover, a spot cooling means, which restricts thermal conduction so as not to be exerted in any direction other than a specific direction, is installed in the lower mold; therefore, a specific portion of the molten metal inside the casting mold cavity is allowed to cool off and solidify under a directivity in a predetermined direction from the lower mold side.

In other words, upon solidifying the molten metal after the casting process, the solidification of the molten metal is accelerated by the application of the cooling means, and by utilizing the shape inherent to the cylinder head, it is possible not only to simply increase the solidifying rate, but also to carry out the cooling process with a proper directivity; thus, it becomes possible to effectively reduce the occurrence of problems such as gas defects, and consequently to obtain high quality cast products more stably.

What is claimed is:

1. A casting apparatus of a cylinder head, which comprises a pair of upper and lower molds that are separably joined to each other and which cast-molds a cylinder head of an engine by injecting molten metal into a casting mold cavity formed between the two molds so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold.

2. The casting apparatus of a cylinder head according to claim 1, wherein a cooling medium of the cooling means attached to the inner core protrusions is liquid and a cooling medium of the cooling means attached to the outer core protrusions is gas.

3. The casting apparatus of a cylinder head according to claim 2, wherein a removing means is installed so as to remove residual cooling medium inside the core protrusions after stoppage of the cooling operation of the cooling means attached the inner core protrusions.

4. The casting apparatus of a cylinder head according to claim 1, wherein the core protrusions correspond to at least a plug hole located comparatively closer to the center of the cylinder -head and a bolt hole located comparatively closer to the periphery of the cylinder head.

5. A casting apparatus of a cylinder head according to claim 1, wherein side walls are provided so as to form a casting mold cavity with the upper and lower molds, and a spot cooling means, which restricts thermal conduction so as not to be exerted in any direction other than a specific direction, is installed at least in either the upper or lower mold.

6. The casting apparatus of a cylinder head according to claim 1, wherein first and second elongated cores are to be assembled in a mold before molten metal is injected into a casting mold cavity, wherein core prints are placed on both ends of each of the two cores; the first core is assembled in the casting mold through the core prints; and the second core is assembled in the casting mold with core prints thereof being supported by the core prints of the first core.

7. The casting apparatus of a cylinder head according to claim 6, wherein a suction means is installed so as to suck, through at least either of the core prints of the two cores, gas generated in the core or the other core at the time of a casting process.

8. The casting apparatus of a cylinder head according to claim 1, wherein side wall casting molds which form the side walls are supported by the upper mold; a mold cooling means is installed on the upper mold so as to cool the mold in accordance with the temperature thereof; the side wall casting molds are installed in a manner so as to be switched between a mold-closed state for forming a sealed volume section and a mold-opened state for allowing the volume section to open; and under conditions that all the side wall casting molds are set in the mold-closed state and that the upper mold is cooled to a temperature in a predetermined temperature range, a mold wash is applied to inner faces of the side wall casting molds and the upper mold.

9. A casting apparatus of a cylinder head, which comprises a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold, and in that a spot cooling means, which restricts thermal conduction so as not to be exerted in any direction other than a specific direction, is installed in the-lower mold.

10. A casting method for a cylinder head, which comprises the steps of preparing a pair of upper and lower molds that are separably joined to each other and cast-molding a cylinder head of an engine by injecting molten metal into a casting mold cavity formed between the two molds so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold.

11. A casting method for a cylinder head according to claim 10, wherein side walls are provided so as to form a casting mold cavity with the upper and lower molds, and a spot cooling means, which restricts thermal conduction so as not to be exerted in any direction other than a specific direction, is installed at least in either the upper or lower mold.

12. The casting method for a cylinder head according to claim 10, wherein first and second elongated cores are to be assembled in a mold before molten metal is injected into a casting mold cavity, wherein core prints are placed on both ends of each of the two cores; the first core is assembled in the casting mold through the core prints; and the second core is assembled in the casting mold with core prints thereof being supported by the core prints of the first core.

13. The casting method for a cylinder head according to claim 12, wherein a suction means is installed so as to suck, through at least either of the core prints of the two cores, gas generated in the core or the other core at the time of a casting process.

14. The casting method for a cylinder head according to claim 10, wherein side wall casting molds which form the side walls are supported by the upper mold; a mold cooling means is installed on the upper mold so as to cool the mold in accordance with the temperature thereof; the side wall casting molds are installed in a manner so as to be switched between a mold-closed state for forming a sealed volume section and a mold-opened state for allowing the volume section to open; and under conditions that all the side wall casting molds are set in the mold-closed state and that the upper mold is cooled to a temperature in a predetermined temperature range, a mold wash is applied to inner faces of the side wall casting molds and the upper mold.

15. A casting method for a cylinder head, which comprises the step of preparing a pair of upper and lower molds that are separably joined to each other and side walls, and which cast-molds a cylinder head of an engine by injecting molten metal into a casting mold cavity formed by the two molds and the side walls so as to fill it with the molten metal to be solidified, through a gate formed in the lower mold, wherein a plurality of core protrusions corresponding to holes are formed on the upper mold with cooling means being attached to each of the core protrusions, the cooling means attached to inner core protrusions comparatively closer to the center of the mold being designed so as to have a greater cooling capability than those attached to outer core protrusions comparatively closer to the periphery of the mold, and in that a spot cooling means, which restricts thermal conduction so as not to be exerted in any direction other than a specific direction, is installed in the lower mold.

* * * * *